US010897992B2

(12) United States Patent
Vandenham et al.

(10) Patent No.: US 10,897,992 B2
(45) Date of Patent: Jan. 26, 2021

(54) STORAGE APPARATUS

(71) Applicant: NewAge Products Inc., Vaughan (CA)

(72) Inventors: Robert Vandenham, North York (CA); Mitch Harder, Toronto (CA); Margaret Shatara, North York (CA)

(73) Assignee: NewAge Products Inc., Vaughan (CA)

( * ) Notice: Subject to any disclaimer, the term of this patent is extended or adjusted under 35 U.S.C. 154(b) by 0 days.

(21) Appl. No.: 16/124,777

(22) Filed: Sep. 7, 2018

(65) Prior Publication Data

US 2020/0077791 A1 Mar. 12, 2020

(51) Int. Cl.

| | |
|---|---|
| ***A47B 43/00*** | (2006.01) |
| ***A47F 5/08*** | (2006.01) |
| ***A47F 5/01*** | (2006.01) |

(52) U.S. Cl.

CPC ..... *A47B 43/006* (2013.01); *A47F 5/01* (2013.01); *A47F 5/0892* (2013.01)

(58) Field of Classification Search

CPC ..... A47B 43/006; A47B 55/02; A47B 96/063; A47F 5/0892; A47F 5/01

See application file for complete search history.

(56) References Cited

U.S. PATENT DOCUMENTS

| | | | | |
|---|---|---|---|---|
| 478,805 | A | 7/1892 | Munson | |
| 493,596 | A * | 3/1893 | McLaren | A47B 46/005 211/117 |
| 557,567 | A | 4/1896 | Eddy | |
| 579,584 | A | 3/1897 | Jessup | |
| 587,945 | A | 8/1897 | Elliott | |
| 588,542 | A | 8/1897 | Williams | |
| 590,773 | A | 9/1897 | Pruden | |

(Continued)

FOREIGN PATENT DOCUMENTS

| | | | |
|---|---|---|---|
| DE | 10028876 | C1 | 7/2001 |
| EP | 0154704 | A2 | 9/1985 |

(Continued)

OTHER PUBLICATIONS

Allied Tube & Conduit Inc.., "Webpage—Off-The-Floor Garage Storage Systems", 2003, downloaded from www.offthefloor.com, 3 pages.

(Continued)

*Primary Examiner* — Stanton L Krycinski

(74) *Attorney, Agent, or Firm* — Howard & Howard Attorneys PLLC

(57) ABSTRACT

A storage apparatus includes a support beam defining a beam axis and adapted to be coupled to a surface. The support beam has first and second beam ends a plurality of mounting positions between the beam ends. The storage apparatus further includes a support structure abutting and being supported by the support beam, an alignment device attached to the support beam, and a cable having a first cable end adapted to be attached to the surface and a second cable end removably attached to the support beam at a selected mounting position. The cable is coupled to the alignment device to align the second cable end with the support beam and the selected mounting position, and is movable along the alignment device to move the second cable end from the selected mounting position to another mounting position for adjusting the support structure relative to the surface.

33 Claims, 39 Drawing Sheets

(56) References Cited

U.S. PATENT DOCUMENTS 608,393 A 8/1898 Jackson et al.
610,656 A 9/1898 Martin
611,856 A 10/1898 Brown et al.
624,231 A 5/1899 Martin
653,386 A 7/1900 Hunter
706,718 A 8/1902 Bradbury
1,066,371 A * 7/1913 Bosworth ..... A47F 5/0892 211/117
1,202,166 A * 10/1916 Corbett ..... A47F 5/0892 211/117
1,211,286 A * 1/1917 Carney ..... A47B 43/006 108/164
1,599,653 A * 9/1926 Cranston ..... A47B 96/028 108/185
2,057,092 A 10/1936 Geib
2,205,193 A * 6/1940 Goldman ..... A47B 43/006 108/135
2,556,105 A * 6/1951 Smith ..... A47B 43/006 108/106
2,559,322 A 7/1951 Skamser
2,970,702 A 2/1961 Maslow
2,998,886 A * 9/1961 Sides ..... A47F 5/01 211/133.5
3,139,045 A 6/1964 Rojakovick
3,188,039 A 6/1965 Krohn
3,190,604 A 6/1965 Jorgensen et al.
3,282,547 A * 11/1966 Ables ..... A47B 43/006 248/546
3,643,607 A * 2/1972 MacKenzie ..... A47B 96/025 108/180
3,724,078 A * 4/1973 Carlin ..... A63B 9/00 52/177
3,735,951 A 5/1973 Reed
3,770,133 A 11/1973 Kolker
3,771,466 A 11/1973 Ferdinand et al.
3,782,559 A 1/1974 Wright
3,837,609 A 9/1974 Weiss et al.
3,872,972 A 3/1975 Cummins et al.
3,924,751 A 12/1975 Ballenger
3,945,462 A 3/1976 Griswold
3,986,462 A * 10/1976 Heft ..... A47B 96/02 108/188
3,993,002 A 11/1976 Stroh
4,064,994 A 12/1977 Ondrasik, II
4,116,341 A 9/1978 Hebda
4,142,705 A 3/1979 Miller
4,157,070 A 6/1979 Huempfner et al.
4,167,908 A 9/1979 Jones et al.
4,187,787 A 2/1980 Nakatsu
4,316,544 A 2/1982 Goldstein
4,352,432 A 10/1982 Smith
4,392,572 A 7/1983 Bernard
4,441,583 A 4/1984 Vaught
4,523,526 A * 6/1985 O'Neill ..... A47B 43/006 108/149
4,552,270 A 11/1985 Lentz et al.
4,589,351 A * 5/1986 Love ..... A47B 43/006 108/105
4,630,423 A 12/1986 Lind
4,650,144 A 3/1987 Conrad
4,700,845 A 10/1987 Fretter
4,813,550 A 3/1989 Saeks
4,830,196 A 5/1989 Csanady
4,840,278 A 6/1989 Gelinas
4,955,490 A * 9/1990 Schafer ..... A47B 57/581 211/187
4,974,523 A * 12/1990 Giarratana ..... A47B 43/006 108/42
5,027,959 A 7/1991 Luukkonen
5,052,648 A 10/1991 Landau
5,074,419 A 12/1991 Smith
5,078,276 A 1/1992 Rogge et al.
5,082,120 A 1/1992 Vega
5,082,123 A 1/1992 Lamb
5,086,930 A 2/1992 Saeks
D326,579 S 6/1992 Leeds
5,125,517 A 6/1992 Martinell
5,176,266 A * 1/1993 Gillet ..... A47B 43/006 108/106
5,240,122 A 8/1993 Arnold
5,246,120 A 9/1993 Walker
5,292,009 A 3/1994 Smith
5,332,104 A 7/1994 Santella
5,351,926 A 10/1994 Moses
5,354,035 A 10/1994 Helgren
5,384,937 A 1/1995 Simon
5,427,344 A 6/1995 Beauchemin
5,460,274 A 10/1995 Kramer
5,474,189 A 12/1995 Peterson
5,702,007 A 12/1997 Fritz et al.
5,725,293 A 3/1998 Wilkening et al.
5,737,801 A 4/1998 Flood
5,749,479 A 5/1998 Belokin et al.
5,772,048 A 6/1998 Sopcisak
5,779,068 A * 7/1998 Whiten ..... A47B 43/006 108/107
5,794,793 A 8/1998 Frederick
5,848,708 A 12/1998 Edwards
5,871,070 A 2/1999 Contreras
D406,972 S 3/1999 McCoy
D416,152 S 11/1999 Payne et al.
5,984,111 A 11/1999 Pennella
6,015,127 A 1/2000 Carr
6,016,928 A 1/2000 Cothran et al.
6,050,426 A 4/2000 Leurdijk
6,061,884 A 5/2000 Ohms et al.
6,095,344 A 8/2000 White
6,109,461 A 8/2000 Kluge et al.
6,116,164 A * 9/2000 Justen, Jr. ..... A47B 43/006 108/42
6,145,678 A 11/2000 Morrison
6,161,702 A 12/2000 Campbell
6,161,709 A 12/2000 Kluge et al.
6,179,136 B1 1/2001 Kluge et al.
6,182,836 B1 2/2001 Gutierrez
6,189,527 B1 2/2001 Walsh et al.
6,224,029 B1 * 5/2001 Marble ..... A47B 43/006 248/214
6,247,871 B1 6/2001 Nickel et al.
6,286,691 B1 9/2001 Oberhaus et al.
6,299,001 B1 10/2001 Frolov et al.
6,311,626 B1 11/2001 Roberts
6,332,597 B1 12/2001 Korcz et al.
6,409,031 B1 6/2002 Wynne
D459,926 S 7/2002 Mikich et al.
6,435,105 B1 8/2002 Mikich et al.
D470,353 S 2/2003 Mikich et al.
6,550,878 B2 4/2003 Nott et al.
D477,957 S 8/2003 Mikich et al.
6,715,427 B2 4/2004 Mikich et al.
6,725,608 B1 4/2004 Kraus
6,814,418 B2 * 11/2004 D'Orso ..... A47B 61/04 108/149
6,883,513 B2 4/2005 Bock
6,935,600 B1 * 8/2005 Barrepski ..... A47B 43/006 108/42
7,000,783 B2 2/2006 Webb
D516,348 S 3/2006 Satterthwaite
7,021,476 B2 4/2006 Lloyd et al.
D525,811 S 8/2006 Nawrocki
D526,519 S 8/2006 Nawrocki
7,128,225 B2 10/2006 Saltzburg et al.
7,150,449 B1 12/2006 Dueck et al.
7,150,591 B1 12/2006 Kent
7,152,535 B2 12/2006 Mikich et al.
7,165,684 B2 1/2007 Ferron
7,225,933 B1 6/2007 Pollock et al.
7,228,669 B1 6/2007 Yaraschefski
7,252,202 B2 8/2007 Saltzberg et al.
7,255,237 B2 8/2007 Stitchick et al.
D553,401 S 10/2007 Peddycord
7,320,453 B2 1/2008 Berlyn et al.
7,357,262 B2 4/2008 Fratilla

(56) References Cited

U.S. PATENT DOCUMENTS

| | | | | |
|---|---|---|---|---|
| 7,421,957 | B2 | 9/2008 | Baez | |
| 7,494,110 | B2 | 2/2009 | Lob et al. | |
| 7,543,538 | B2 | 6/2009 | Baez | |
| D597,354 | S | 8/2009 | Liss | |
| 7,604,131 | B1 | 10/2009 | Clark et al. | |
| 7,669,822 | B2 | 3/2010 | Kluge et al. | |
| 7,740,143 | B2 * | 6/2010 | White | A47B 43/006 211/85.7 |
| 7,770,419 | B2 | 8/2010 | Stone | |
| 7,810,438 | B2 | 10/2010 | Ryberg | |
| 7,815,055 | B2 | 10/2010 | Lang | |
| D637,427 | S | 5/2011 | Troyner et al. | |
| 7,967,155 | B2 | 6/2011 | Klingspor | |
| 8,066,131 | B2 | 11/2011 | Mansor et al. | |
| D653,064 | S | 1/2012 | Lutt | |
| 8,117,970 | B1 | 2/2012 | Baez | |
| 8,132,764 | B2 | 3/2012 | Kuipers | |
| 8,245,651 | B1 | 8/2012 | Mikich et al. | |
| 8,356,720 | B2 * | 1/2013 | Mathews | A47B 43/006 108/149 |
| 8,371,458 | B2 | 2/2013 | Yu | |
| 8,480,047 | B2 * | 7/2013 | Sloan | A47B 43/003 248/243 |
| 8,511,486 | B2 | 8/2013 | Mansor | |
| 8,602,365 | B2 | 12/2013 | Neace | |
| 8,651,294 | B2 | 2/2014 | Mansor et al. | |
| 8,656,842 | B1 | 2/2014 | McDonley | |
| 8,657,130 | B2 * | 2/2014 | Thrush | A47F 5/08 211/117 |
| 8,794,454 | B2 | 8/2014 | Bleazard | |
| 8,827,232 | B2 | 9/2014 | Crowley | |
| 8,893,899 | B1 | 11/2014 | Hund | |
| 8,893,900 | B2 | 11/2014 | Kedar | |
| 8,960,457 | B2 | 2/2015 | Brisendine | |
| 8,985,344 | B2 | 3/2015 | Larson | |
| 9,010,553 | B2 | 4/2015 | Crowley | |
| 9,228,756 | B2 | 1/2016 | Crowley | |
| D753,420 | S | 4/2016 | Cheng | |
| 9,375,102 | B2 * | 6/2016 | Troyner | A47B 47/021 |
| 9,420,884 | B2 * | 8/2016 | Newman | A47B 55/02 |
| 9,447,914 | B2 | 9/2016 | Neace | |
| 9,572,427 | B2 | 2/2017 | Klooth | |
| D781,063 | S | 3/2017 | Shah et al. | |
| 9,629,455 | B2 | 4/2017 | Shah et al. | |
| 9,635,940 | B2 * | 5/2017 | Letham | A47B 81/00 |
| 9,669,907 | B2 * | 6/2017 | Field | B63B 35/7946 |
| 9,737,136 | B1 * | 8/2017 | Toland | A47B 23/007 |
| 9,737,140 | B2 * | 8/2017 | Bondi | A47B 51/00 |
| 9,745,542 | B2 | 8/2017 | Kimmel et al. | |
| 9,877,600 | B1 * | 1/2018 | Lin | A47B 5/00 |
| 9,888,772 | B2 | 2/2018 | Quinto et al. | |
| 9,924,697 | B1 | 3/2018 | Koskey, Jr. | |
| 2001/0026543 | A1 | 10/2001 | Hwang et al. | |
| 2002/0023888 | A1 | 2/2002 | Wynne et al. | |
| 2003/0164347 | A1 | 9/2003 | Bouvier | |
| 2004/0050807 | A1 | 3/2004 | Cheng | |
| 2004/0149878 | A1 | 8/2004 | Gierke et al. | |
| 2004/0182291 | A1 | 9/2004 | Mikich et al. | |
| 2004/0226899 | A1 | 11/2004 | Ferron | |
| 2005/0098511 | A1 | 5/2005 | Webb | |
| 2006/0180554 | A1 | 8/2006 | Lang | |
| 2007/0007223 | A1 | 1/2007 | Thrush et al. | |
| 2007/0108357 | A1 | 5/2007 | Plowman | |
| 2007/0119805 | A1 | 5/2007 | Nawrocki | |
| 2007/0138357 | A1 | 6/2007 | Carroll | |
| 2007/0205169 | A1 | 9/2007 | Fratilla | |
| 2008/0087787 | A1 * | 4/2008 | Baumer | A47B 43/006 248/324 |
| 2009/0108160 | A1 | 4/2009 | Kluge et al. | |
| 2009/0278004 | A1 | 11/2009 | Eustace et al. | |
| 2011/0062301 | A1 | 3/2011 | Sloan | |
| 2011/0182704 | A1 | 7/2011 | Mansor | |
| 2011/0198307 | A1 | 8/2011 | Mansor et al. | |
| 2012/0103923 | A1 | 5/2012 | Mansor et al. | |
| 2012/0145659 | A1 | 6/2012 | Mansor | |
| 2012/0181240 | A1 | 7/2012 | Crowley | |
| 2013/0228536 | A1 | 9/2013 | Crowley | |
| 2013/0270201 | A1 | 10/2013 | Vineyard | |
| 2013/0327802 | A1 | 12/2013 | Hammond | |
| 2013/0334150 | A1 | 12/2013 | Watson | |
| 2014/0014607 | A1 | 1/2014 | Mikich et al. | |
| 2014/0138334 | A1 | 5/2014 | Mansor | |
| 2014/0151315 | A1 | 6/2014 | Mansor | |
| 2014/0312200 | A1 | 10/2014 | Crowley | |
| 2015/0014886 | A1 | 1/2015 | Mullaney | |
| 2015/0060374 | A1 | 3/2015 | Mansor | |
| 2015/0226451 | A1 | 8/2015 | Crowley | |
| 2015/0305494 | A1 | 10/2015 | Shah | |
| 2017/0224105 | A1 | 8/2017 | Klooth | |

FOREIGN PATENT DOCUMENTS

| | | | |
|---|---|---|---|
| EP | 0206994 | A1 | 12/1986 |
| FR | 2191426 | A5 | 2/1974 |
| FR | 2526648 | A1 | 11/1983 |
| GB | 222248 | A | 10/1924 |
| GB | 1045379 | A | 10/1966 |
| JP | H04339760 | A | 11/1992 |
| JP | H08168416 | A | 7/1996 |
| JP | H08254039 | A | 10/1996 |
| JP | H10179299 | A | 7/1998 |
| WO | 9116837 | A1 | 11/1991 |
| WO | 0232257 | A1 | 4/2002 |
| WO | 2005074747 | A1 | 8/2005 |

OTHER PUBLICATIONS

Amazon.com, "Eramaix Ceiling Mounted Storage Overhead Garage Heavy Duty Height Adjustable Hanging Rack 4'x8'", downloaded from www.amazon.com/Ceiling-Mounted-Storage-Overhead-Adjustable/dp/B073Z7YZ29/ref=sr_1 . . . , 2017, 5 pages.

Amazon.com, "Goplus Overhead Garage Storage Rack Heavy Duty Adjustable Ceiling Storage Rack (4'x8')", downloaded from www.amazon.com/Goplus-Overhead-Storage_Adjustable_Ceiling/dp/B071JDZC4J/ref=sr_1_1 . . . , 2017, 2 pages.

Computer-generated English language abstract for WO9116837A1 extracted from espacenet.com database on Nov. 26, 2018, 2 pages.

Computer-generated English language translation for FR2191426A5 extracted from espacenet.com database on Nov. 26, 2018, 6 pages.

English language abstract for DE10028876C1 extracted from espacenet.com database on Nov. 26, 2018, 1 page.

English language abstract for EP0206994A1 extracted from espacenet.com database on Nov. 26, 2018, 2 pages.

English language abstract for FR2526648A1 extracted from espacenet.com database on Nov. 26, 2018, 1 page.

English language abstract for JPH04339760A extracted from espacenet.com database on Nov. 26, 2018, 1 page.

English language abstract for JPH08168416A extracted from espacenet.com database on Nov. 26, 2018, 1 page.

English language abstract for JPH08254039A extracted from espacenet.com database on Nov. 26, 2018, 1 page.

English language abstract for JPH10179299A extracted from espacenet.com database on Nov. 26, 2018, 1 page.

Goplus Corp., "Overhead Storage Rack Install Instructions", 2017, 6 pages.

Hyloft USA, LLC, "Webpage—Hyloft Overhead Storage Units", 2001, downloaded from www.hyloftusa.com, 4 pages.

Newage Products Inc., "Install Instructions for Versarac", Apr. 3, 2014, 14 pages.

Newage Products Inc., "Sample Packaging for Grey—4'x4' Overhead Rack", SKU: 40144-77744, Box 1 of 1, Apr. 3, 2014, 1 page.

Newage Products Inc., "Sample Packaging for Grey—4'x8' Overhead Rack", SKU: 40148-77748, Box 1 of 2, Apr. 3, 2014, 1 page.

Newage Products Inc., "Sample Packaging for Grey—4'x8' Overhead Rack", SKU: 40148-77748, Box 2 of 2, Apr. 3, 2014, 1 page.

Off The Floor, "Web pages from Internet URL page www.offthefloor.com", 3 pages.

(56) References Cited

OTHER PUBLICATIONS

Onrax Overhead Storage Racks, "Webpage—Overhead Storage Racks", 2003, downloaded from www.onrax.com, 5 pages.
Sam's Club, "Garage Shelving Webpages", http://www.samsclub.com/sams/garage-shelving/1067.cp, Nov. 2013, 6 pages.
Sam's Club, "NewAge Products—Ceiling Storage Rack 4'x8' Gray Item No. 252034/Model #40148", Nov. 2013, 2 pages.
Store More Shelving, "Web pages from Internet URL page www.storemoreshelving.com", Dec. 6, 2013, 4 pages.
The Home Depot, "Husky Overhead Celing Mount Storage", downloaded from www.homedepot.com/p/Husky-Overhead-Ceiling-Mount-Storage-Rack-ACR4896B/303493157, 3 pages.
The Uncluttered Garage, "Webpage—Tuffrax", Jan. 10, 2005, downloaded from www.unclutteredgarageh.com/index.html, 5 pages.

* cited by examiner

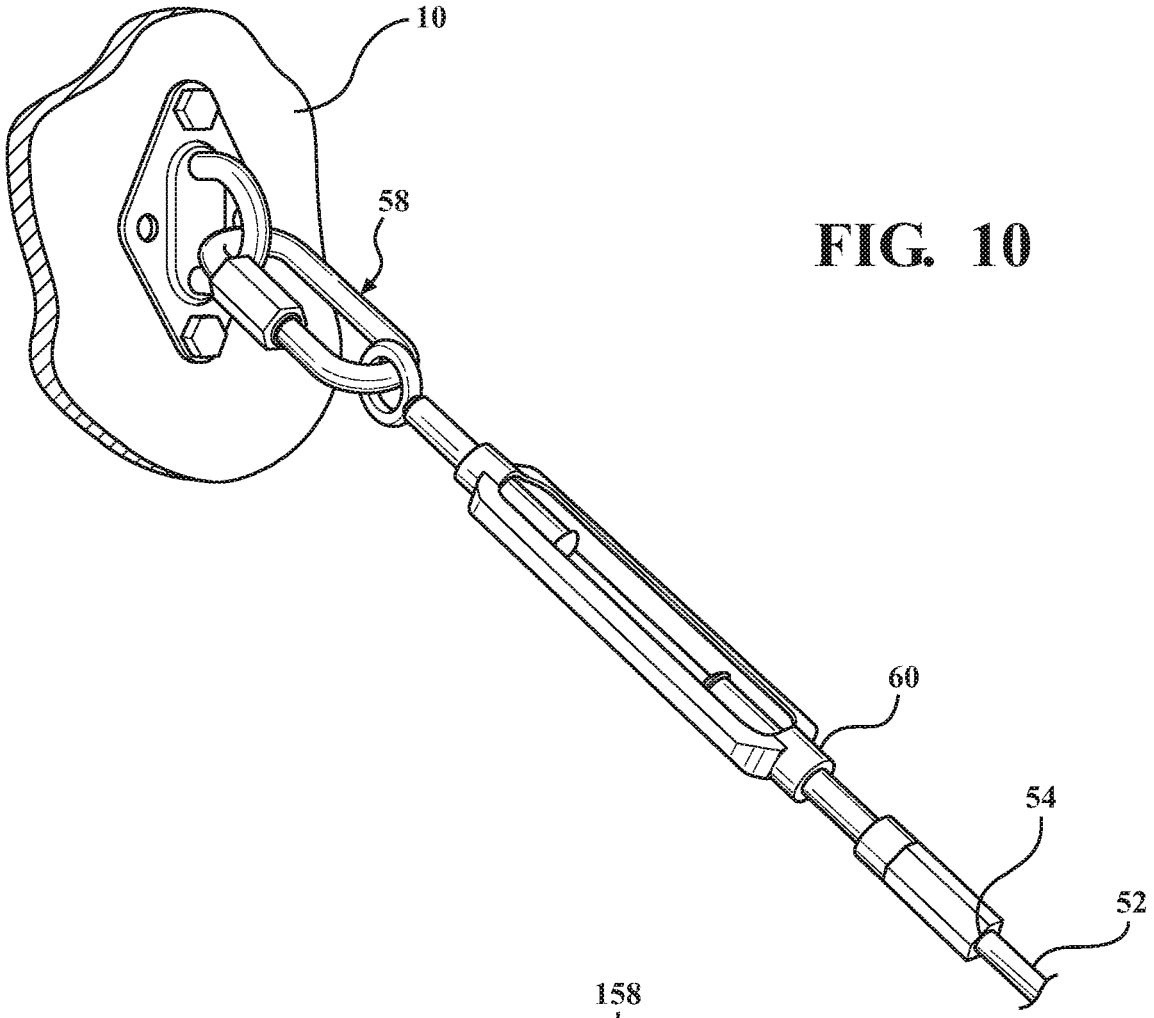
FIG. 10
FIG. 12
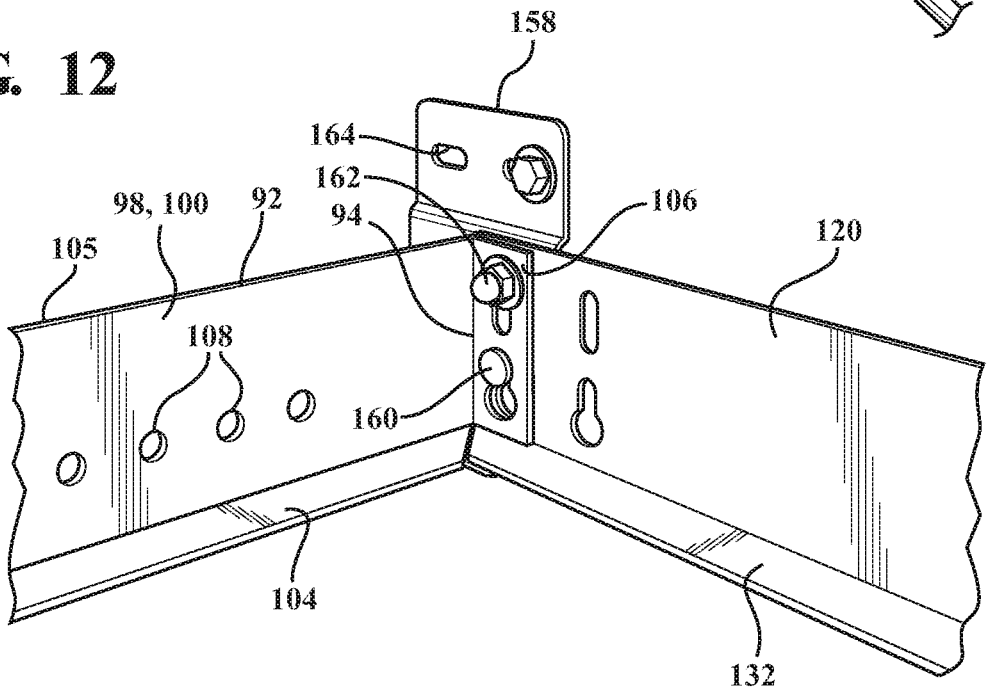

FIG. 16
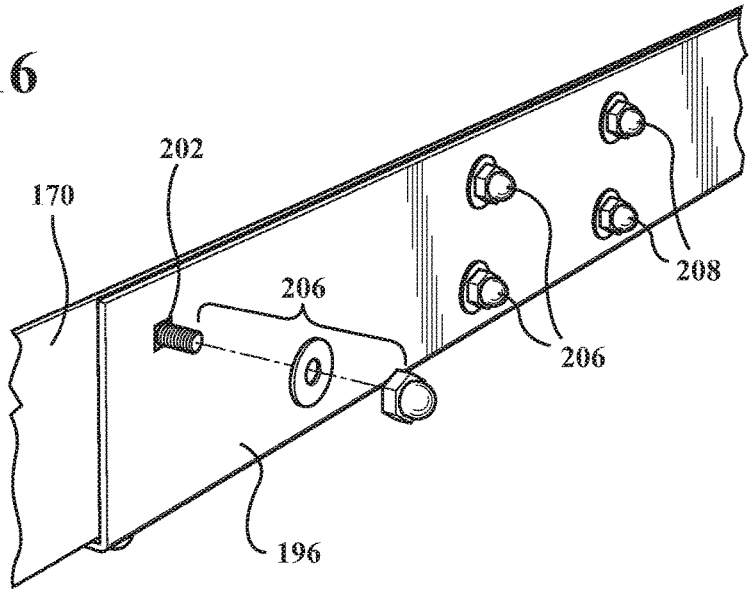
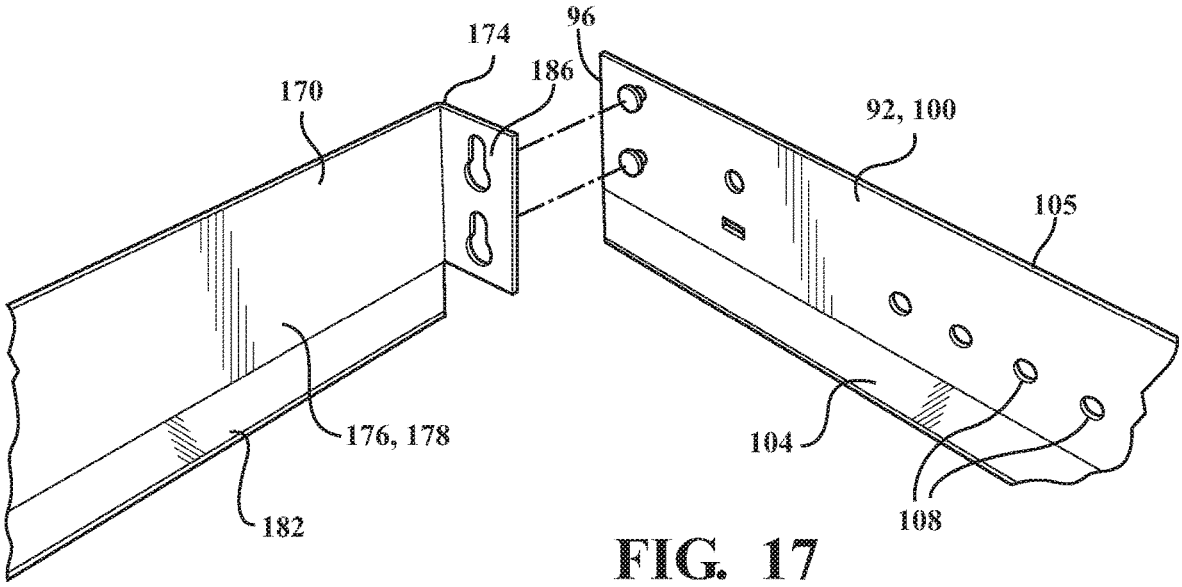
FIG. 17

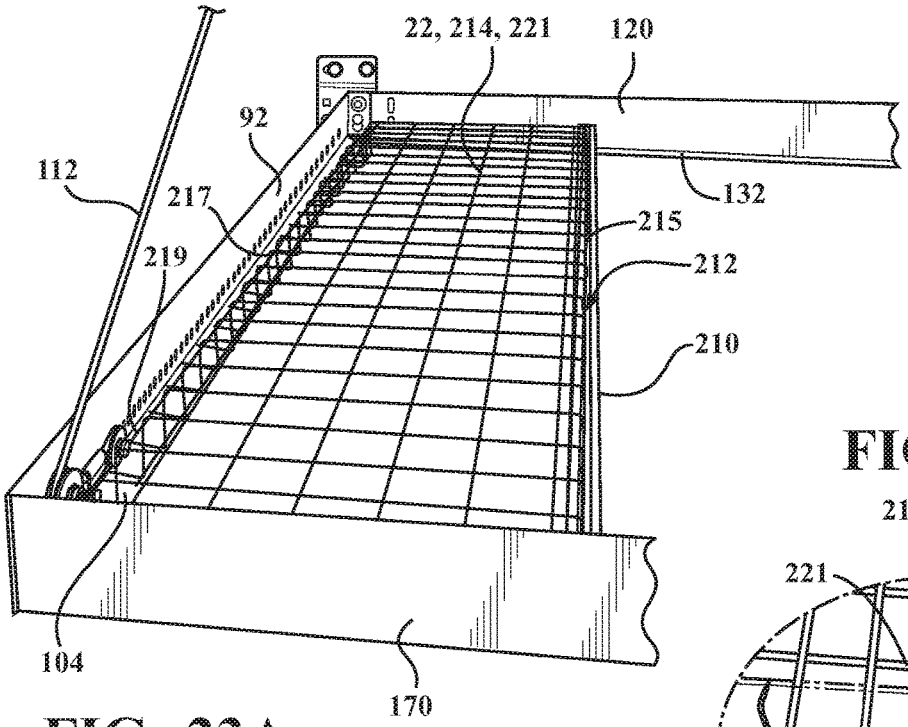
FIG. 23A
FIG. 23C
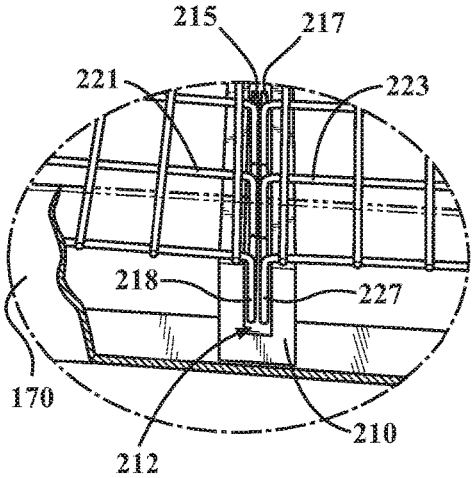
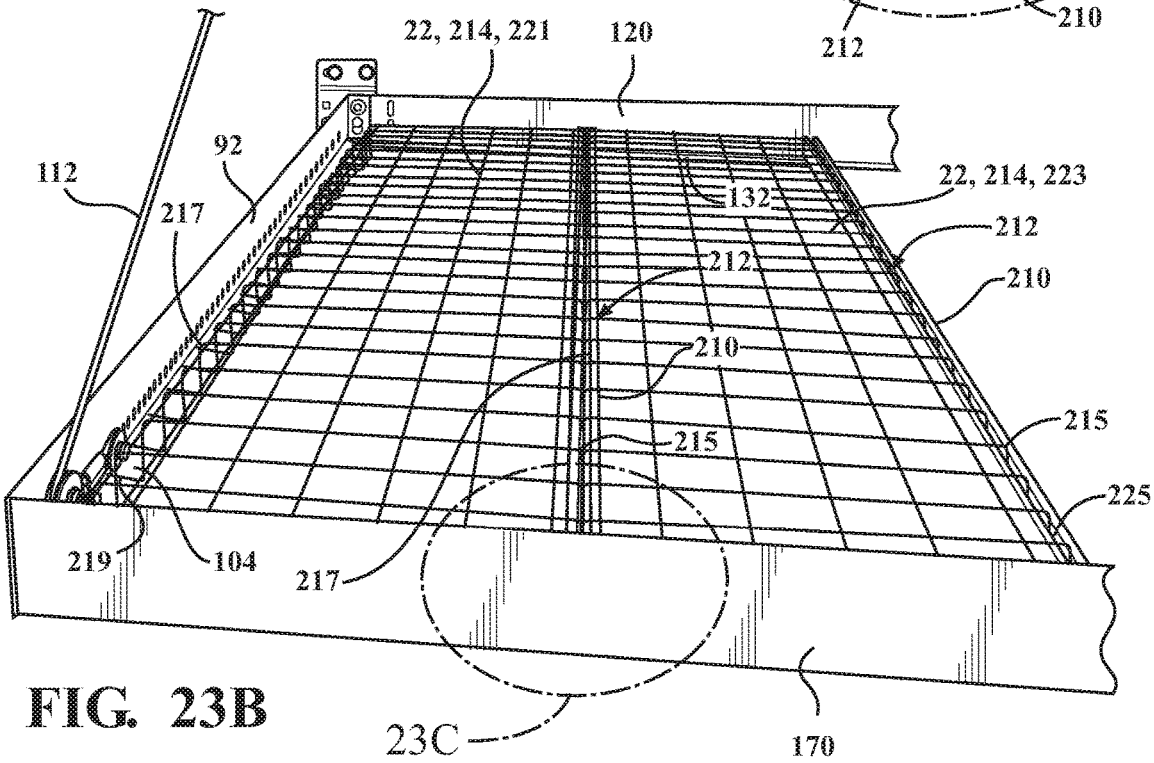
FIG. 23B

STORAGE APPARATUS

FIELD OF THE DISCLOSURE

The present disclosure relates generally to a storage apparatus attachable to a surface.

BACKGROUND

Storage apparatuses are often used in residential and/or commercial properties for storing items. Some storage apparatuses may be attachable to a surface, such as to a side wall or ceiling of building structure, and one or more items may be placed or stacked on the apparatus when attached to the surface. In some instances, it may be desirable to adjust a height of the apparatus relative to the surface. However, with some designs, height adjustment may be limited and/or cumbersome for the user. The present disclosure is aimed at solving the challenge(s) presented above.

SUMMARY

A storage apparatus attachable to a surface is disclosed. The storage apparatus comprises a support beam defining a beam axis and adapted to be coupled to the surface with the support beam having first and second beam ends and defining a first plurality of mounting positions between the first and second beam ends. The storage apparatus further comprises a support structure abutting and being supported by the support beam, an alignment device attached to the support beam, and a cable having first and second cable ends with the first cable end adapted to be attached to the surface and the second cable end removably attached to the support beam at a selected one of the first plurality of mounting positions, with the cable coupled to the alignment device to align the second cable end with the support beam and the selected one of the first plurality of mounting positions, and the cable movable along the alignment device to move the second cable end from the selected one of the first plurality of mounting positions to another one of the first plurality of mounting positions for adjusting the support structure relative to the surface.

Another embodiment of a storage apparatus is disclosed. In this embodiment, the storage apparatus comprises a support beam defining a beam axis, a support structure abutting and being supported by the support beam with the support structure defining a longitudinal axis transverse to the beam axis, and a cross beam supported by the support beam and extending transverse to the longitudinal axis with the cross beam defining a channel. The support structure is further defined as a plurality of support racks each having a lip with the lip of one of the plurality of support racks and the lip of an adjacent one of said plurality of support racks disposed within the channel of the cross beam to secure said one of the plurality of support racks and the adjacent one of said plurality of support racks to the cross beam.

BRIEF DESCRIPTION OF THE DRAWINGS

Advantages of the present disclosure will be readily appreciated as the same becomes better understood by reference to the following detailed description when considered in connection with the accompanying drawings.

FIG. 10 is an enlarged view of a portion of the storage apparatus of FIG. 1 illustrating a first cable end of the cable attached to the wall of the building.

FIG. 12 is an enlarged perspective view of a portion of the storage apparatus of FIG. 1 illustrating a portion of a second support beam, a portion of the third support beam, and another end bracket shifted to one side and the second and third support beams attached to the other end bracket.

FIG. 16 is an enlarged view of a portion of the storage apparatus of FIG. 1 illustrating a central bracket attached to first and second beam segments of the fourth support beam.

FIG. 17 is an enlarged exploded view of a portion of the storage apparatus of FIG. 1 showing a portion of the second support beam and a portion of the fourth support beam.

FIGS. 21, 22, and 23A are perspective views of a portion of the storage apparatus of FIG. 1 illustrating an installation sequence of a support rack on the support frame.

FIG. 23B is a perspective view of a portion of the storage apparatus of FIG. 1 illustrating a plurality of support racks supported by the support frame.

FIG. 23C is an enlarged portion of the storage apparatus of FIG. 23B.

DETAILED DESCRIPTION

Figure 1:
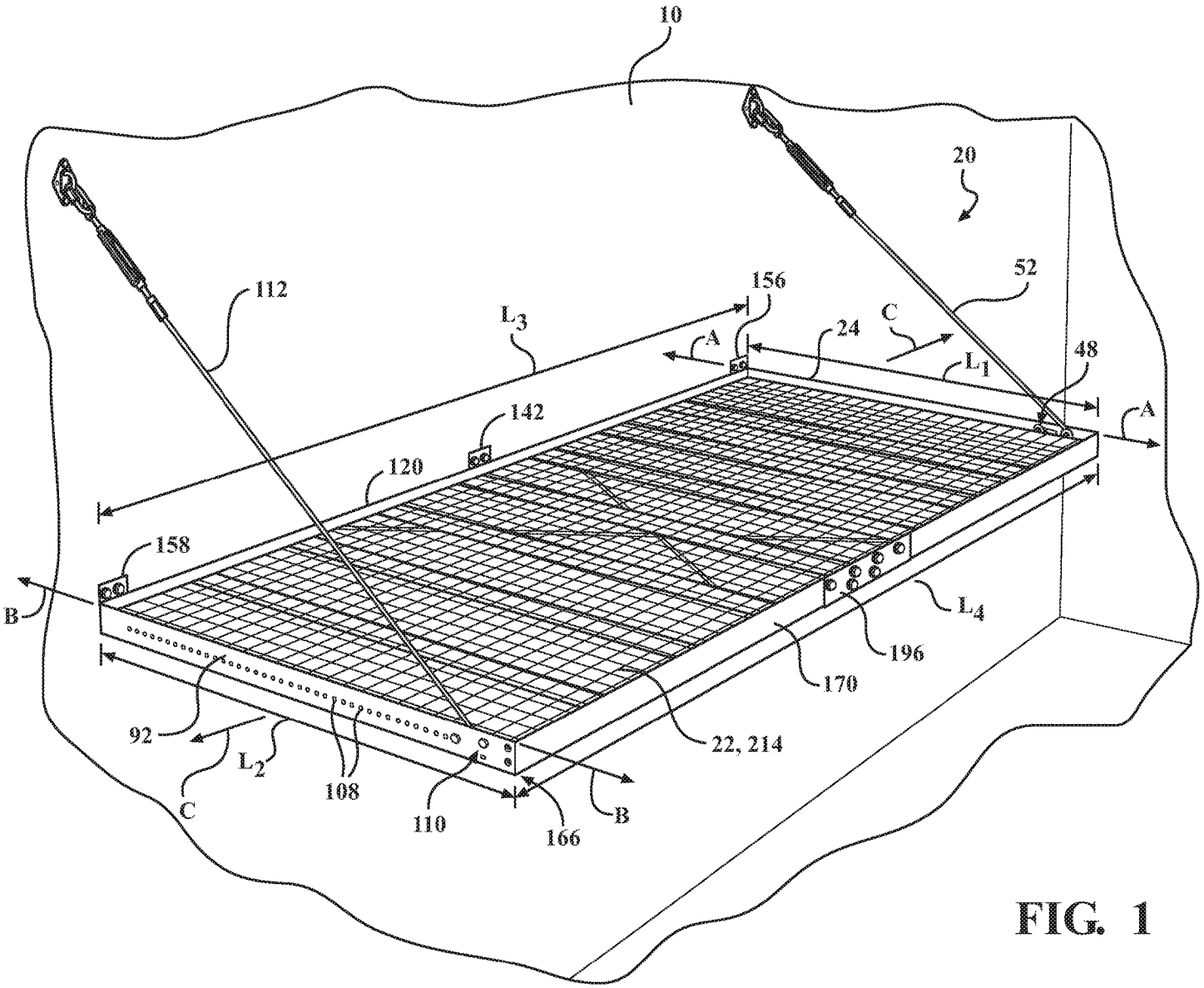
FIG. 1 is a semi-schematic perspective view of an embodiment of a storage apparatus attached to a wall of a building.

Referring now to the figures, wherein like numerals indicate corresponding parts throughout the several views, embodiments of a storage apparatus 20, 320, 520, 720 are shown throughout the figures and described in detail below. The storage apparatus 20, 320, 520, 720 is attachable to a surface 10, such as a ceiling, a wall, a door, a tangible or intangible object, etc. In certain embodiments, the storage apparatus 20, 320, 520, 720 is attachable to a wall, such as a wall of a commercial or residential building or structure, such as shown for example in FIG. 1. In certain embodiments, the storage apparatus 20, 320, 520, 720 is attachable to a ceiling of a commercial or residential building or structure, such as shown for example in FIG. 2. The storage apparatus 20 may also be attachable to a surface located inside or outside of the building or structure. For instance, the storage apparatus 20, 320, 520, 720 may be attachable to an interior wall or ceiling of a residential building (such as an interior wall or ceiling of a garage), an exterior wall of the residential building, etc.

The storage apparatus 20, 320, 520, 720 is configured to hold, support, and/or store at least one item. For residential purposes, and as non-limiting examples, the storage apparatus 20, 320, 520, 720 may be configured to hold, support, and/or store household cleaning items, food items, garage items, tools, yard equipment, sporting equipment, clothing, pet supplies, etc. For commercial purposes, and as non-limiting examples, the storage apparatus 20, 320, 520, 720 may be configured to hold, support, and/or store commercial products or stock, packaging, office supplies, office equipment, cleaning supplies, tools, etc. It should be appreciated that the storage apparatus 20, 320, 520, 720 can be configured to hold, support, and/or store any type of item or plurality of items having any configuration. It should also be appreciated that the storage apparatus 20, 320, 520, 720 can be configured to hold, support, and/or store the item(s) having any reasonable weight.

The storage apparatus 20, 320, 520, 720 includes a support structure 22, such as at least one support rack or at least one support panel. The support structure 22 is adapted to hold and/or support the at least one item. For example, the item(s) may be placed on the support structure 22 for storage, safe keeping, or the like. The support structure 22 is adjustable relative to the surface 10. In the illustrated embodiments, the support structure 22 is adjustable in height relative to a reference position, which may be on the surface 10 or may be the surface 10 itself. In certain embodiments, the support structure 22 is adjustable in height relative to the surface 10 itself, such as the ceiling of a building. In certain embodiments, the support structure 22 is adjustable in height relative to a reference position located on the surface 10, such as a user-selected reference position on the wall of a building. The support structure 22 is fixed once the storage apparatus 20, 320, 520, 720 has been attached to the surface 10. In instances where it is desirable to adjust the support structure 22, a user can detach the storage apparatus 20, 320, 520, 720 from the surface 10, make adjustment(s) to the height of the support structure 22, and then reattach the storage apparatus 20, 320, 520, 720 to the surface 10.

Embodiments of the storage apparatus 20, 320, 520, 720 are described below with reference to FIGS. 1-45. It should be appreciated that various features of the embodiments of the storage apparatus 20, 320, 520, 720 may be generically or schematically illustrated in one or more of the figures. Additionally, the embodiments of the storage apparatus 20, 320, 520, 720 shown throughout the figures are merely illustrative and are not necessarily drawn to scale.

With reference to FIGS. 1-25, an embodiment of the storage apparatus 20 includes a support beam 24 having first 26 and second 28 beam ends. The support beam 24 defines a beam axis A and is adapted to be coupled to the surface 10. In an embodiment, the support beam 24 is further defined as a first support beam 24 defining the beam axis A and having a length $L_1$ extending between the first 26 and second 28 beam ends along the beam axis A. The first support beam 24 further has a body 30 with inner 32 and outer 34 sides and a ledge 36 extending inwardly from the inner side 32 of the body 30. Additionally, the first support beam 24 has a top surface 37 and a flange 38 extending inwardly at the first beam end 26. The first support beam 24 may be formed of any suitable material, such as a metal, a metal alloy, a polymer or plastic, a natural material (e.g., wood), a synthetic material, and/or the like, and/or combinations thereof.

The first support beam 24 defines a first plurality of mounting positions 40 between the first 26 and second 28 beam ends. In the illustrated embodiments, the plurality of mounting positions 40 is further defined as a first plurality of apertures 40. Each one of the first plurality of apertures 40 is separated from an adjacent one of the first plurality of apertures 40. In an embodiment, each one of the first plurality of apertures 40 is evenly spaced from an adjacent one of the first plurality of apertures 40. As shown, each of the first plurality of apertures 40 has a circular configuration. It should be appreciated that the first plurality of apertures 40 can have any suitable configuration.

Figure 3:
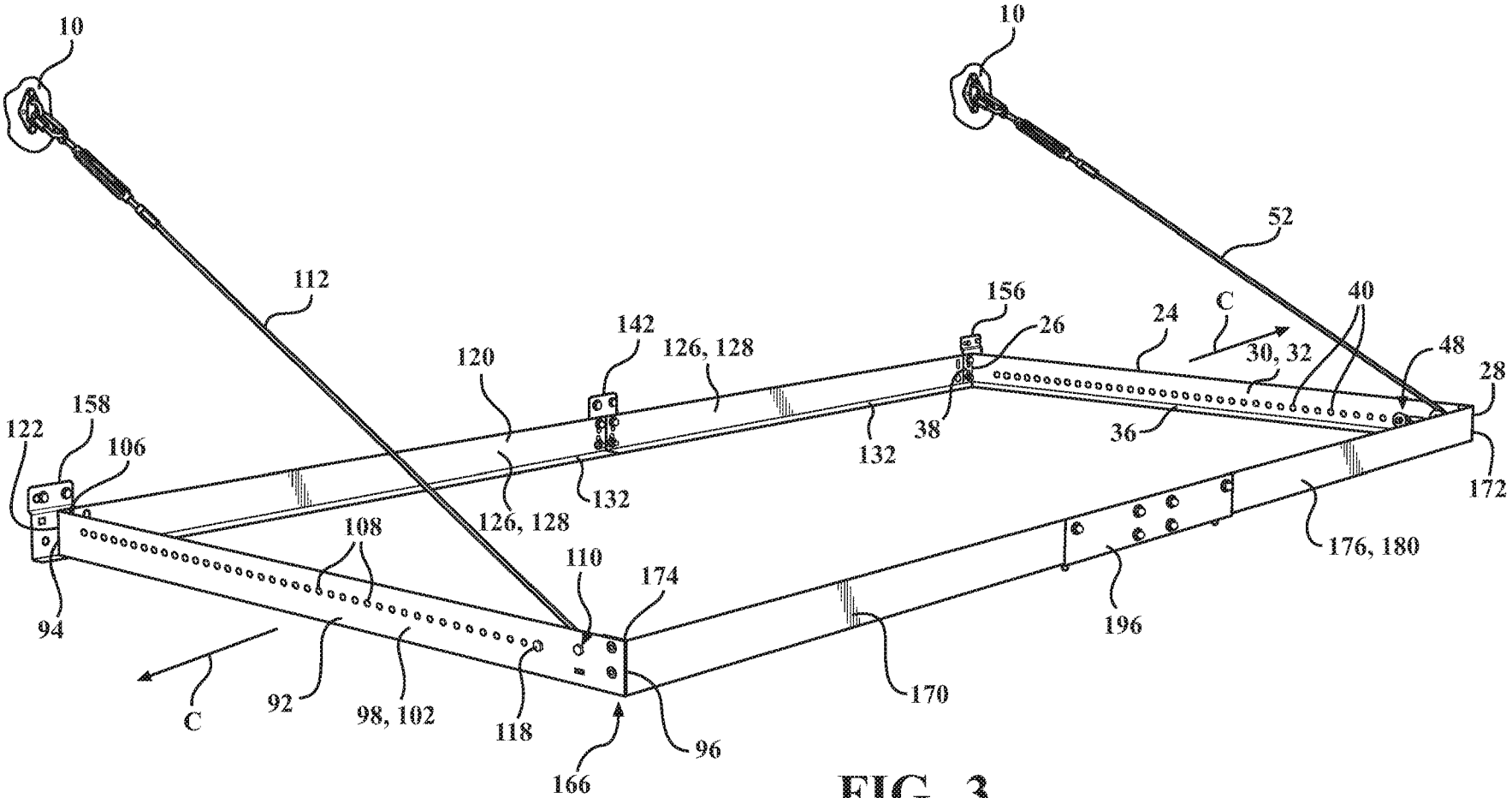
FIG. 3 is a perspective view of the storage apparatus of FIG. 1 with a support structure, cross beams, and support bars removed.
Figure 4:
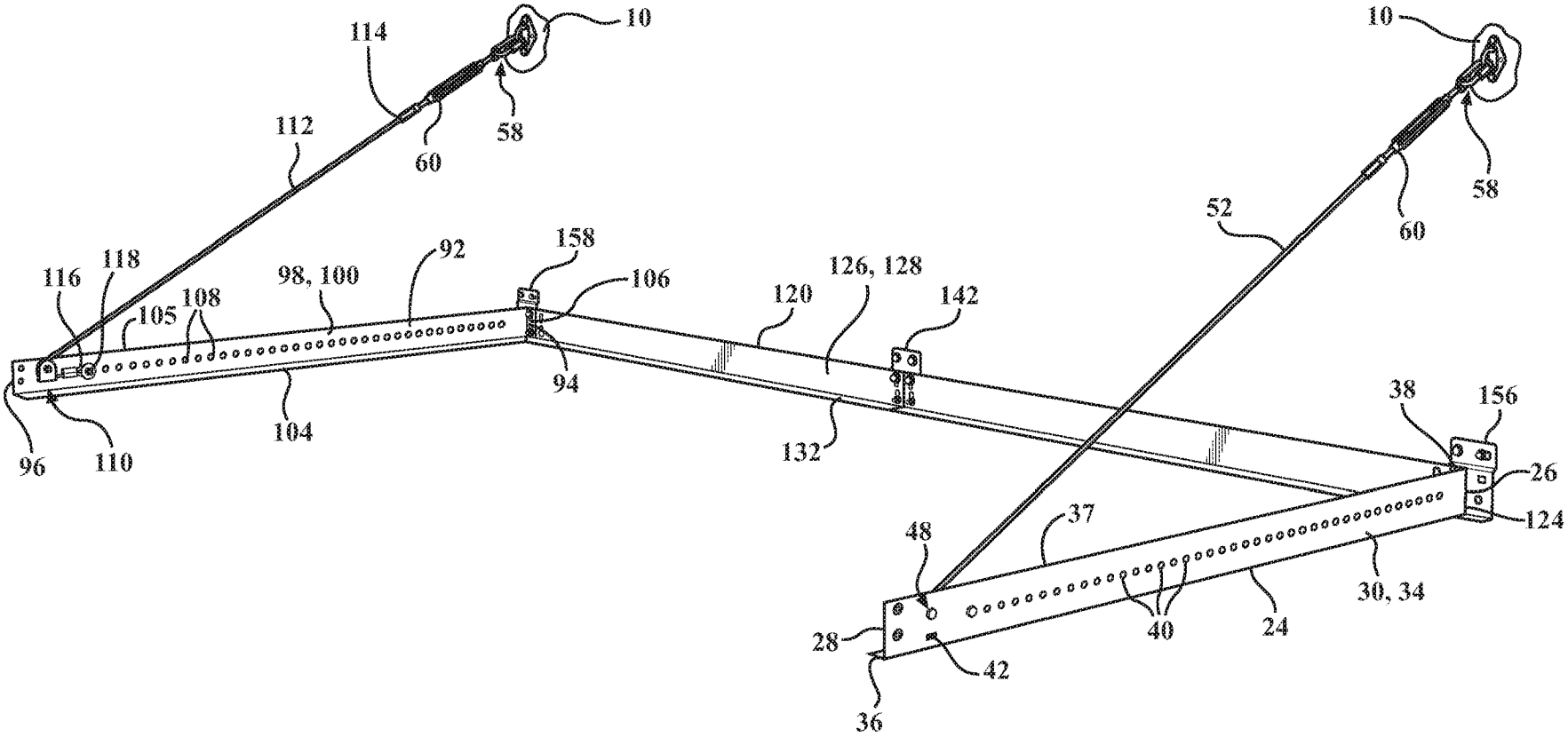
FIG. 4 is a perspective view of the storage apparatus of FIG. 1 with a fourth support beam, the support structure, the cross beams, and the support bars removed.
Figure 5:
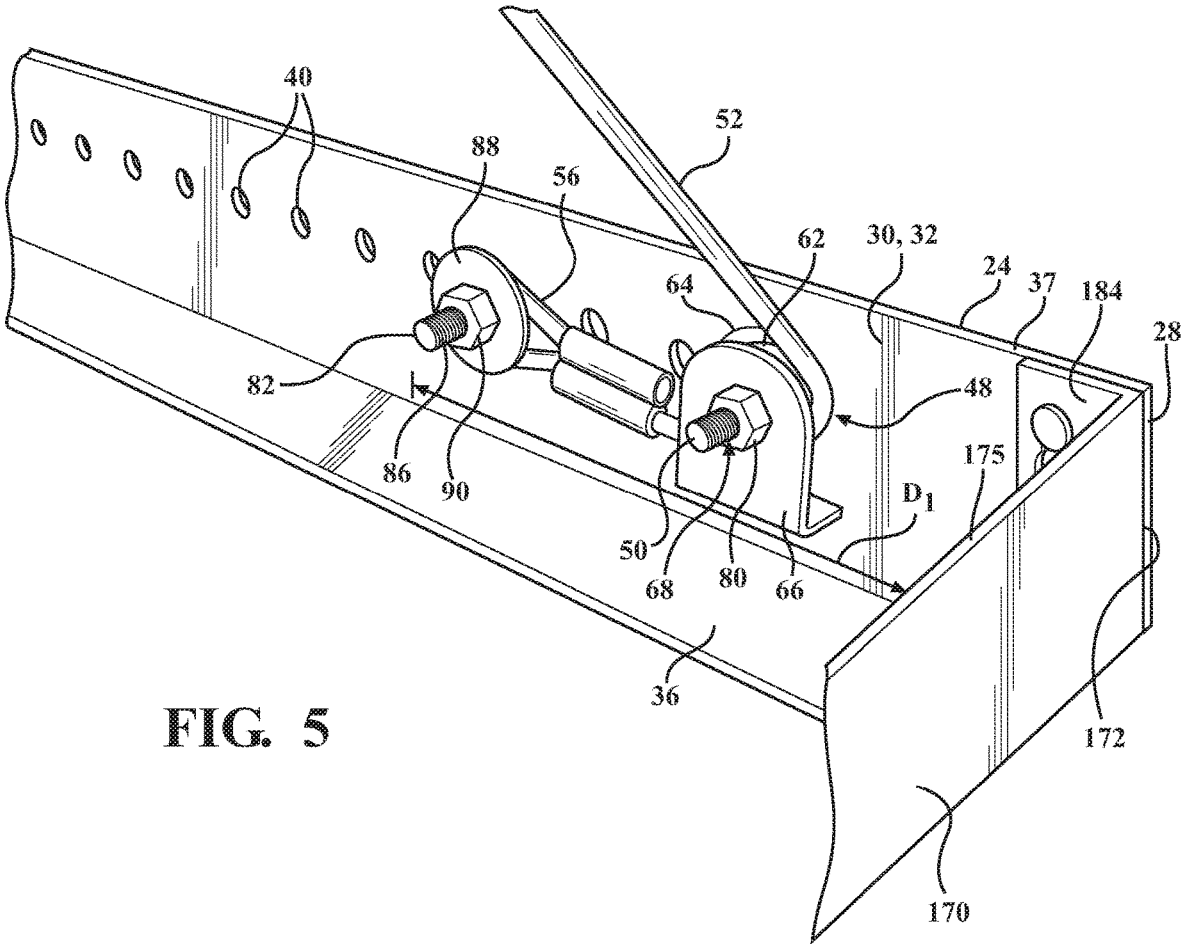
FIG. 5 is an enlarged perspective view of a portion of the storage apparatus of FIG. 1 illustrating a portion of a first support beam, a portion of the fourth support beam, an alignment device coupled to the first support beam, a portion of a cable coupled to the alignment device and the first support beam at a selected one of a plurality of mounting positions for setting a height of the support structure.
Figure 9:
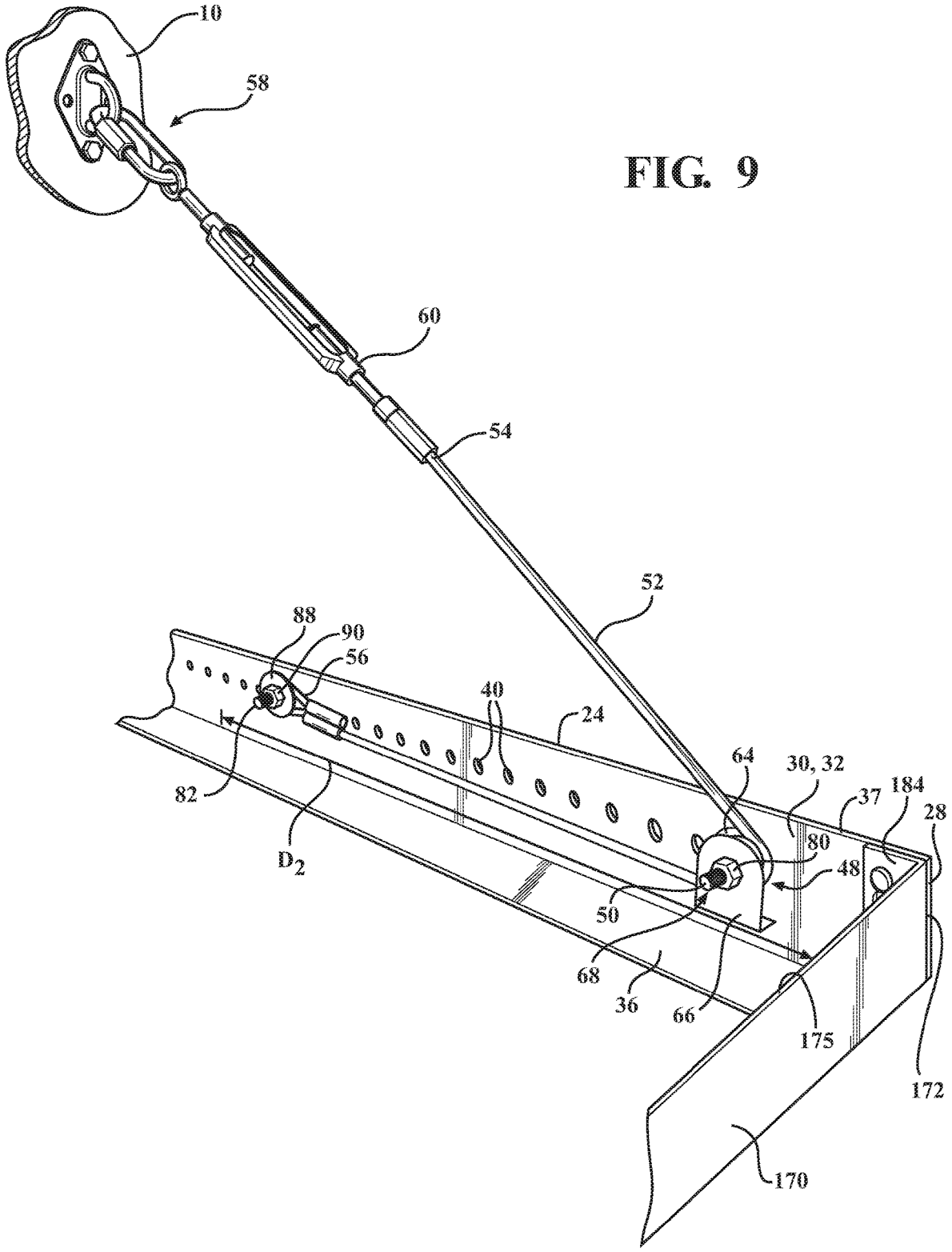
FIG. 9 is an enlarged perspective view of a portion of the storage apparatus of FIG. 1 illustrating a portion of the first support beam, a portion of the fourth support beam, the alignment device coupled to the first support beam, the cable coupled to the alignment device and the first support beam at another selected one of a plurality of mounting positions for setting another height of the support structure.

Each one of the first plurality of apertures 40 corresponds to a particular height of the support structure 22 relative to the reference position on the surface 10 or the surface 10 itself. During assembly of the storage apparatus 20, the user selects one of the apertures 40 corresponding to a desired height of the support structure 22. With reference to FIGS. 3 and 5, the selected one of the first plurality of apertures 40 is spaced inwardly a first distance $D_1$ from the second beam end 28 of the first support beam 24 for forming a first height of the support structure 22 relative to the surface 10. As shown, the selected one of the plurality of apertures 40 is proximate the second beam end 28. It should be appreciated, however, that the selected one of the apertures 40 can be anywhere along the length $L_1$ of the first support beam 24. As previously mentioned, the user can adjust the height of the support structure 22, for example, to raise or lower the support structure 22 relative to the reference position on the surface 10 or the surface 10 itself. The user can accomplish this by selecting another one of the first plurality of apertures 40 corresponding to another height of the support structure 22. To raise the height of the support structure 22, and with reference to FIG. 9, the other one of the first plurality of apertures 40 is spaced inwardly a second distance $D_2$ from the second beam end 28 of the first support beam 24 with the second distance $D_2$ larger than the first distance $D_1$ for forming a second height of the support structure 22 relative to the surface 10. It should be appreciated that the user can select any one of the apertures 40 when adjusting the height of the support structure 22 such that the second distance $D_2$ can be longer or shorter than as shown in FIG. 9. In an alternative embodiment, the user can adjust the height of the support structure to lower the support structure 22 relative to the surface 10. In this alternative embodiment, the selected one of the apertures 40 could be spaced from the second beam end 28 the first distance $D_1$ and the selected other one of the apertures 40 could be spaced inwardly from the second beam end 28 the second distance $D_2$ with the second distance $D_2$ smaller than the first distance $D_1$.

Figure 6:
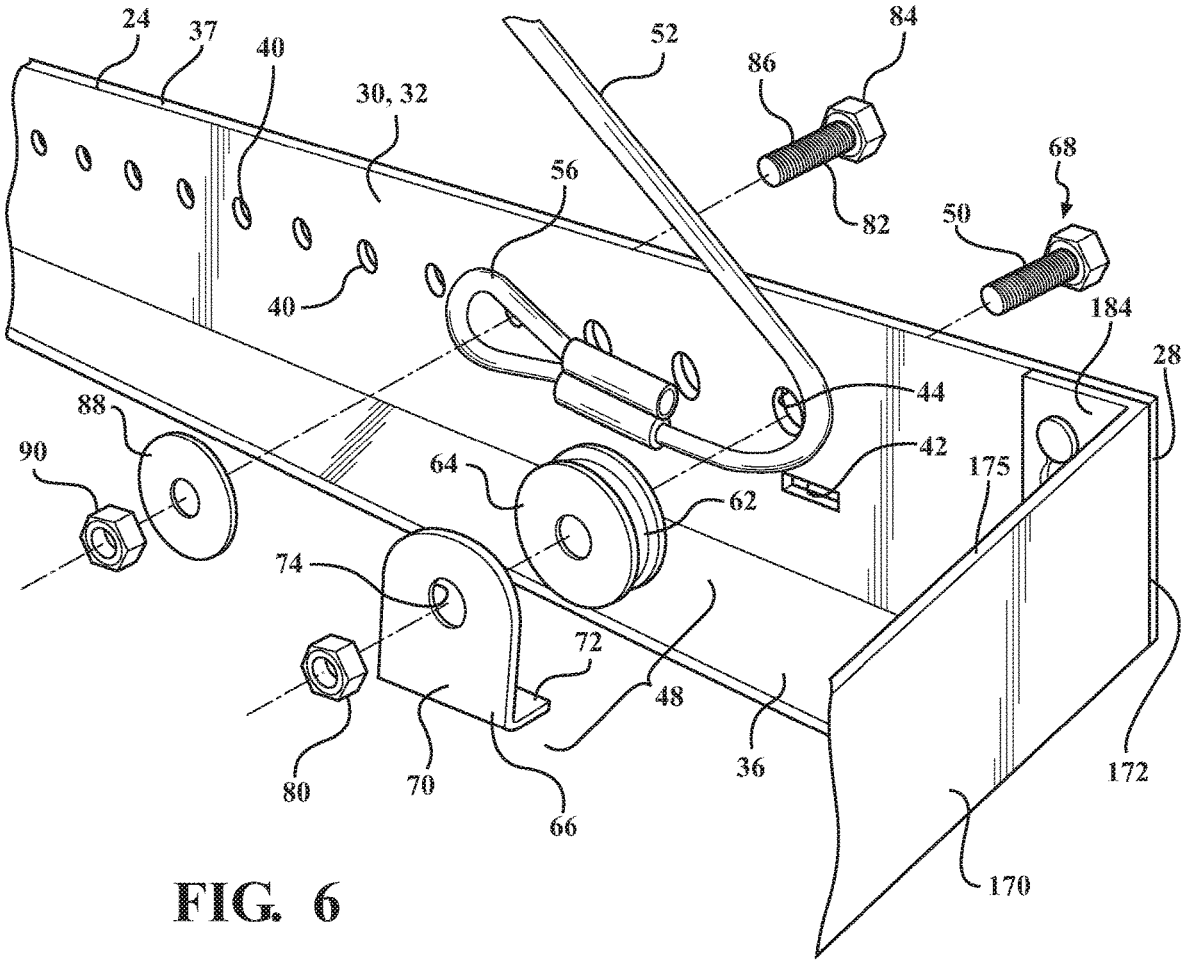
FIG. 6 is a partially exploded view of the portion of the storage apparatus of FIG. 5.
Figure 7:
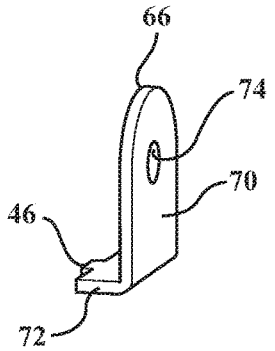
FIG. 7 is a perspective view of a bracket of the alignment device.
Figure 8:
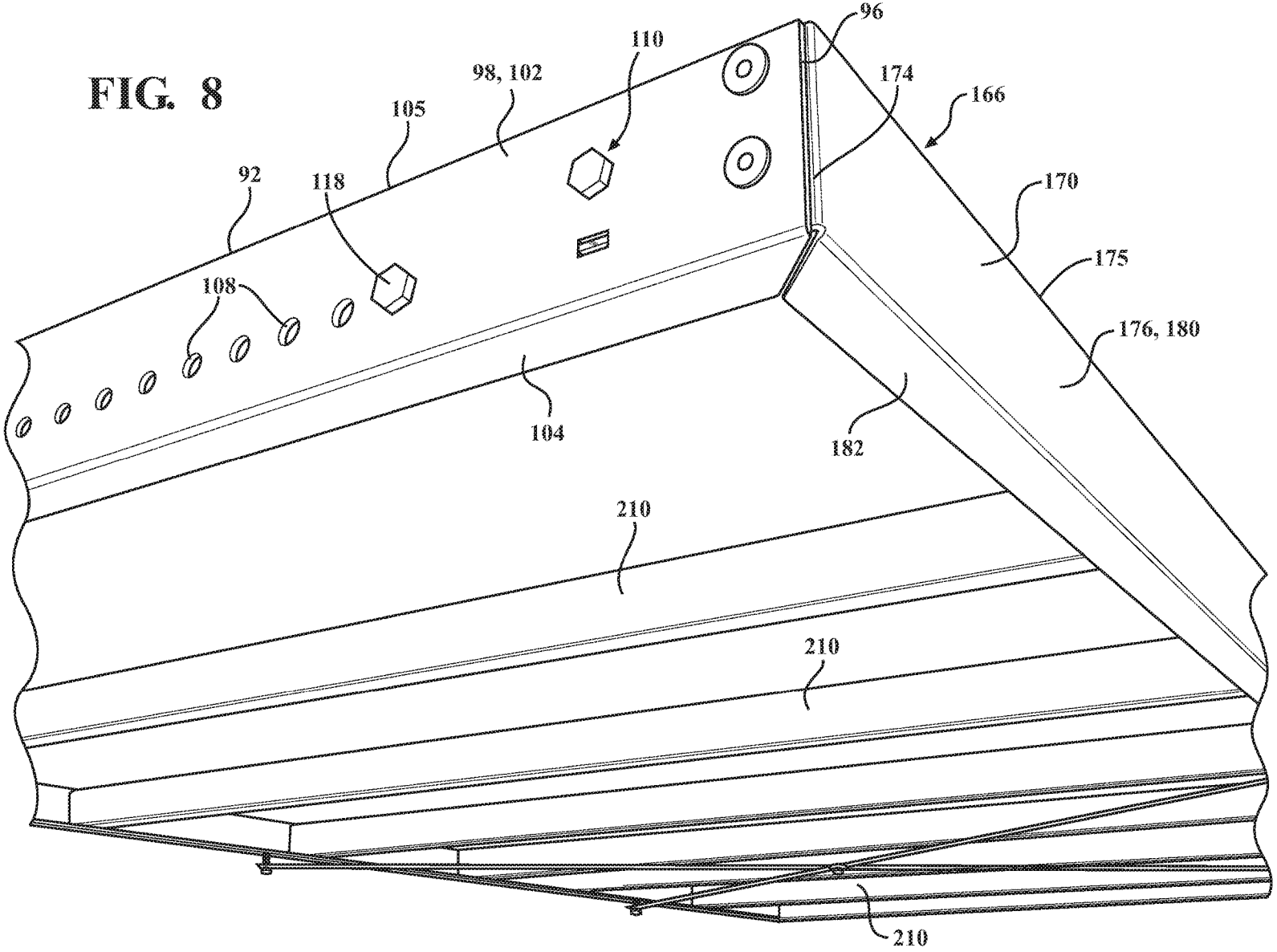
FIG. 8 is an enlarged perspective view of a portion of a bottom side of the storage apparatus of FIG. 1 with the support structure and cables removed.

With reference to FIGS. 6 and 7, the first support beam 24 further defines first 42 and second 44 openings both proximate the second beam end 28. The first opening 42 has a square- or rectangular-shaped configuration and is configured to receive a locating tab 46 of an alignment device 48. The second opening 44 may have any suitable configuration and is configured to receive a bolt 50 of a fastening system 68 for securing the alignment device 48 to the first support beam 24 as described below.

The storage apparatus 20 further includes the alignment device 48 attached to the first support beam 24. The alignment device 48 may be attached anywhere along the length $L_1$ of the first support beam 24. In an embodiment, the alignment device 48 is attached proximate the second beam end 28 of the first support beam 24. Additionally, the alignment device 48 is disposed adjacent the inner side 32 of the first support beam 24. Further details of the alignment device 48 are described below.

The storage apparatus 20 further includes a cable 52 having first 54 and second 56 cable ends. The first cable end 54 is adapted to be attached to the surface 10. The first cable end 54 may be attached to the surface 10 utilizing a suitable fastening system 58. In an embodiment, and as best shown in FIGS. 9 and 10, the storage apparatus 20 further includes a turnbuckle 60 coupled to the fastening system 58. The purpose of the turnbuckle 60 is described below.

The second cable end 56 is removably attached to the first support beam 24 at a selected one of the first plurality of mounting positions 40. The cable 52 is coupled to the alignment device 48 to align the second cable end 56 with the first support beam 24 and the selected one of the first plurality of mounting positions 40. As shown at least in FIGS. 5 and 6, the alignment device 48 includes a groove 62 with the cable 52 seated within the groove 62. The groove 62 can have any suitable configuration and/or take on any suitable form. In the illustrated embodiment, the alignment device 48 includes a pulley 64, and the pulley 64 defines the groove 62. The pulley 64 is fixed to the first support beam 24, utilizing the fastening system 68 described in further detail below, such that the pulley 64 does not rotate relative to the first support beam 24.

As shown in FIGS. 5-7 and 9, the alignment device 48 further includes a bracket 66 having the locating tab 46. As shown, the bracket 66 has an L-shaped configuration, and includes a base 70 and a leg 72 extending from and transverse to the base 70. The base 70 defines an aperture 74. The locating tab 46 extends from the leg 72 transverse to the base 70 of the bracket 66. The locating tab 46 has a square- or rectangular-shaped configuration and may have any suitable length. Alternatively, the locating tab 46 could have any suitable configuration. Additionally, the configuration of the locating tab 46 is complementary to the configuration of the first opening 42 of the first support beam 24. The opening 42 is configured to receive the locating tab 46 to maintain a position of the alignment device 48 to secure the cable 52 within the groove 62.

As previously mentioned, the alignment device 48 includes the pulley 64. As illustrated, the pulley 64 is sandwiched between the bracket 66 and the first support beam 24. The pulley 64 and the bracket 66 are secured to the first support beam 24 utilizing the fastening system 68. As best shown in FIGS. 5, 6, and 9, the fastening system 68 includes the bolt 50 disposed through the second opening 44 of the first support beam 24, through the pulley 64, and through the aperture 74 of the bracket 66. The fastening system 68 further includes a nut 80 configured to receive a shaft of the bolt 50 to secure the alignment device 48 to the first support beam 24.

With continued reference to FIGS. 5, 6, and 9, the storage apparatus 20 further includes a mounting post 82 attached to the first support beam 24 at a selected one of the first plurality of mounting positions 40. The mounting post 82 receives the second cable end 56 to attach the second cable end 56 to the first support beam 24 at the selected one of the first plurality of mounting positions 40. Where the mounting positions 40 are further defined as a first plurality of apertures 40, the mounting post 82 is coupled to a selected one of the first plurality of apertures 40 and configured to receive the second cable end 56 to attach the second cable end 56 to the first support beam 24. The mounting post 82 may have any suitable configuration. In an embodiment, the mounting post 82 has a head 84 and a threaded shaft 86, and the second cable end 56 forms a loop. The mounting post 82 is disposed through the selected one of the first plurality of apertures 40 and through the loop defined by the second cable end 56. A washer 88 and a nut 90 are disposed over the threaded shaft 86 to secure the second cable end 56 to the first support beam 24 at the selected one of the first plurality of mounting positions 40.

The cable 52 of the storage apparatus 20 is movable along the alignment device 48 to move the second cable end 56 from the selected one of the first plurality of mounting positions 40 (such as shown in FIG. 5) to another one of the first plurality of mounting positions 40 (such as shown in FIG. 9) for adjusting the support structure 22 relative to the surface 10. For example, prior to attaching the storage apparatus 20 to the surface 10, the user selects one of the mounting positions 40 of the first support beam 24, and attaches the second cable end 56 to the first support beam 24 at the selected mounting position 40. This is accomplished by disposing the mounting post 82 through the aperture corresponding to the selected mounting position 40 such that the head 84 abuts one of the sides 32, 34 of the first support beam 24, attaching the second cable end 56 to the shaft 86 of the mounting post 82 protruding through the other one of the sides 32, 34 of the first support beam 24, and securing the mounting post 82 to the first support beam 24 by securing the washer 88 and the nut 90 to the shaft 86. In the embodiment shown, the head 84 of the mounting post 82 abuts the outer side 34 of the first support beam 24, and the washer 88 and the nut 90 are attached to the shaft 86 against the inner side 32 of the first support beam 24. With the cable 52 seated in the groove 62 of the alignment device 48, a portion of the cable 52 extends a first length from the alignment device 48 to the selected mounting position 40 and another portion of the cable 52 extends a second length from the alignment device 48 to the surface 10.

During adjustment of the support structure 22, the user detaches the storage apparatus 20 from the surface 10, detaches the mounting post 82 from the first support beam 24, and selects a new mounting position 40 on the first support beam 24. In an example, the new mounting position 40 corresponds to a new desired height of the support structure 22. The user moves the cable 52 (which is seated in the groove 62 of the alignment device 48) until the second cable end 56 is aligned with the newly selected mounting position 40, and attaches the second cable end 56 to the first support beam 24 at the newly selected mounting position 40. For instance, the user disposes the mounting post 82 through the aperture 40 associated with the newly selected mounting position 40, attaches the second cable end 56 to the mounting post 82 (such as by inserting the shaft 86 of the mounting post 82 through the loop of the second cable end 56), and secures the mounting post 82 to the first support beam 24 by securing the washer 88 and the nut 90 to the shaft 86. When adjusted, a portion of the cable 52 extends a third length from the alignment device 48 to the mounting position 40 and another portion of the cable 52 extends a fourth length from the alignment device 48 to the surface 10 with third length longer than the first length and the fourth length shorter than the second length to reduce the height of the storage apparatus 20 relative to the reference position of the surface 10. In another example, the height of the storage apparatus can be lengthened relative to the reference position of the surface 10 when the third length is shorter than the first length and the fourth length is longer than the second length.

Figure 2:
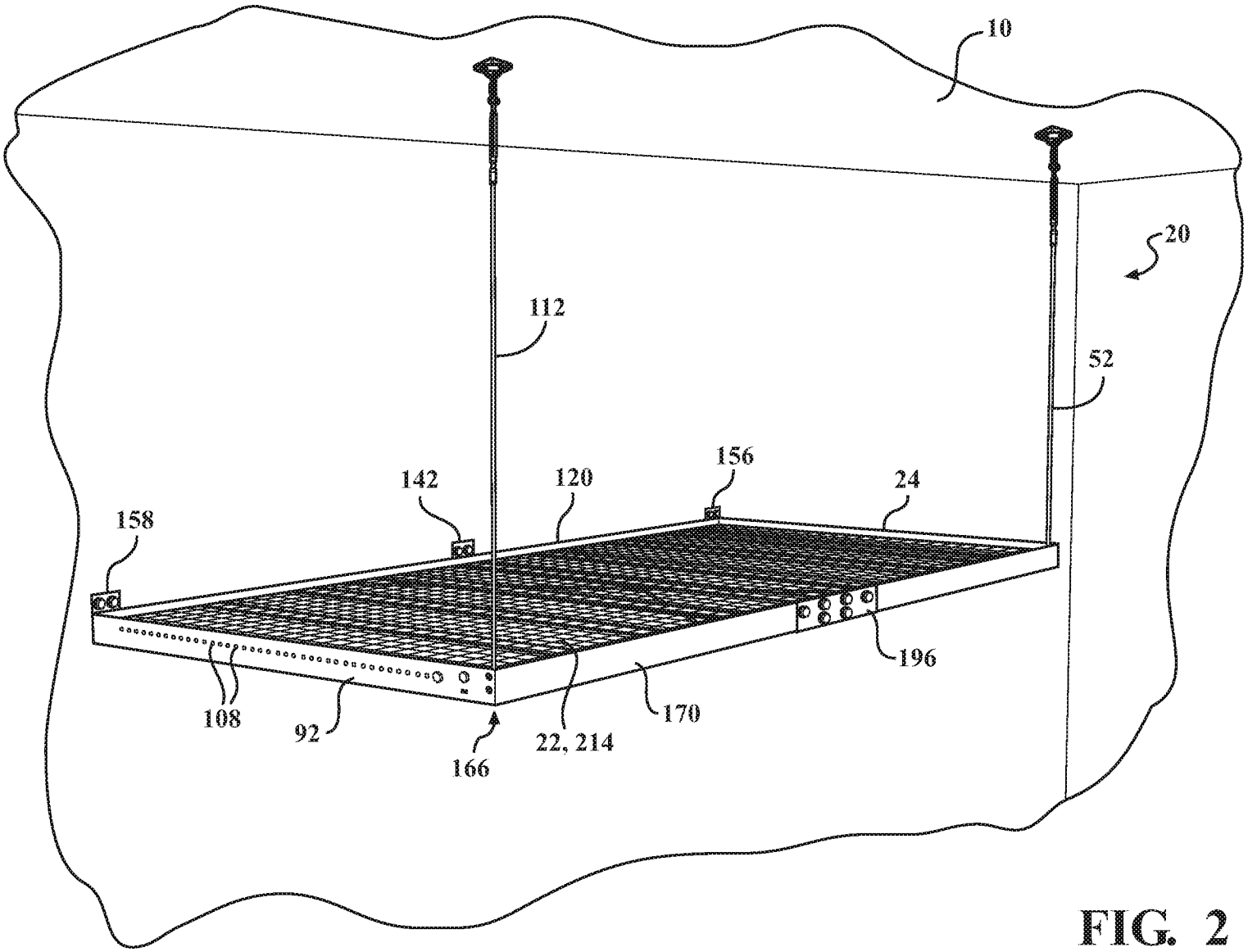
FIG. 2 is a semi-schematic perspective view of the storage apparatus of FIG. 1 attached to a ceiling of the building.

The storage apparatus 20 further includes the support structure 22 abutting and being supported by the first support beam 24. In an embodiment, and as best shown in FIG. 1, the support structure 22 defines a longitudinal axis C transverse to the beam axis A. The support structure 22 may have any configuration such that the support structure 22 can suitably hold and/or support at least one item. Additionally, the support structure 22 may take on many different forms, such as at least one support rack, at least one support panel, etc. Further details of the different forms of the support structure 22 are set forth below.

With reference to FIGS. 1-4, and in an embodiment, the storage apparatus 20 further includes a second support beam 92 spaced from the first support beam 24 with the second support beam 92 having first 94 and second 96 beam ends. The beam axis A may be further defined as a first beam axis A, and the second support beam 24 defines a second beam axis B parallel to the first beam axis A. The second support beam 92 further has a length $L_2$ extending between the first 94 and second 96 beam ends along the second beam axis B. The second support beam 92 further has a body 98 with inner 100 and outer 102 sides and a ledge 104 extending inwardly from the inner side 100 of the body 98. Additionally, the second support beam 92 has a top surface 105 and a flange 106 extending inwardly at the first beam end 94. The second support beam 92 may be formed of any suitable material, such as a metal, a metal alloy, a polymer or plastic, a natural material (e.g., wood), and/or the like, and/or combinations thereof.

As shown at least in FIGS. 3, 4, 8, and 12, the second support beam 92 defines a second plurality of mounting positions 108 between the first 94 and second 96 beam ends of the second support beam 92. The second plurality of mounting positions 108 of the second support beam 92 is further defined as a second plurality of apertures 108. The arrangement and configuration of the second plurality of apertures 108 of the second support beam 92 are the same as the first plurality of apertures 40 of the first support beam 24 described above. Additionally, the first plurality of apertures 40 of the first support beam 24 is evenly spaced from one another and the second plurality of apertures 108 of the second support beam 92 is evenly spaced from one another with a selected one of the first plurality of apertures 40 of the first support beam 24 and a selected one of the second plurality of apertures 108 of the second support beam 92 are aligned along the longitudinal axis C. With this configuration, each aperture 40 of the first support beam 24 has a corresponding aperture 108 of the second support beam 92 such that each pair of corresponding apertures 40, 108 is aligned along the longitudinal axis C, is aligned with each other, and/or is opposite one another. This enables the beams 24, 92 (and thus the support structure 22 supported on or by the beams 24, 92) to be level when the storage apparatus 20 is attached to the surface 10.

Each one of the plurality of apertures 108 corresponds to a particular height of the support structure 22 relative to the reference position on the surface 10 or the surface 10 itself. During assembly of the storage apparatus 20 having both the first 24 and second 92 support beams, the user selects one of the apertures 40 of the first support beam 24 and a corresponding one of the apertures 108 of the second support beam 92 with the pair of apertures 40, 108 corresponding to a desired height of the support structure 22. The user can adjust the height of the support structure 22, for example, by selecting another pair of apertures 40, 108 corresponding to another height of the support structure 22.

In an embodiment, the alignment device 48 is further defined as a first alignment device 48 and the storage apparatus 20 further includes a second alignment device 110 attached to the second support beam 92. The second alignment device 110 may be attached anywhere along the length $L_2$ of the second support beam 92. In an embodiment, the alignment device 110 is attached proximate the second beam end 96 of the second support beam 92. Additionally, the alignment device 110 is disposed adjacent the inner side 100 of the second support beam 92. The second alignment device 110 has the same configuration as the first alignment device 48, and the second alignment device 110 is attached or secured to the second support beam 92 in the same fashion as described above for attachment of the first alignment device 48 to the first support beam 24.

In an embodiment, the cable 52 is further defined as a first cable 52 and the storage apparatus 20 further includes a second cable 112. The second cable 112 has first 114 and second 116 cable ends. The first cable end 114 of the second cable 112 is adapted to be attached to the surface 10, such as with the same fastening system 58 and turnbuckle 60 used to attach the first cable end 54 of the first cable 52 to the surface 10 as described above. The turnbuckles 60 attached to the cables 52, 112 provides a means for leveling second beam ends 28, 96 of the first 24 and second 92 support beams, respectively. Adjustments to the turnbuckles 60 reduces or increases the length of the cables 52, 112, which reduces or increases a distance between the support structure 22 and the surface 10 to level the second beam ends 28, 96.

The second cable end 116 is removably attached to the second support beam 92 at a selected one of the second plurality of mounting positions 108. The second cable 112 is coupled to the second alignment device 110 to align the second cable end 116 of the second cable 112 with the second support beam 92 and the selected one of the second plurality of mounting positions 108.

The storage apparatus 20 further includes a mounting post 118 coupled to a selected one of the second plurality of apertures 108 and configured to receive the second cable end 116 of the second cable 112 to attach the second cable end 116 of the second cable 112 to the second support beam 92. The mounting post 118 receives the second cable end 116 of the second cable 112 to attach the second cable end 116 to the second support beam 92 at the selected one of the second plurality of mounting positions 108 the same way as previously described for attaching the second cable end 56 of the first cable 52 to the first support beam 24 at the selected one of the first plurality of mounting positions 40.

The second cable 112 is movable along the second alignment device 110 to move the second cable end 116 of the second cable 112 from the selected one of the second plurality of mounting positions 108 to another one of the second plurality of mounting positions 108 for adjusting the support structure 22 relative to the surface 10. The second cable 112 is movable in a similar fashion as the first cable 52 described above. During adjustment of the support structure 22, the user detaches the storage apparatus 20 from the surface 10, detaches the mounting post 82 from the first support beam 24 and the mounting post 118 from the second support beam 92, and selects a new pair of mounting positions 40, 108 on the first 24 and second 92 support beams with the new pair of mounting positions 40, 108 corresponding to a new desired height of the support structure 22. The user moves the first cable 52 until the second cable end 56 is aligned with the newly selected mounting position 40 of the first support beam 24, and attaches the second cable end 56 to the first support beam 24 at the newly selected mounting position 40. The user also moves the second cable 112 until the second cable end 116 is aligned with the newly selected mounting position 108 of the second support beam 92, and attaches the second cable end 116 to the second support beam 92 at the newly selected mounting position 108. For example, the user disposes the mounting post 82 through aperture 40 associated with the newly selected mounting position 40, attaches the second cable end 56 to the mounting post 82, and secures the mounting post 82 to the first support beam 24. Additionally, the user disposes the mounting post 118 through the aperture 108 associated with the newly selected mounting position 108, and secures the mounting post 118 to the second support beam 92.

As shown at least in FIGS. 1-4, the storage apparatus 20 further includes a third support beam 120 extending transverse to the first beam axis A and attached to the first 24 and second 92 support beams. The third support beam 120 is also transverse to the second beam axis B. Additionally, the third support beam 120 also extends along the longitudinal axis C. The third support beam has first 122 and second 124 beam ends and a length $L_3$ extending between the first 122 and second 124 beam ends along the longitudinal axis C. The third support beam 120 further has a body 126 with an inner side 128, an outer side, and a ledge 132 extending inwardly from the inner side 128 of the body 126. The third support beam 120 may be formed of any suitable material, such as a metal, a metal alloy, a polymer or plastic, a natural material (e.g., wood), and/or the like, and/or combinations thereof. In the illustrated embodiments, the third support beam 120 is adapted to be coupled to the surface 10. In an embodiment, the third support beam 120 is adapted to be positioned directly adjacent and directly contacts the surface 10.

Figure 11:
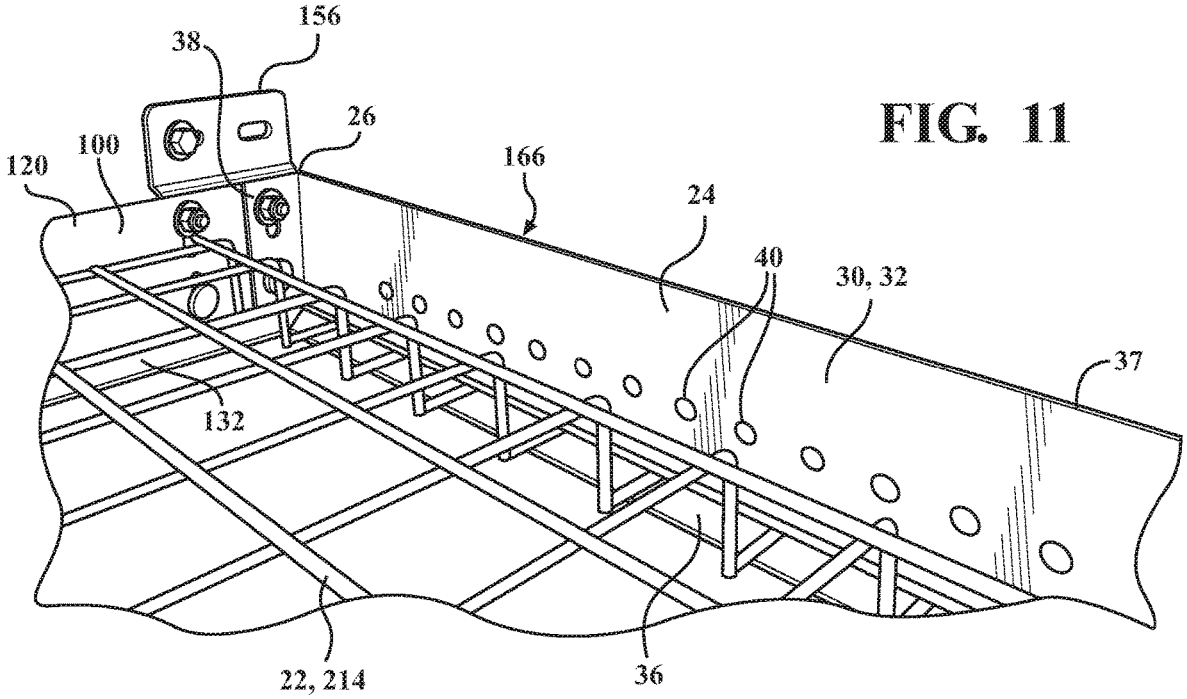
FIG. 11 is an enlarged perspective view of a portion of the storage apparatus of FIG. 1 illustrating a portion of the support structure, a portion of the first support beam, a portion of a third support beam, and an end bracket with the first and third support beams attached to the end bracket.
Figure 13:
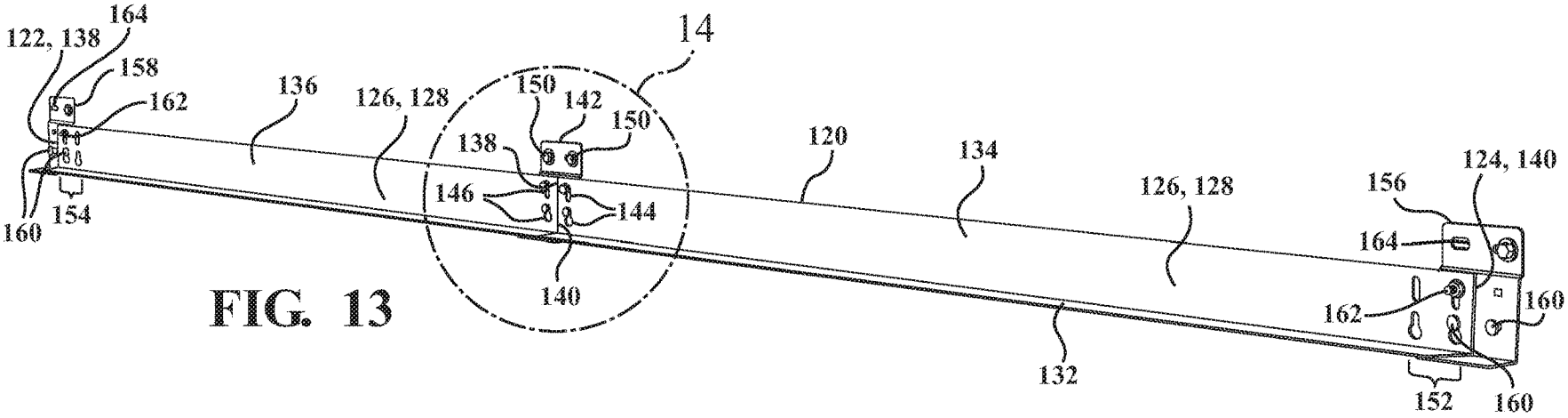
FIG. 13 is a perspective view of the third support beam of the storage apparatus of FIG. 1 including first and second beam segments, a central bracket for interconnecting the first and second beam segments, and end brackets with the first beam segment attached to one of the end brackets and the second beam segment attached to the other end bracket.

The third support beam 120 is configured to be attached to the first support beam 24 (such as with fasteners, rivets, and/or another suitable fastening system) to interconnect the first 24 and third 120 support beams, as best shown in FIG. 11. For example, the flange 38 at the first end 26 of the first support beam 24 is positioned against the inner side 128 of the third beam 120, and rivets and/or fasteners are used to attach the flange 38 of the first support beam 24 to the third support beam 120. The third support beam 120 is also configured to be attached to the second support beam 92 (such as with fasteners, rivets, and/or another suitable fastening system) to interconnect the second 92 and third 120 support beams, as best shown in FIG. 12. For example, the flange 106 at the first end 94 of the second support beam 92 is positioned against the inner side 128 of the third support beam 120, and rivets and/or fasteners are used to attach the flange 106 of the second support beam 92 to the third support beam 120. Further details for how the third support beam 120 is attached to the first 24 and second 92 support beams are described below.

In an embodiment, the third support beam 120 may be formed as a single piece. In another embodiment, and as shown at least in FIGS. 13 and 14, the third support beam 120 has interconnected first 134 and second 136 beam segments. Each of the first 134 and second 136 beam segments of the third support beam 120 has first 138 and second 140 segment ends. The first segment end 138 of the first beam segment 134 is interconnected to the second segment end 140 of the second beam segment 136 utilizing a first central bracket 142. In other words, both of the first 134 and second 136 beam segments are attached to the first central bracket 142, which interconnects the first 134 and second 136 beam segments to form the third support beam 120.

Figure 14:
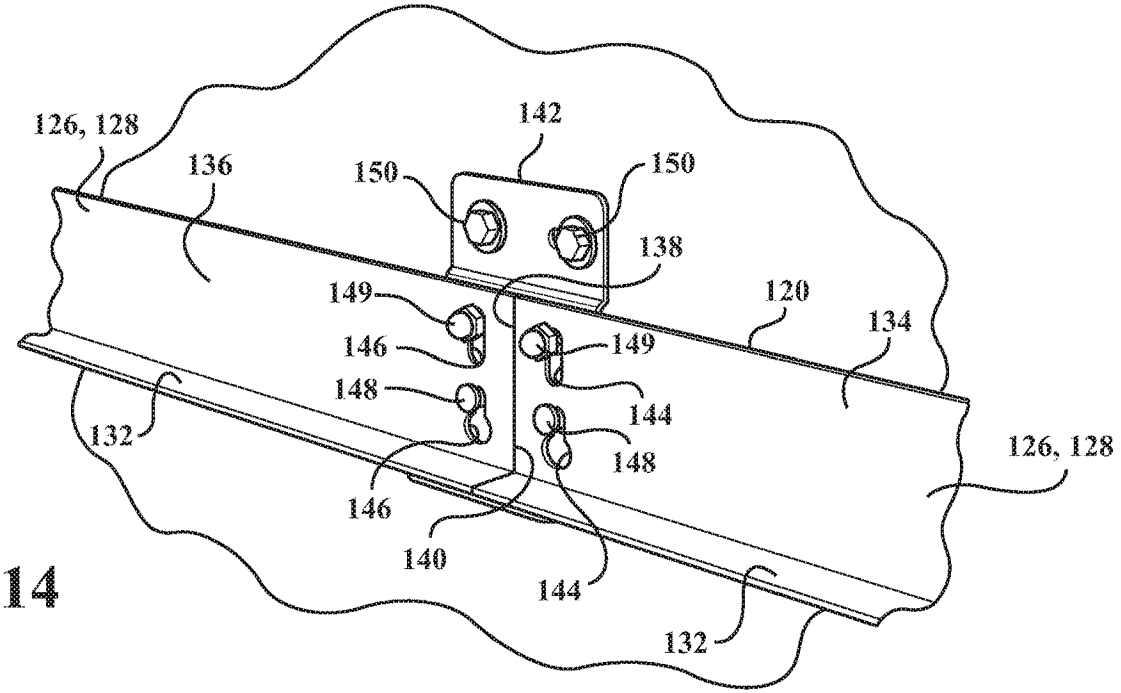
FIG. 14 is an enlarged view of a portion of the first support beam and the central bracket interconnecting the first and second beam segments.
Figure 15:
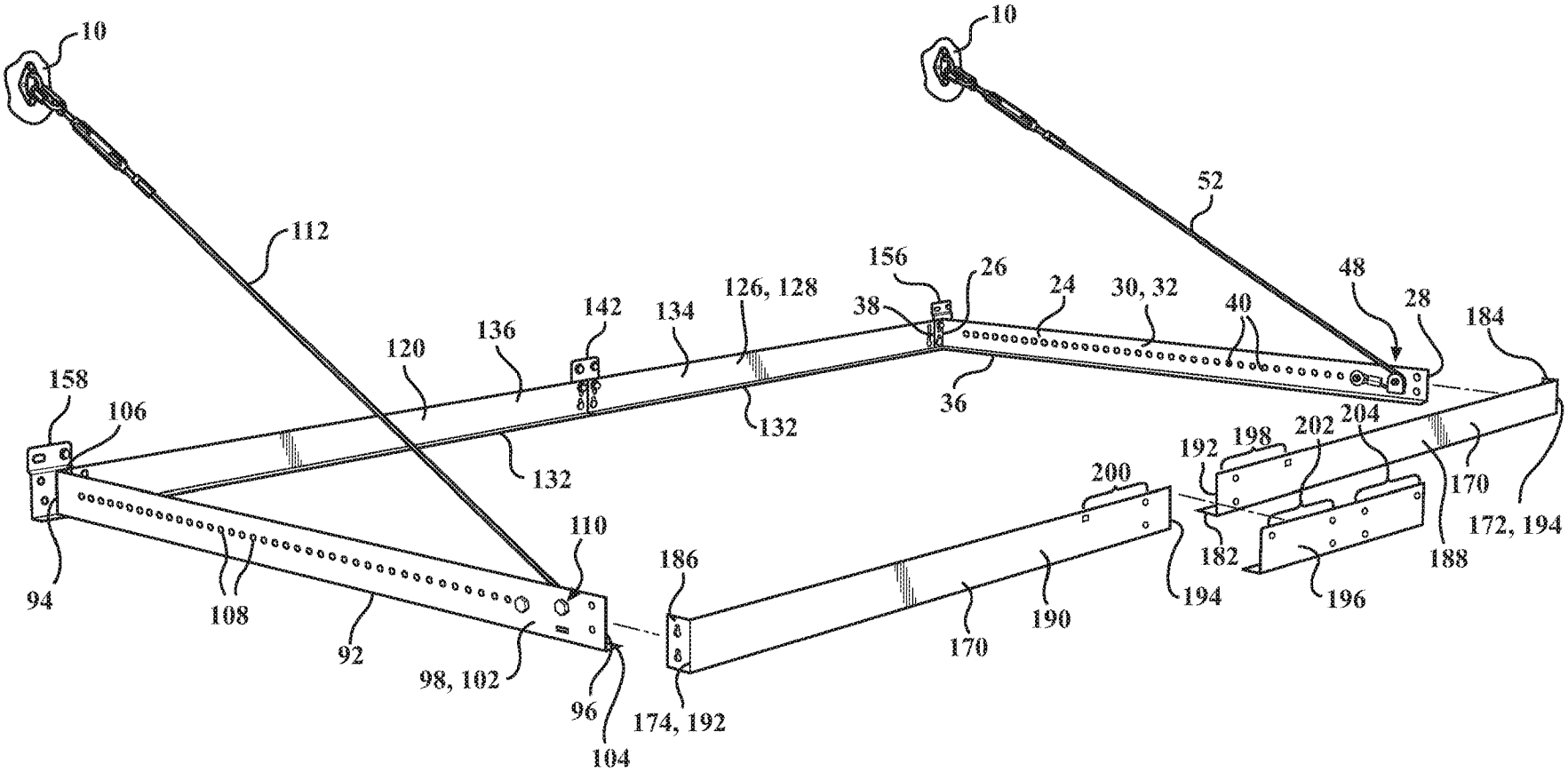
FIG. 15 is a partially exploded perspective view of the storage apparatus of FIG. 1 with the support structure, the cross beams, and the support bars removed.

As best shown in FIG. 14, the first beam segment 134 has a pair of vertically-arranged apertures 144 proximate the first segment end 138, and the second beam segment 136 has a pair of vertically-arranged apertures 146 proximate the second segment end 140. Each of the upper apertures of the pairs of apertures 144, 146 has an oval configuration, and each of the lower apertures of the pairs of apertures 144, 146 has a key-hole configuration. The first central bracket 142 has a pair of rivets 148, with one of the rivets 148 disposed within and secured by the key-hole shaped aperture of the first beam segment 134 and another one of the rivets 148 disposed within and secured by the key-hole shaped aperture of the second beam segment 136. Additionally, the first central bracket 142 defines two pairs of vertically arranged apertures which are aligned with the pairs of vertically-arranged apertures 144, 146 of the first 134 and second 136 beam segments. Fasteners 149 are inserted through the upper aligned apertures to attach the beam segments 134, 136 to the first central bracket 142.

In an embodiment, at least one of the apertures of the first central bracket 142 may have a square-shaped configuration and at least one of the fasteners 149 may have a shaft with a square-shaped configuration complementary to the square-shaped configuration of the aperture(s). When the fastener(s) 149 is/are disposed through the aperture(s) of the first central bracket 142, the square-shaped configuration of the shaft of the bolt mates with the square-shaped configuration of the respective aperture to prevent the first central bracket 142 from moving (such as spinning or rotating) as the first 134 and second 136 beam segments are attached to the first central bracket 142.

The first central bracket 142 also serves to connect the first 134 and second 136 beam segments of the third support beam 120 directly to the surface 10 utilizing fasteners (such as bolts 150).

The first beam segment 134 of the third support beam 120 further defines two pairs of vertically-arranged apertures 152 proximate the second segment end 140, and the second beam segment 136 defines two pairs of vertically-arranged apertures 154 proximate the first segment end 138. Each of the upper apertures of the pairs of apertures 152, 154 has an oval configuration, and each of the lower apertures of the pairs of apertures 152, 154 has a key-hole configuration. The storage apparatus 20 further has first 156 and second 158 end brackets, with the first end bracket 156 attached to the second segment end 140 of the first beam segment 134 and the second end bracket 158 attached to the first segment end 138 of the second beam segment 136. Each of the first 156 and second 158 end brackets has the same configuration as the first central bracket 142. For example, each of the first 156 and second 158 end brackets has a pair of rivets 160, with one of the rivets 160 disposed within and secured by the key-hole shaped apertures of the third support beam 120. Additionally, fasteners 162 are inserted through the upper aligned apertures to attach the third beam segment 120 to the first 156 and second 158 end brackets respectively.

In an embodiment, each of the first 156 and second 158 end brackets also define oval-shaped apertures 164. The oval-shaped apertures enable the end brackets 156, 158 to shift from one side to the other. For example, each of the end brackets 156, 158 may be shifted in one direction (and secured to the surface 10) such that both of the end brackets 156, 158 are attached to the third support beam 120 of the storage apparatus 20 having a single support frame 166. An example of this is shown at least in FIGS. 1, 2 and 11. However, one or more of the end brackets 156, 158 may be shifted in the opposite direction (and secured to the surface 10) such that the end bracket(s) 156, 158 is attached to the third support beam 120 of a first support frame 166 and attached to the third support beam 120 of a second support frame 168 arranged adjacent the first support frame 166 along the same horizontal plane. An example of this is shown at least in FIGS. 32 and 38.

The storage apparatus 20 further includes a fourth support beam 170 spaced from the third support beam 120 and extending transverse to the first beam axis A. The fourth support beam 170 is also transverse to the second beam axis B. Additionally, the fourth support beam 170 extends along the longitudinal axis C. The fourth support beam 170 is attached to the first 24 and second 92 support beams, and has first 172 and second 174 beam ends and a length $L_4$ extending between the first 172 and second 174 beam ends along the longitudinal axis C. Additionally, the fourth support beam 170 has a top surface 175. In an embodiment, the length $L_4$ of the fourth support beam 170 is about the same as the length $L_3$ of the third support beam 120. In an alternative embodiment, the lengths $L_3$ and $L_4$ could be different.

The fourth support beam 170 further has a body 176 with inner 178 and outer 180 sides and a ledge 182 extending inwardly from the inner side 178 of the body 176. The fourth support beam 170 further has first 184 and second 186 flanges at the first 172 and second 174 beam ends respectively. The first flange 184 is directly attached to the first support beam 24 (such as with fasteners) to interconnect the fourth support beam 170 and the first support beam 24, and the second flange 186 is directly attached to the second support beam 92 (such as with fasteners) to interconnect the fourth support beam 170 and the second support beam 92. The fourth support beam 170 may be formed of any suitable material, such as a metal, a metal alloy, a polymer or plastic, a natural material (e.g., wood), and/or the like, and/or combinations thereof. In the illustrated embodiments, the fourth support beam 170 is spaced from the surface 10, but adapted to be coupled to the surface 10.

Figure 24:
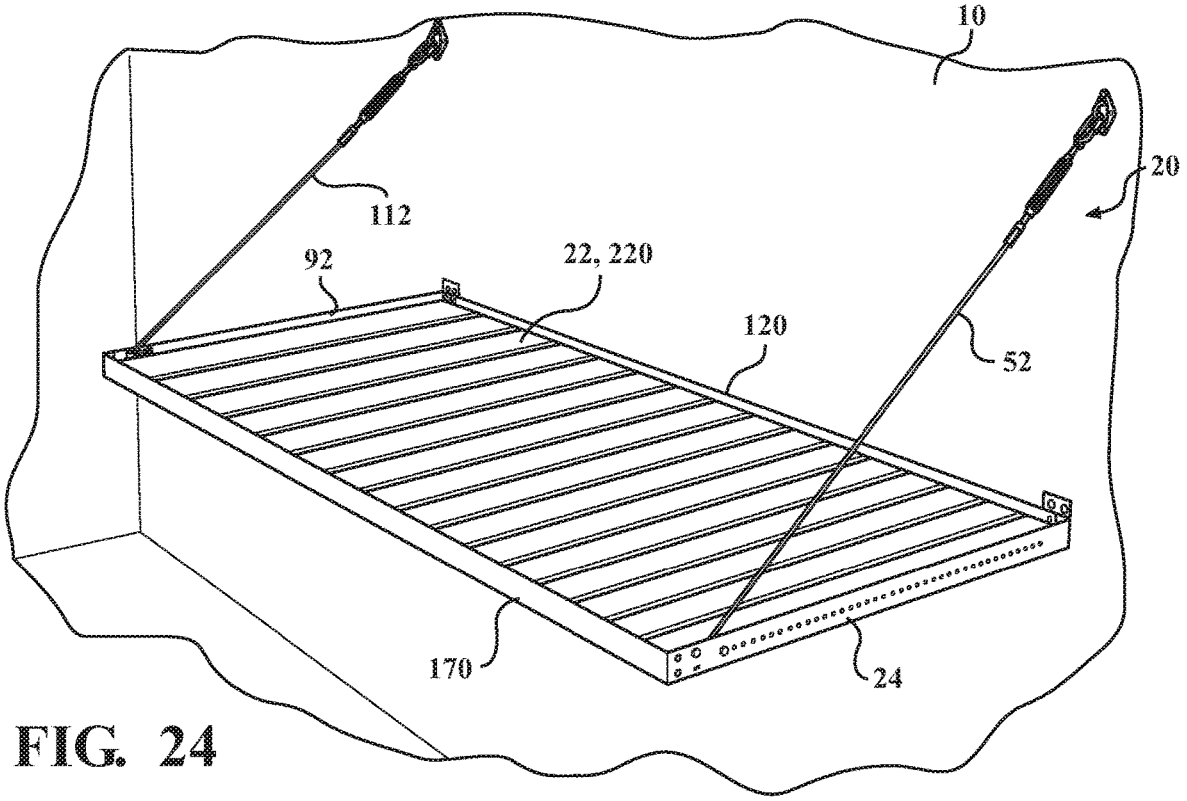
FIG. 24 is a semi-schematic perspective view of another embodiment of a storage apparatus including a plurality of support panels.
Figure 25:
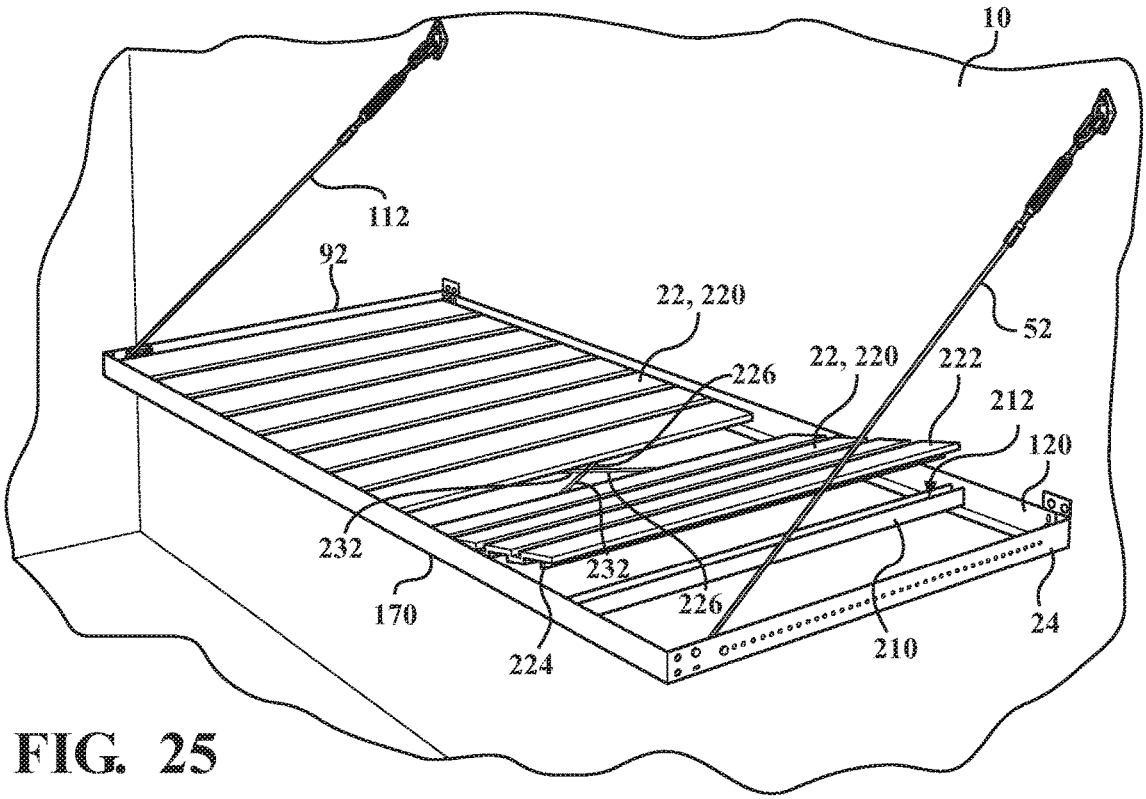
FIG. 25 is a semi-schematic perspective view of a portion of the storage apparatus of FIG. 24 illustrating installation of one of the support panels.

In an embodiment, the fourth support beam 170 may be formed as a single piece, such as shown in FIGS. 24 and 25. In another embodiment, and as shown at least in FIGS. 15 and 16, the fourth support beam 170 has interconnected first 188 and second 190 beam segments. Each of the first 188 and second 190 beam segments of the fourth support beam 170 has first 192 and second 194 segment ends. The first segment end 192 of the first beam segment 188 is interconnected to the second segment end 194 of the second beam segment 190 utilizing a second central bracket 196. In other words, both of the first 188 and second 190 beam segments are attached to the second central bracket 196, which interconnects the first 188 and second 190 beam segments to form the fourth support beam 170.

The first beam segment 188 of the fourth support beam 170 defines a set of apertures 198 proximate the first segment end 192, and the second beam segment 190 defines a set of apertures 200 proximate the second segment end 194. The apertures of each of the sets 198, 200 may have any suitable configuration. The second central bracket 196 defines first 202 and second 204 sets of apertures. The first set of apertures 202 of the second central bracket 196 is aligned with the set of apertures 200 of the second beam segment 190, and fasteners 206 are used to secure the second beam segment 190 to the second central bracket 196. Similarly, the second set of apertures 204 of the second central bracket 196 is aligned with the set of apertures 198 of the first beam segment 188, and fasteners 208 are used to secure the first beam segment 188 to the second central bracket 196.

In an embodiment, and as shown in FIG. 16, at least one of the apertures of the first 202 or second 204 sets of apertures of the second central bracket 196 may have a square-shaped configuration, and at least one of the fasteners 206, 208 may have a square-shaped shaft complementary to the square-shaped configuration of the aperture 202, 204. When the fastener 206, 208 is disposed through the aperture 202, 204 of the second central bracket 196, the square-shaped configuration of the shaft of the fastener 206, 208 mates with the square-shaped configuration of the aperture 202, 204 to prevent the second central bracket 196 from moving (such as spinning or rotating) as the first 188 and second 190 beam segments are attached to the second central bracket 196.

In an alternative embodiment, the fourth support beam 170 could be further defined as a single second support beam as mentioned above. In this alternative embodiment, no second central bracket 196 would be required.

The first 24, second 92, third 120, and fourth 170 support beams collectively define the support frame 166 with the support structure 22 abutting and being supported by the support frame 166.

Referring at least to FIGS. 18-22, and 23A-C, the storage apparatus 20 further includes a cross beam 210 supported by a support beam, such as by the third 120 and fourth 170 support beams. The cross beam 210 extends along the first beam axis A and transverse to the longitudinal axis C. Additionally, the cross beam 210 is transverse to the third 120 and fourth 170 support beams and, in a non-limiting embodiment, is parallel to the first 24 and second 92 support beams. In an embodiment, the cross beam 210 is further defined as a plurality of cross beams 210 each extending along the first beam axis A and transverse to the longitudinal axis C.

The cross beam(s) 210 may have any suitable configuration. In an embodiment, the cross-beam(s) 210 has a U-shaped configuration in cross-section and defines a channel 212. The cross beam(s) 210 is supported by the third 120 and fourth 170 support beams and movable along the longitudinal axis C relative to the third 120 and fourth 170 support beams to adjust a position of the cross beam(s) 210. In the embodiment shown, the cross beam(s) 210 is seated against and movably supported by the respective ledges 132, 182 of the third 120 and fourth 170 support beams. Once positioned, the cross beam(s) 210 rests against the ledges 132, 182. Notably, the cross beam(s) 210 is not mounted or fixed to the support beams 120, 170 and remains movable along the longitudinal axis C.

As previously mentioned, the storage apparatus 20 further has the support structure 22. The support structure 22 abuts the cross beam(s) 210. Additionally, the support structure 22 is removably supported by the first support beam 24 and the second support beam 92. In the embodiments illustrated in FIGS. 1, 2, 11, and 20-22, and 23A-C, the support structure 22 is further defined as a plurality of support racks 214 arranged adjacent one another. Each support rack 214 may have any length or width, and may be formed of any suitable material, such as a metal, a metal alloy, a plastic, etc.

Each support rack 214 has a main portion 216 and a lip 218 extending from the main portion 216. As described in further detail below, the lip 218 is configured to be disposed within the channel 212 of one of the cross beams 210 to mount or secure the support rack 214 to the cross beam 210. The lip 218 of one of the plurality of support racks 214 and the lip of an adjacent one of the plurality of support racks 214 are disposed within the channel 212 of a common cross beam 210 to mount or secure the one of the plurality of support racks 214 and the adjacent one of the plurality of support racks 214 to the cross beam 210. In other words, the channel 212 of the cross beam 210 is configured to receive both the lip 218 of one support rack 214 and the lip 218 of and adjacent support rack 214 to mount or secure the support rack 214 to the cross beam 210. In instances where the storage apparatus 20 has a plurality of cross beams 210, the lip 218 of one of the plurality of support racks 214 and the lip 218 of an adjacent one of the plurality of support racks 214 are disposed within the channel 212 of a common one of the plurality of cross beams 210.

Mounting of the adjacent support racks 214 to a common cross beam 210 is accomplished without using locking tabs, bolts, clamps, and/or welded connections between the adjacent support racks 214. Additionally, it should be appreciated that while the respective lips 218 of the adjacent support racks 214 extend into the channel 212, the main portion 216 is seated and rests against the legs of the 'U' of the U-shaped cross beam 210. This enables weight transfer between the adjacent support racks 214. Additionally, the support racks 214 are removable from the cross beam 210, which may be accomplished by simply lifting each support rack 214 off the support beams 120, 170 and the cross beams 210.

In one embodiment, the storage apparatus 20 may have a single cross beam 210 and two support racks 214. The support racks 214 in this embodiment are further defined as end racks 221. One of the end racks 221 is positioned adjacent the first support beam 24 and the other one of the end racks 221 is positioned adjacent the second support beam 92. Each end rack 221 has the main portion 216 with first 215 and second 217 sides, the lip 218 extending from the first side 215, and a foot 219 extending from the second side 217 of the main portion 216. The respective lips 218 of the two end racks 221 are disposed within the channel 212 of the common single cross beam 210. Additionally, the foot 219 of one of the end racks 221 is seated against or supported by the ledge 36 of the first support beam 24 to mount the end rack 221 to the first support beam 24 and the cross beam 210. The foot 219 of the other one of the end racks 221 is seated against or supported by the ledge 104 of the second support beam 92 to mount the end rack 221 to second support beam 92 and the cross beam 210.

In another embodiment, the storage apparatus 20 includes a plurality of cross beams 210 and three support racks 214. The three support racks 214 include two end racks 221 and a middle rack 223 sandwiched between the end racks 221. The lip 218 of one of the end racks 221 is disposed within the channel 212 of one of the cross beams 210, and the foot 219 is seated against the ledge 36 of the first support beam 24 to mount the end rack 221 to the first support beam 24 and the cross beam 210. The lip 218 of the other one of the end racks 221 is disposed within the channel 212 of the other one of the cross beams 210, and the foot 219 is seated against the ledge 104 of the second support beam 92 to mount the end rack 221 to the second support beam 92 and other cross beam 210.

The three support racks 214 further include the middle rack 223 sandwiched between the two end racks 221. The middle rack 223 has the main portion 216 with the first 215 and second 217 sides. The middle rack 223 further has a first lip 225 extending from the first side 215 of the main portion 216 and disposed within the channel 212 of one of the cross beams 210, and a second lip 227 extending from the second side 217 of the main portion 216 and disposed within an adjacent one of the plurality of cross beams 210. Accordingly, and in this example, the lip 218 of one of the end racks 221 and the first lip 225 of the middle rack 223 are disposed within the channel 212 of a common one of the two cross beams 210, and the lip 218 of the other one of the end racks 221 and the second lip 227 of the middle rack 223 are disposed within the channel 212 of a common other one of the two cross beams 210.

It should be appreciated that the plurality of support racks 214 could have a single middle rack 223. Alternatively, the plurality of support racks 214 could have a plurality of middle racks 223 (such as two, three, four, five, or any desired number of middle racks 223), with the plurality of racks 223 sandwiched or disposed between the end racks 221. Additionally, the storage apparatus 20 can have any suitable number of cross beams 210 based on the total number of support racks 214.

Figure 21:
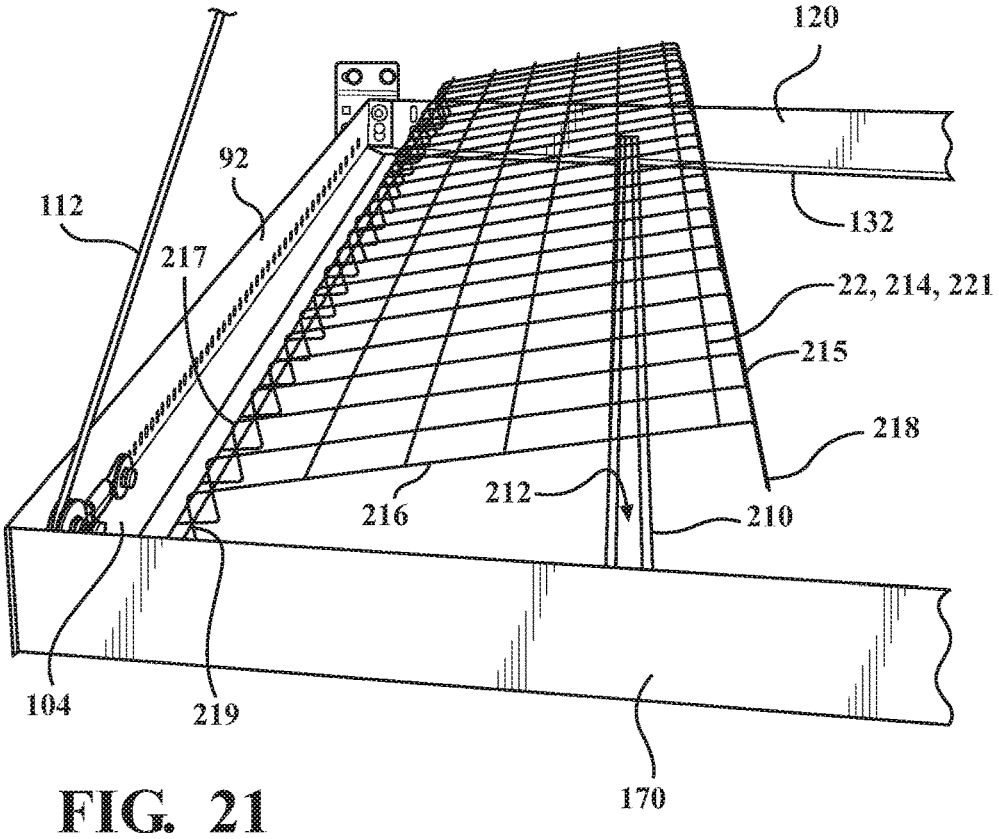
Figure 22:
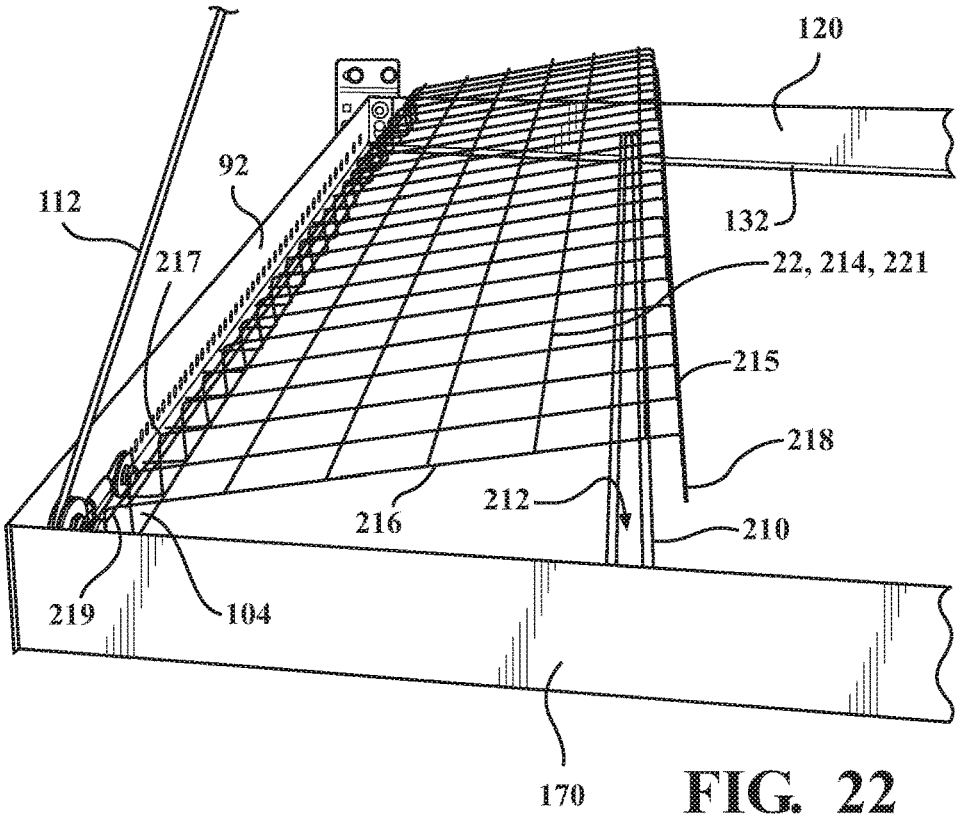

FIGS. 21, 22, and 23A show a sequence for securing the end rack 221 to the second support beam 92 and the cross beam 210. As shown in FIG. 21, the foot 219 of the end rack 221 is positioned adjacent the ledge 104 of the second support beam 92. As shown in FIG. 22, the end rack 221 is moved toward the second support beam 92 such that the foot 219 is seated against the ledge 104. As shown in FIG. 23A, the end rack 221 is moved downwardly so that the lip 218 is received within the channel 212 of the cross beam 210 to secure the end rack 221 to the support beam 92 and the cross beam 210.

The middle rack 223 may be secured to adjacent cross beams 210 of the storage apparatus 20 utilizing a sequence similar to that described above for the end rack 221. For example, and as best shown in FIGS. 23B and 23C, the first lip 225 of the middle rack 223 is received or disposed within one of the cross beams 210, and then the middle rack 223 is moved downwardly so that the second lip 227 is received or disposed within the other one of the cross beams 210 to mount the middle rack 223 to the adjacent cross beams 210.

In the embodiment illustrated in FIGS. 24 and 25, the support structure 22 is further defined as a plurality of support panels 220 formed of any suitable material, such as a metal, a metal alloy, a plastic, a natural material (such as wood), a synthetic material, etc. Each support panel 220 has a main portion 222 and a lip 224 extending from opposing sides of the main portion 222. The channel 212 of the cross beam 210 is configured to receive one of the lips 224 of the support panel 220, as similarly described above for the support rack 214. The arrangement of the plurality of support panels 220 relative to the support beams 24, 92 and the cross beams 210 is the same as described above for the plurality of support racks 214.

Although support racks 214 and panels 220 have been shown in the figures and are described above, it should be appreciated that the support structure 22 can have any configuration and be made of any suitable material.

Figure 18:
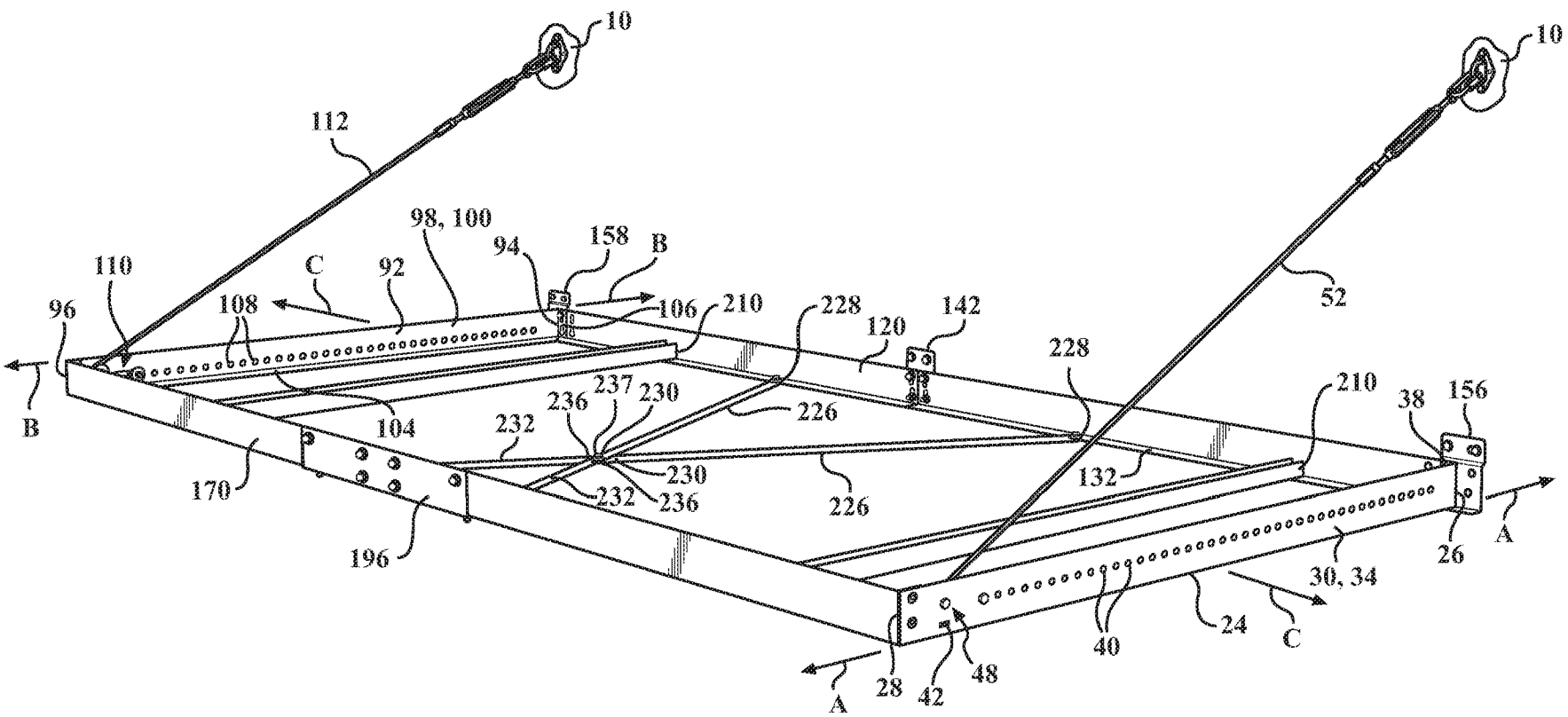
FIG. 18 is a perspective view of the storage apparatus of FIG. 1 with the support structure removed.
Figure 19:
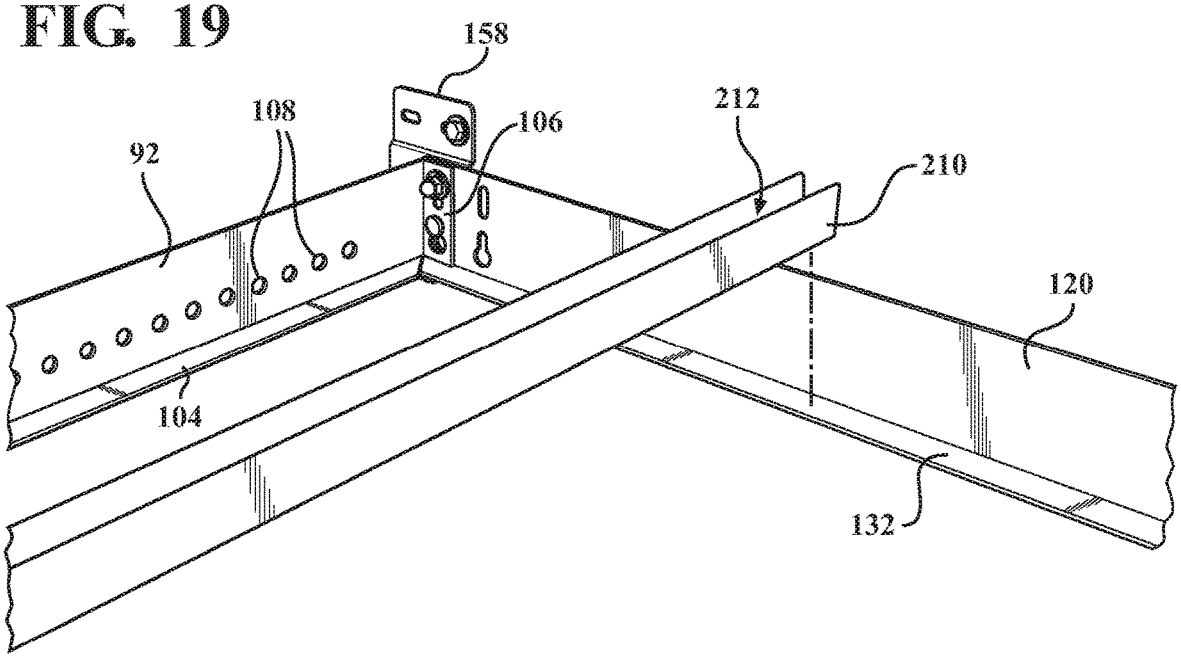
FIG. 19 is an enlarged, partially exploded view of a portion of the storage apparatus of FIG. 18.
Figure 20:
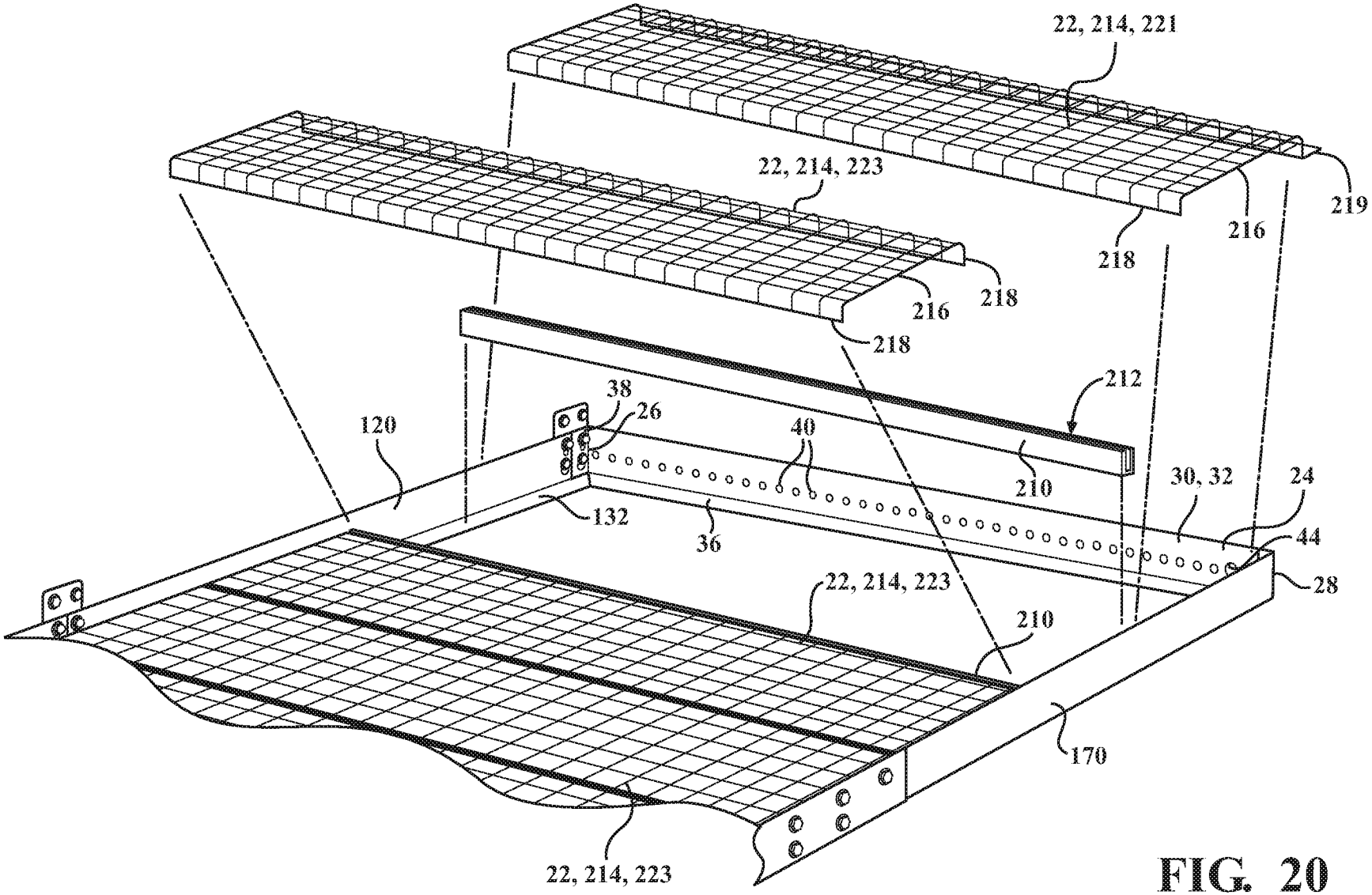
FIG. 20 is an enlarged, partially exploded, perspective view of a portion of the storage apparatus of FIG. 1.

As best shown in FIG. 18, and in an embodiment, the storage apparatus 20 further includes a pair of support bars 226 each having first 228 and second 230 bar ends with the first bar end 228 attached to the third support beam 120. The storage apparatus 20 further includes another pair of support bars 232 each having a first bar end and a second bar end 236 with the first bar end attached to the fourth support beam 170. The second bar ends 230, 236 of the pair of support bars 226 and the other pair of support bars 232 are attached to one another at a location between the third 120 and fourth 170 support beams to stabilize the support frame 166. The second bar ends 230, 236 of the pairs of support bars 226, 232 may be attached to one another by any suitable means, such as with a fastener 237 or the like.

Another embodiment of the storage apparatus 320 is described below with reference to FIGS. 26-31. In this embodiment, the storage apparatus 320 includes only first 324 and second 392 support beams with the support structure 22 abutting the first 324 and second 392 support beams. One end of each of the first 324 and second 392 support beams may be directly attached to the surface 10, such as with a bracket or other suitable fastening system. Alternatively, the one end of each of the first 324 and second 392 support beams may be positioned adjacent the surface 10, but the beams 324, 392 are not directly attached to the surface 10. The other end of each of the first 324 and second 392 support beams are coupled to the surface 10 via the cables 52, 112. The first 324 and second 392 support beams may have any suitable configuration. As illustrated, each of the first 324 and second 392 support beams has a tubular configuration.

The support structure 22 in this embodiment is further defined as a single panel or sheet of material 393 disposed on the first 324 and second 392 support beams. The panel 393 may be attached to the underlying support beams 324, 392 by any suitable means, such as with one or more fasteners. Alternatively, the panel 393 is configured to simply rest on the underlying support beams 324, 392. The panel 393 may extend from the first support beam 324 to the second support beam 392. Alternatively, the panel 393 may extend beyond the first 324 and second 392 support beams, such that the beams 324, 392 are spaced inwardly from the edges of the panel 393 as illustrated in the FIGS. 26-31.

Figure 26:
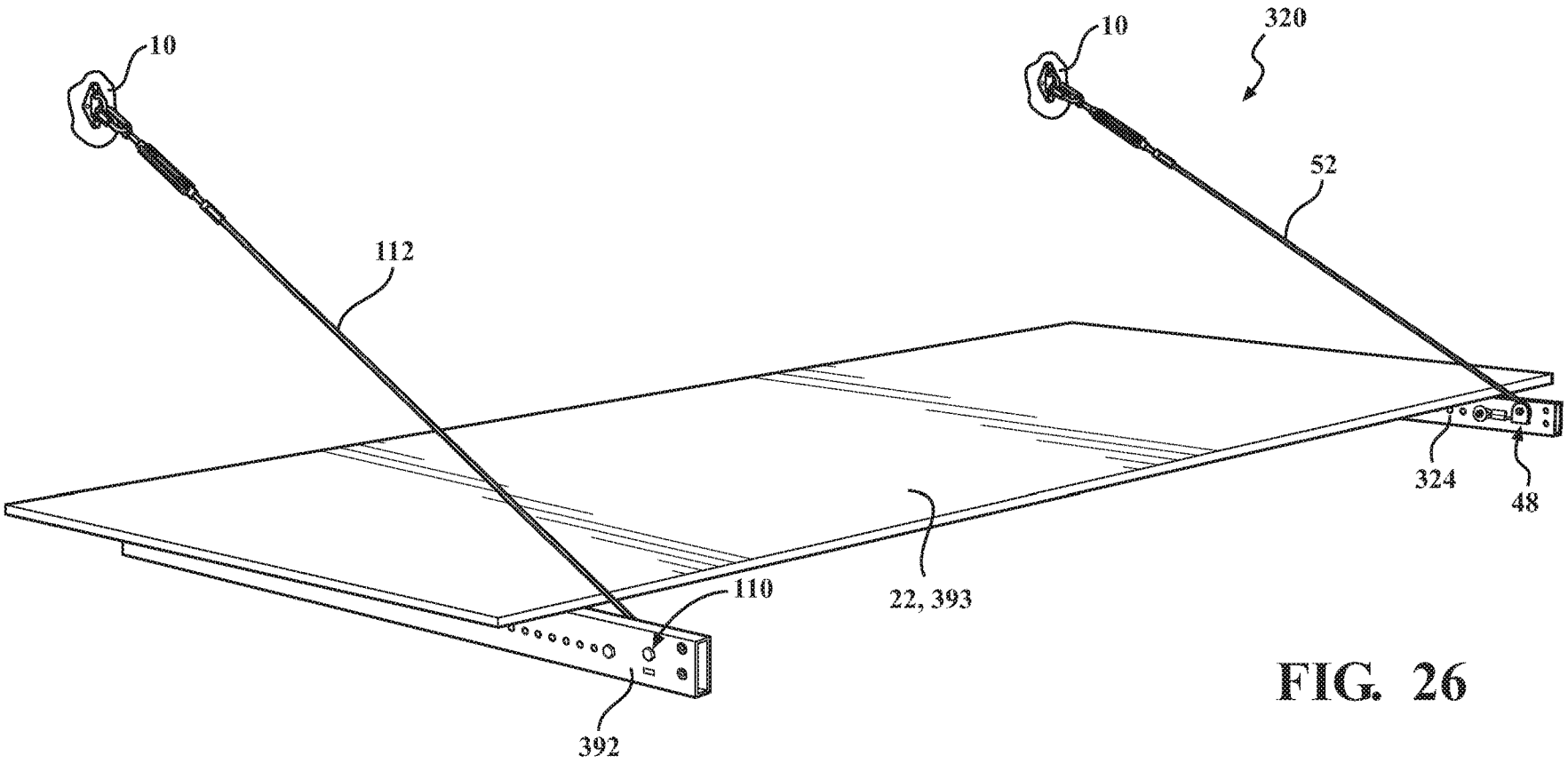
FIG. 26 is a top perspective view of another embodiment of the storage apparatus attached to the wall of the building.
Figure 27:
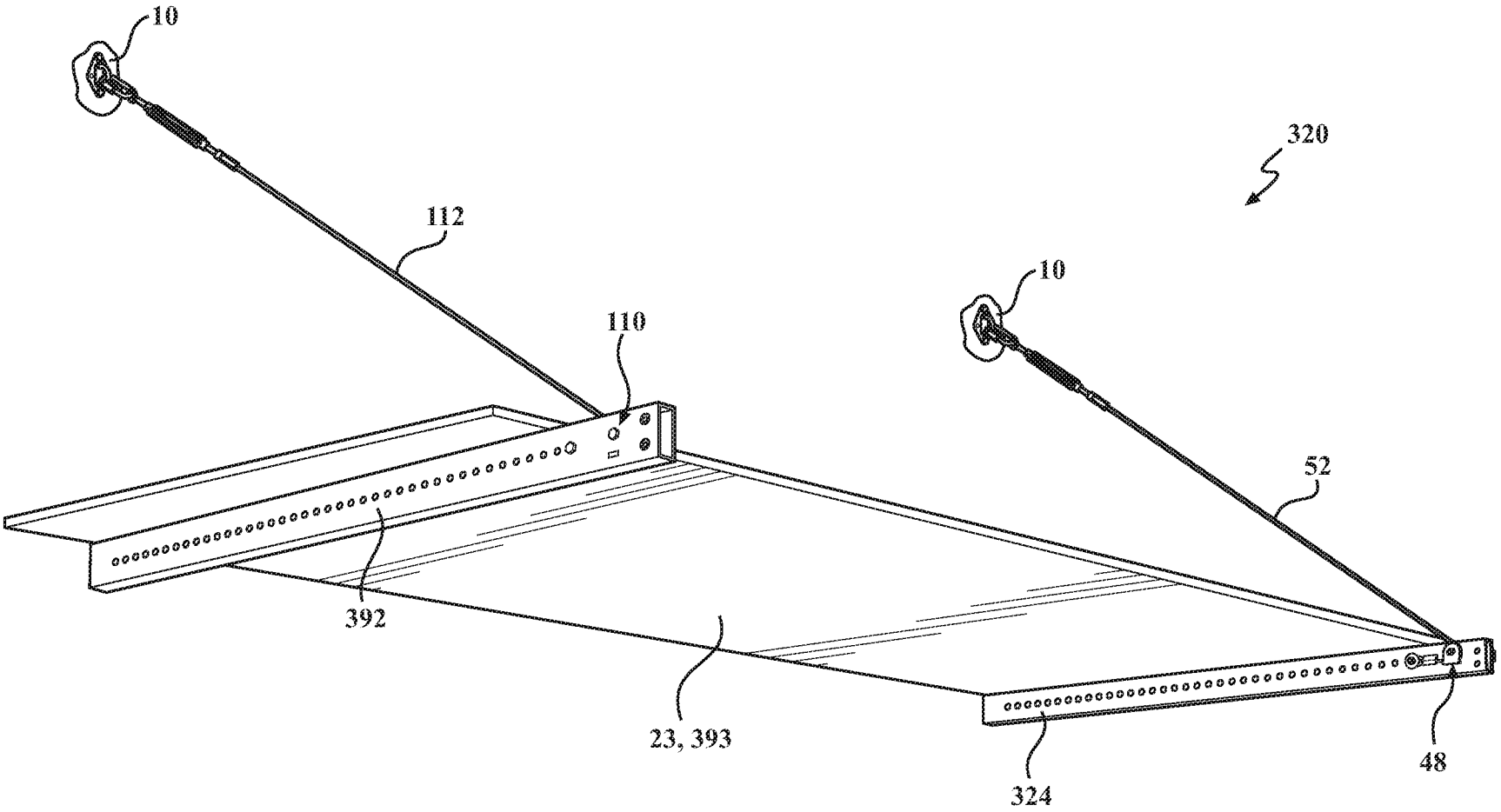
FIG. 27 is a bottom perspective view of the storage apparatus of FIG. 26 attached to the wall of the building.
Figure 28:
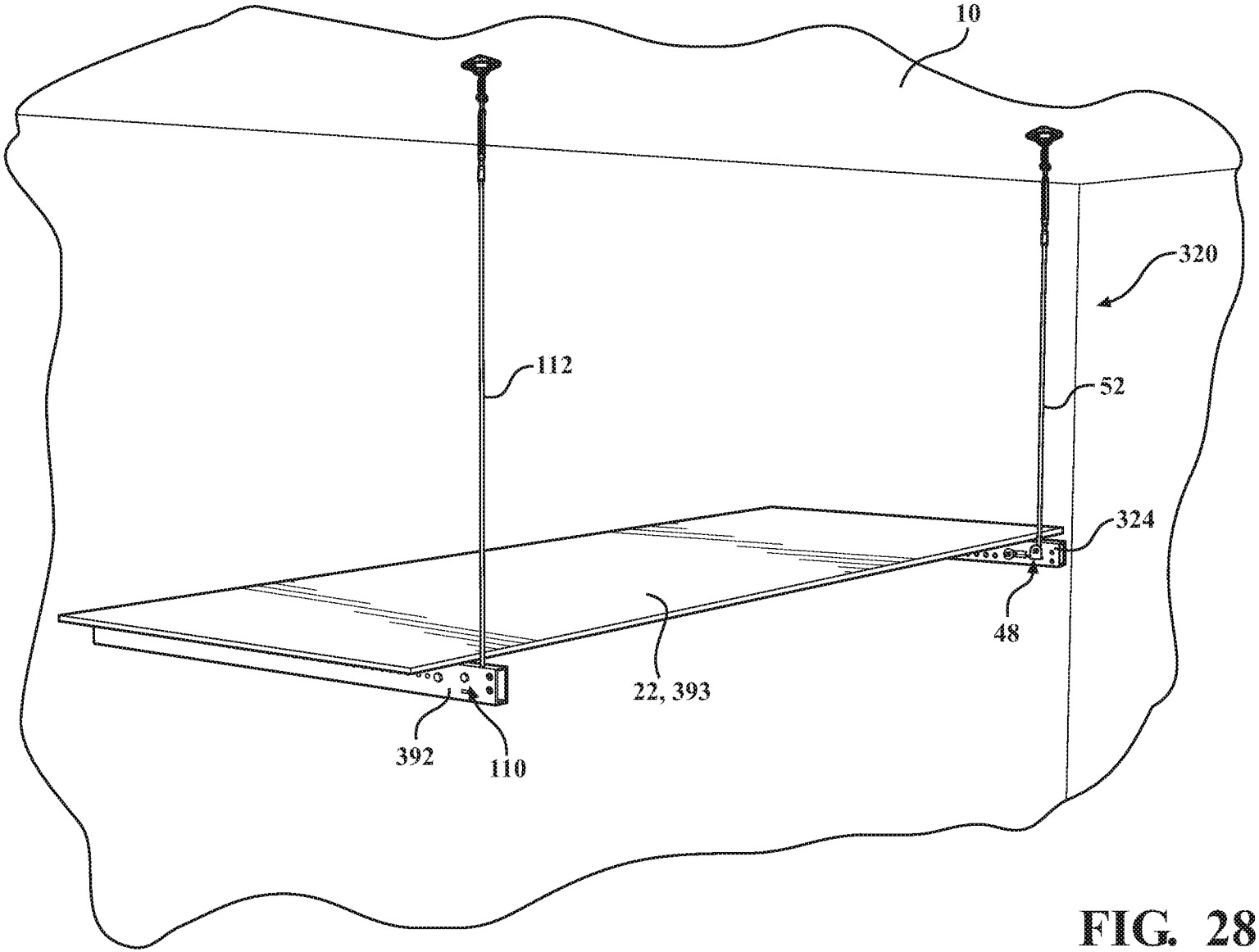
FIG. 28 is a top perspective view of the storage apparatus of FIG. 26 attached to the ceiling of the building.

The storage apparatus 320 may be attached to the wall of the building as shown in FIGS. 26 and 27, or the storage apparatus 320 may be attached to the ceiling of the building as shown in FIG. 28. In these embodiments, the storage apparatus 320 further has the first alignment device 48 attached to the first support beam 324, and the first cable 52 is coupled to the first alignment device 48 to align the first cable 52 with the first support beam 324. The storage apparatus 320 also has the second alignment device 110 attached to the second support beam 392, and the second cable 112 is coupled to the second alignment device 110 to align the second cable 112 with the second support beam 392. The user can adjust a height of the support structure 22 in the same fashion as described above for the storage apparatus 20.

Figure 29:
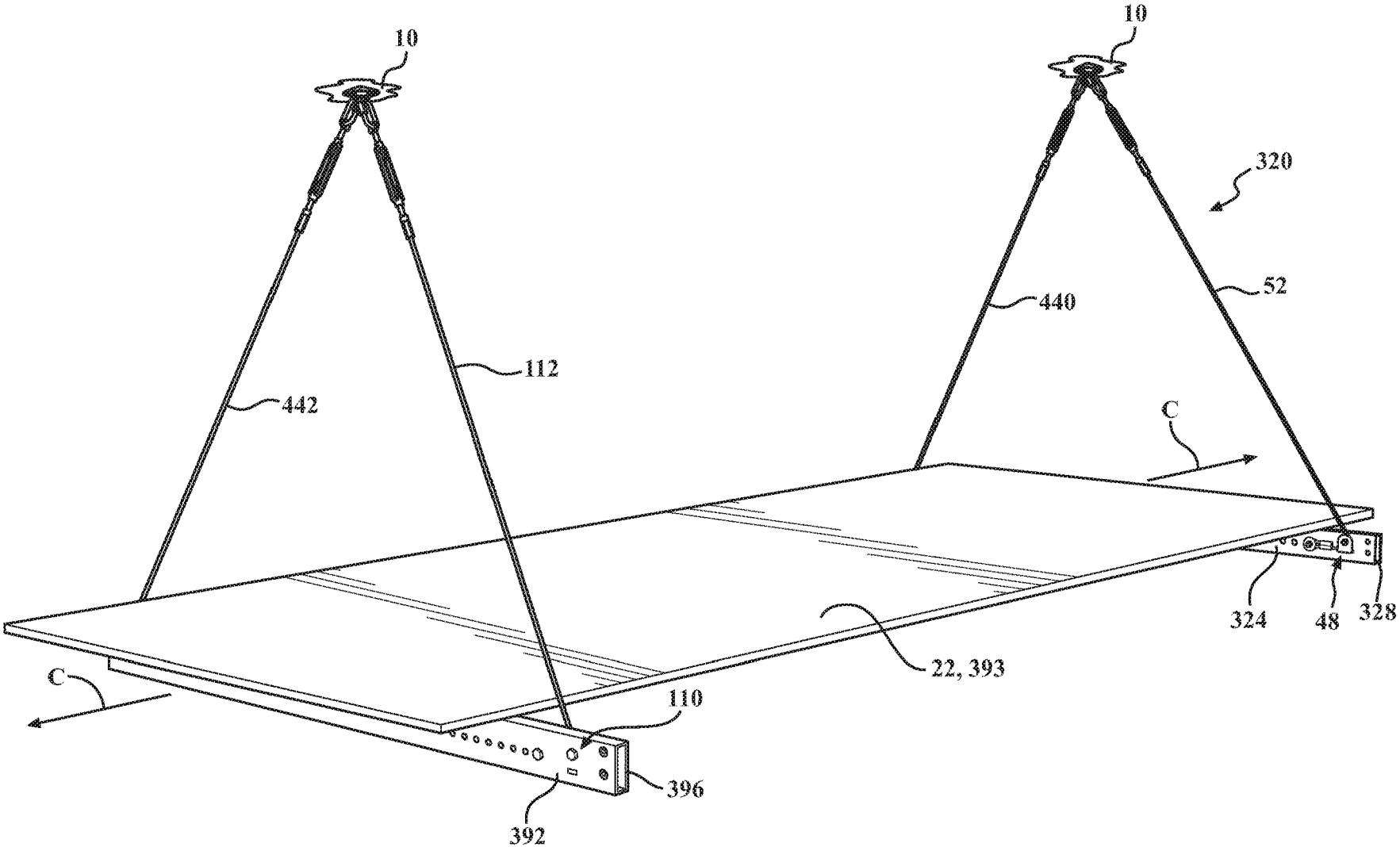
FIG. 29 is a top perspective view of another embodiment of the storage apparatus attached to the ceiling of the building.
Figure 30:
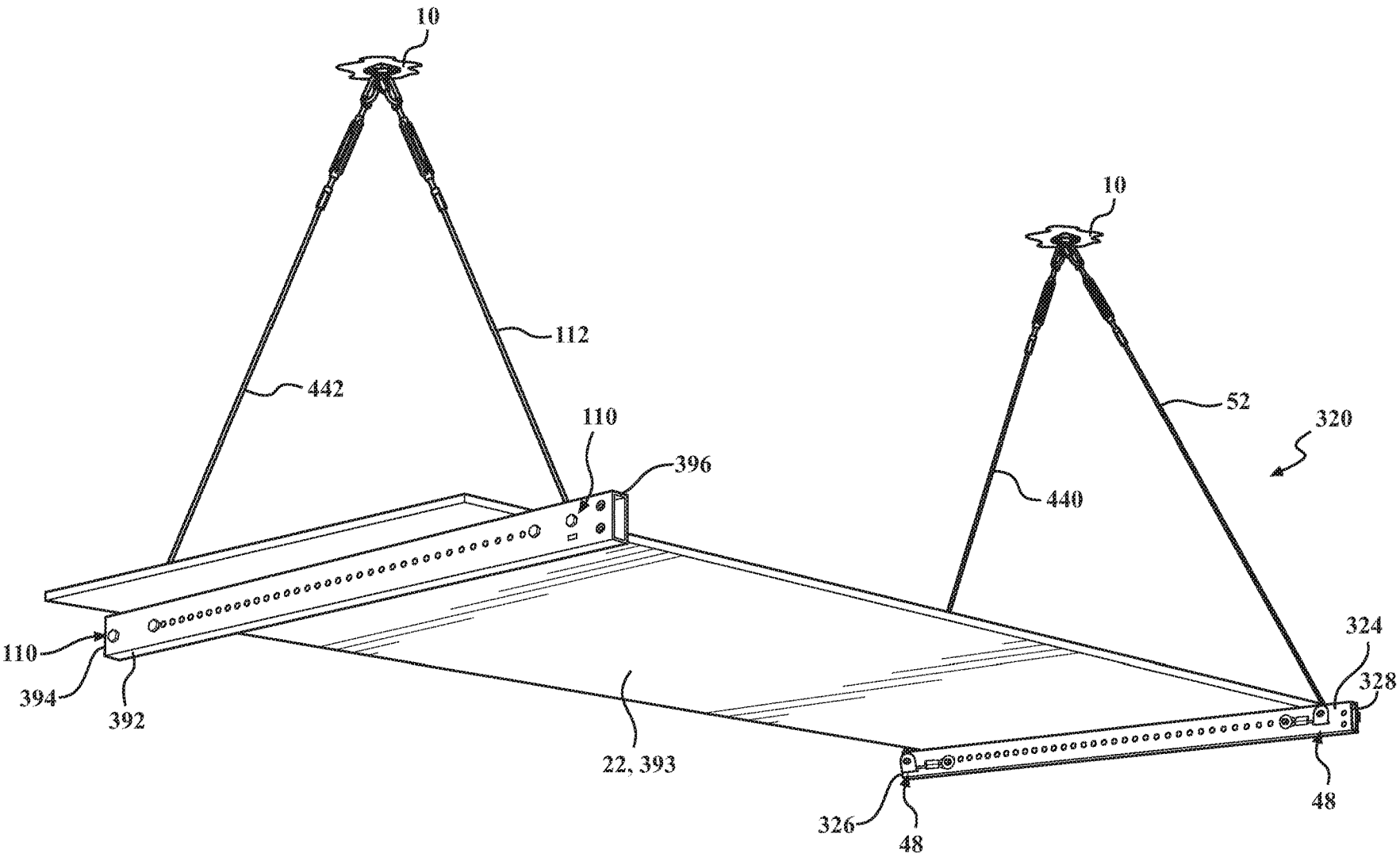
FIG. 30 is a bottom perspective view of the storage apparatus of FIG. 29 attached to the ceiling of the building.
Figure 31:
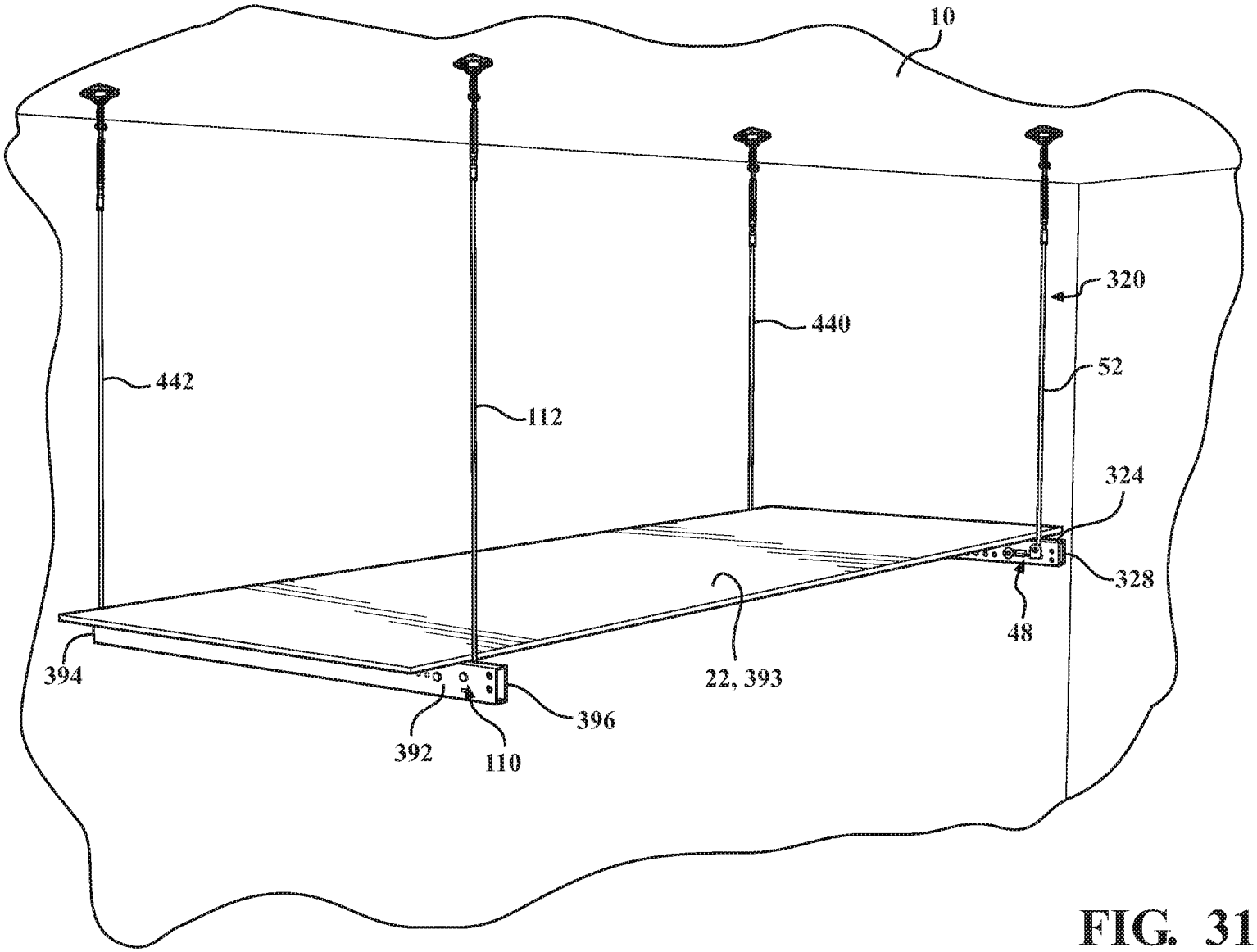
FIG. 31 is another top perspective view of the storage apparatus of FIG. 29 attached to the ceiling of the building.

As shown in FIGS. 29-31, and in another embodiment, the storage apparatus 320 has first 52, second 112, third 440, and fourth 442 cables. One end of the first cable 52 is attached to the first support beam 324 proximate the second end 328 of the first support beam 324, and one end of the third cable 440 is attached to the first support beam 324 proximate the first end 326 of the first support beam 324. Each of the cables 52, 440 are coupled to a respective alignment device 48 to align the first 52 and third 440 cables with the first support beam 324. The other ends of the first 52 and third 440 cables are attached to the surface 10. In the embodiment shown in FIGS. 29 and 30, the other ends of the first 52 and third 440 cables are attached to the surface 10 at the same attachment point. In the embodiment shown in FIG. 31, the other ends of the first 52 and third 440 cables are attached to the surface 10 at different attachment points.

At the other end of the storage apparatus 320, one end the second cable 112 is attached to the second support beam 392 proximate second end 396 of the second support beam 392, and one end of the fourth cable 442 is attached to the second support beam 392 proximate the first end 394 of the second support beam 392. Each of the cables 112, 442 are coupled to a respective alignment device to align the second 112 and fourth 442 cables with the second support beam 392. The other ends of the second 112 and fourth 442 cables are attached to the surface 10. In the embodiment shown in FIGS. 29 and 30, the other ends of the second 112 and fourth 442 cables are attached to the surface 10 at the same attachment point. In the embodiment shown in FIG. 31, the other ends of the second 112 and fourth 442 cables are attached to the surface 10 at different attachment points. In the embodiments shown in FIGS. 29-31, the support structure 22 and the first 324 and second 392 support beams are suspended from the surface 10.

In an alternative embodiment, the storage apparatus 20, 320 could have just one support beam extending along the longitudinal axis C. When storage apparatus 20, 320 is secured to the surface 10, the support beam would be spaced from the surface 10 and the support structure 22 would be directly secured to the surface 10 with hinges, brackets, or another suitable fastening system.

Figure 32:
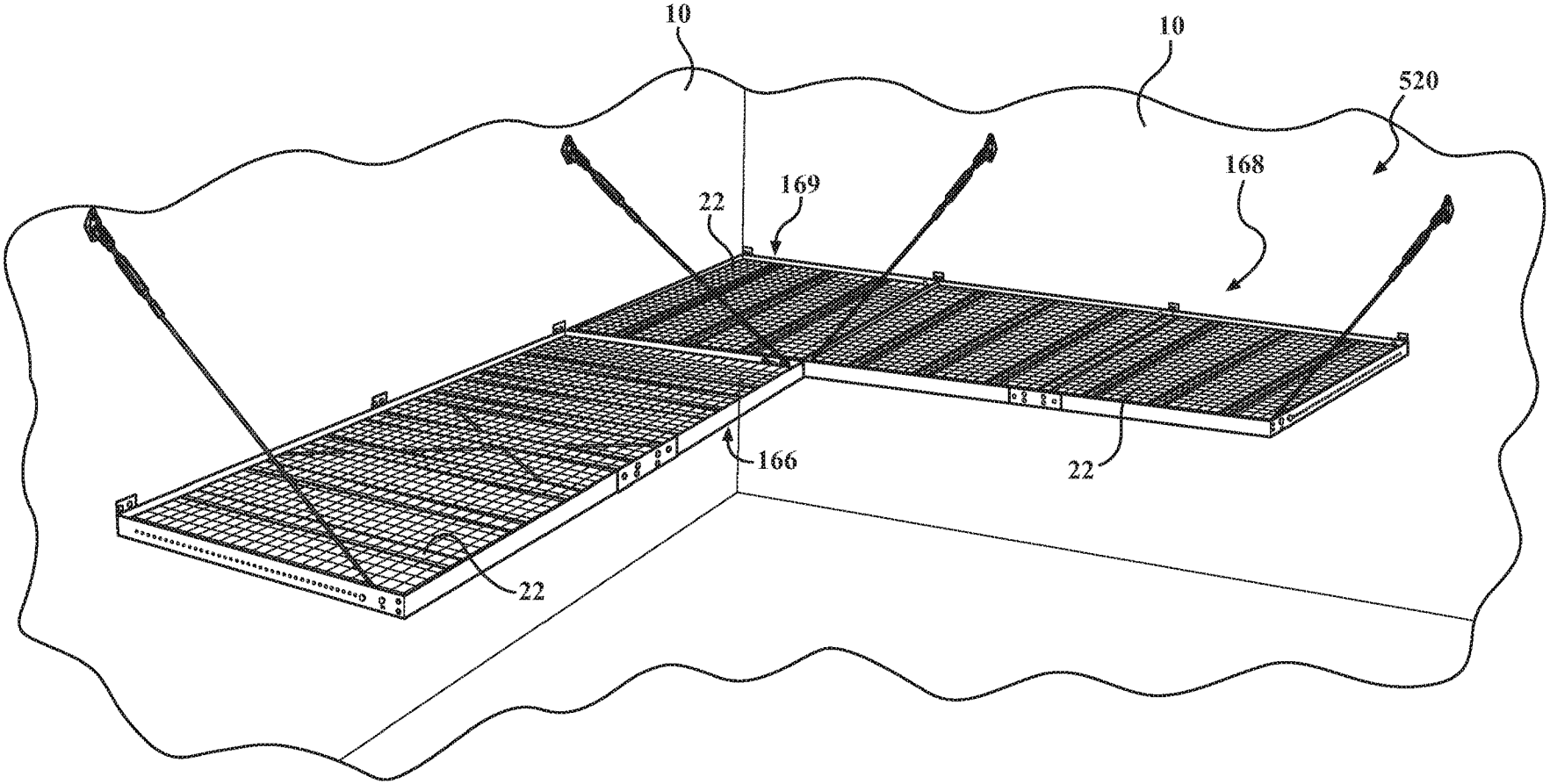
FIG. 32 is a perspective view of another embodiment of the storage apparatus including a plurality of horizontally arranged, interconnected support frames.

The embodiments of the storage apparatus 20 described above have a single support frame 166. In other embodiments of the storage apparatus 520, as described below with reference to FIGS. 32-40, the storage apparatus 520 has more than one support frame. As shown in FIG. 32, for example, the storage apparatus 520 has first 166, second 168, and third 169 support frames. In this embodiment, the first support frame 166 is the same as described above. The second support frame 168 has the same configuration as the first support frame 166. The third support frame 169 is the same as the first 166 and second 168 support frames except that the third support frame 169 is configured to be positioned at or within a corner of a room of the building.

Figure 33:
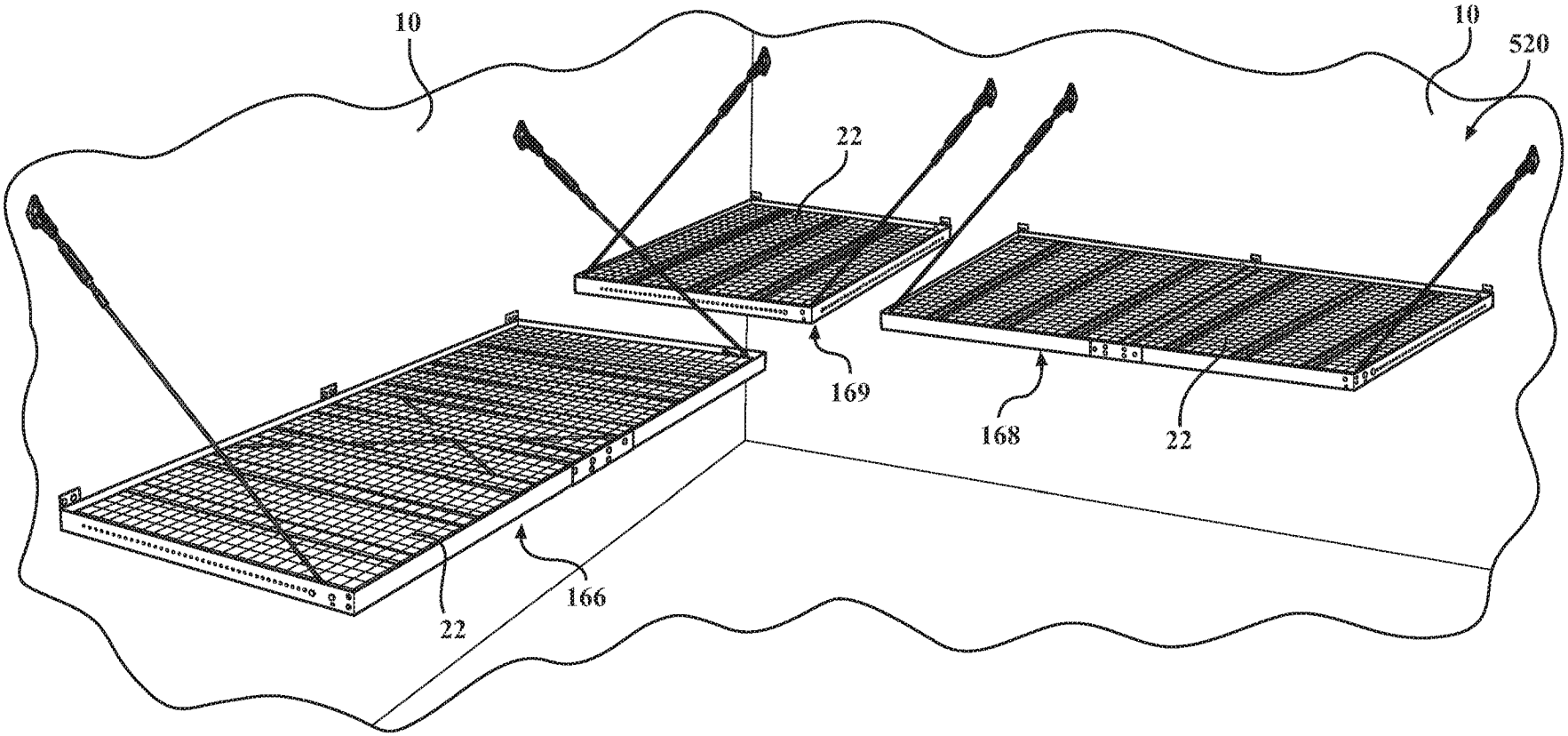
FIG. 33 is a perspective view of another embodiment of the storage apparatus including a plurality of horizontally arranged support frames spaced from one another.

In another example shown in FIG. 33, the storage apparatus 520 has the first 166, second 168, and third 169 support frames horizontally arranged. In this embodiment, the first support frame 166 is positioned adjacent but spaced from the third support frame 169, and the third support frame 169 is positioned adjacent to but spaced from the second support frame 168.

Figure 34:
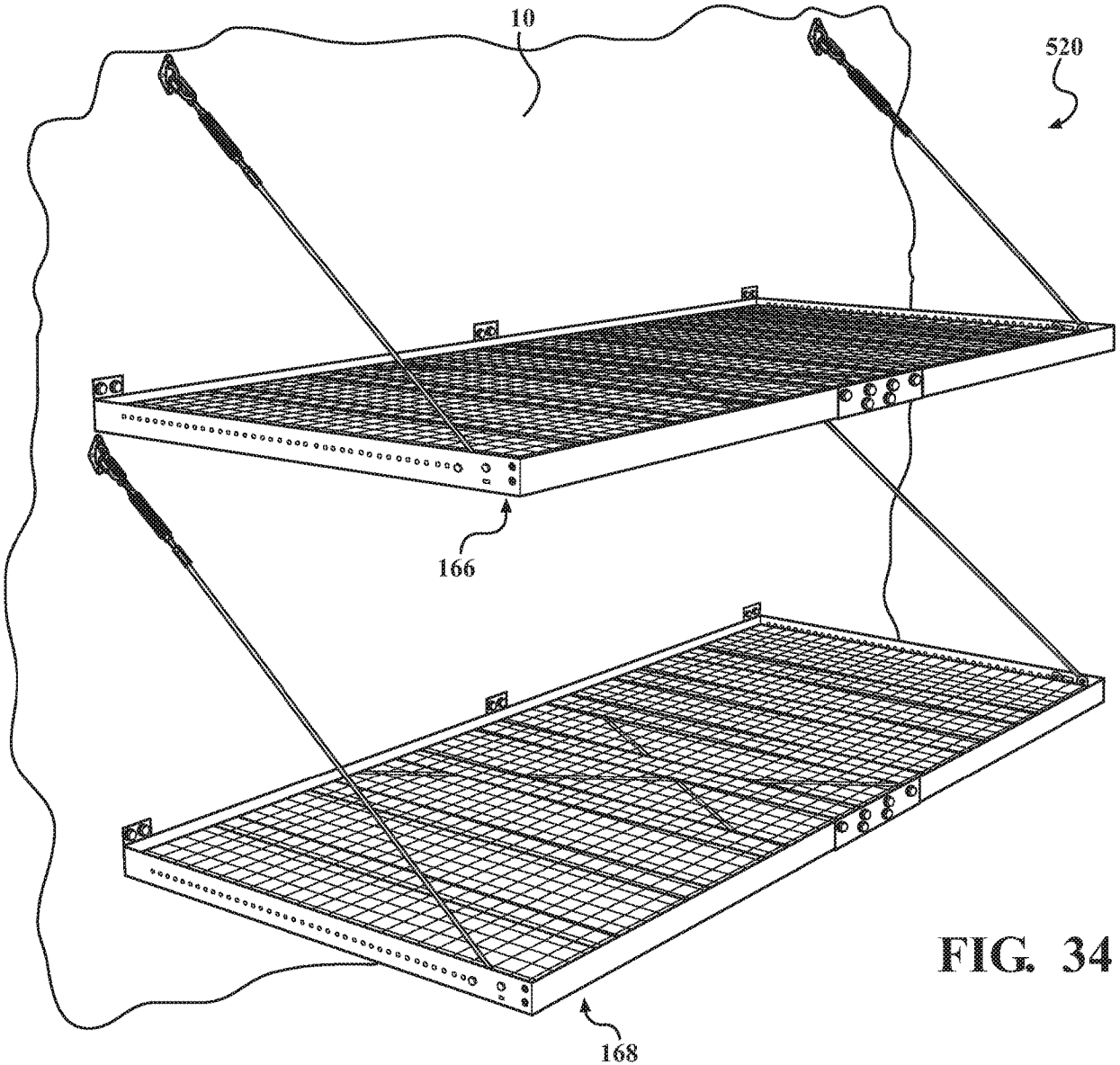
FIG. 34 is a perspective view of another embodiment of the storage apparatus including a plurality of vertically arranged support frames with each support frame individually attached to the wall of the building.

In another embodiment, and shown in FIG. 34, the storage apparatus 520 has the first 166 and second 168 support frames vertically arranged with the first support frame 166 positioned above the second support frame 168. In this embodiment, the first 166 and second 168 support frames are individually coupled to the surface 10.

Figure 35:
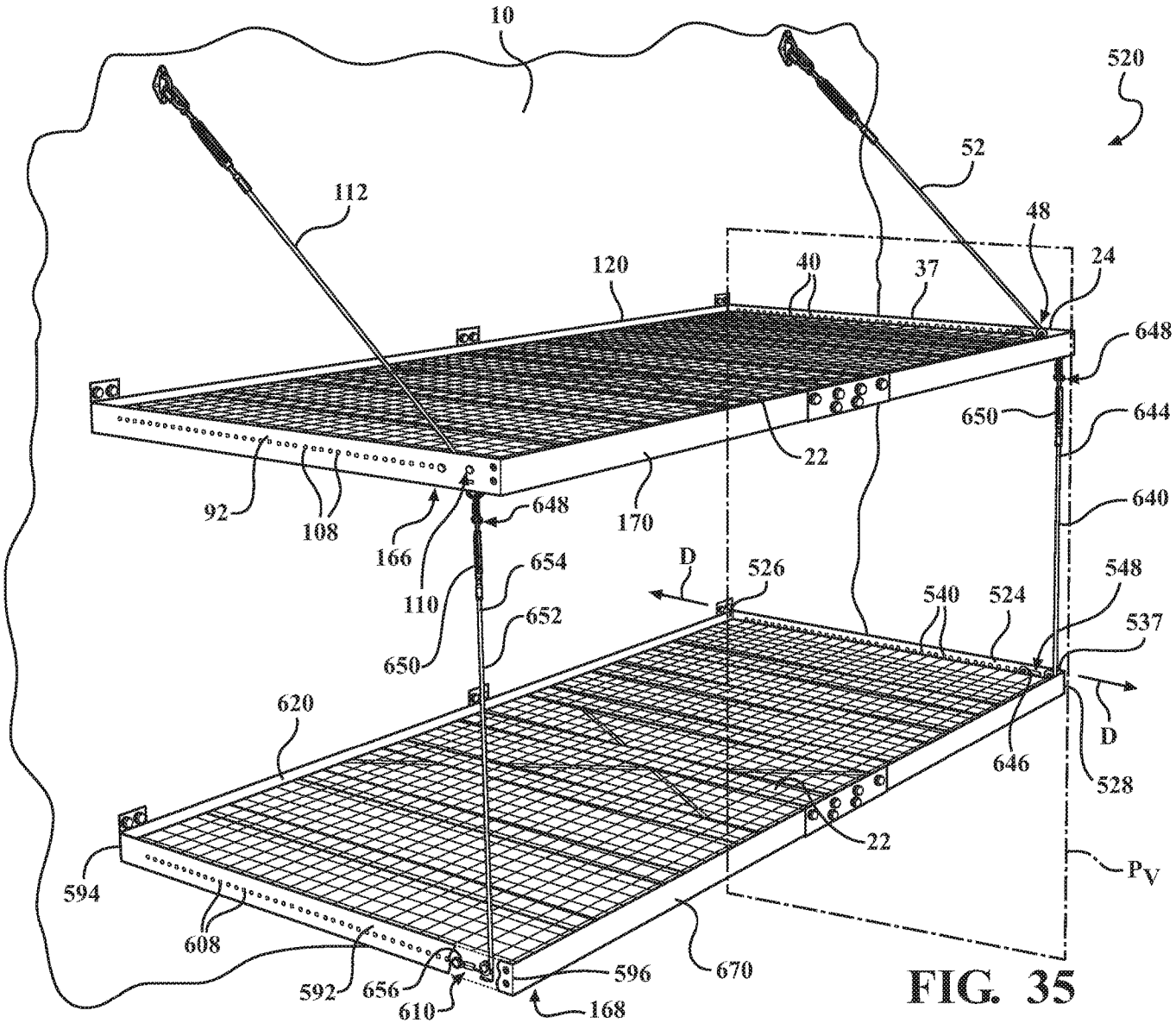
FIG. 35 is a perspective view of another embodiment of the storage apparatus including a plurality of vertically arranged, interconnected support frames attached to the wall of the building.
Figure 36:
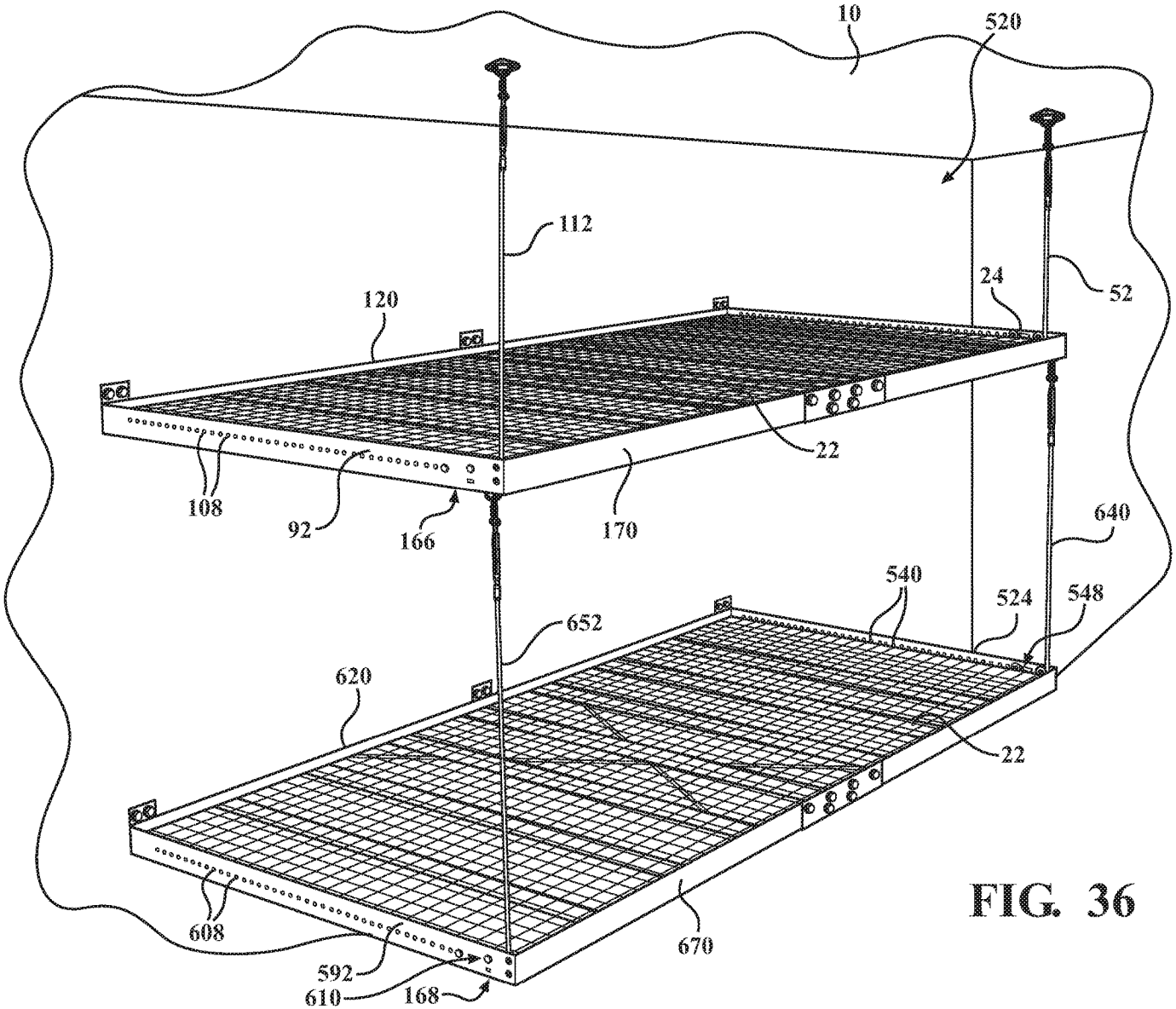
FIG. 36 is a perspective view of the storage apparatus of FIG. 35 attached to the ceiling of the building.
Figure 37:
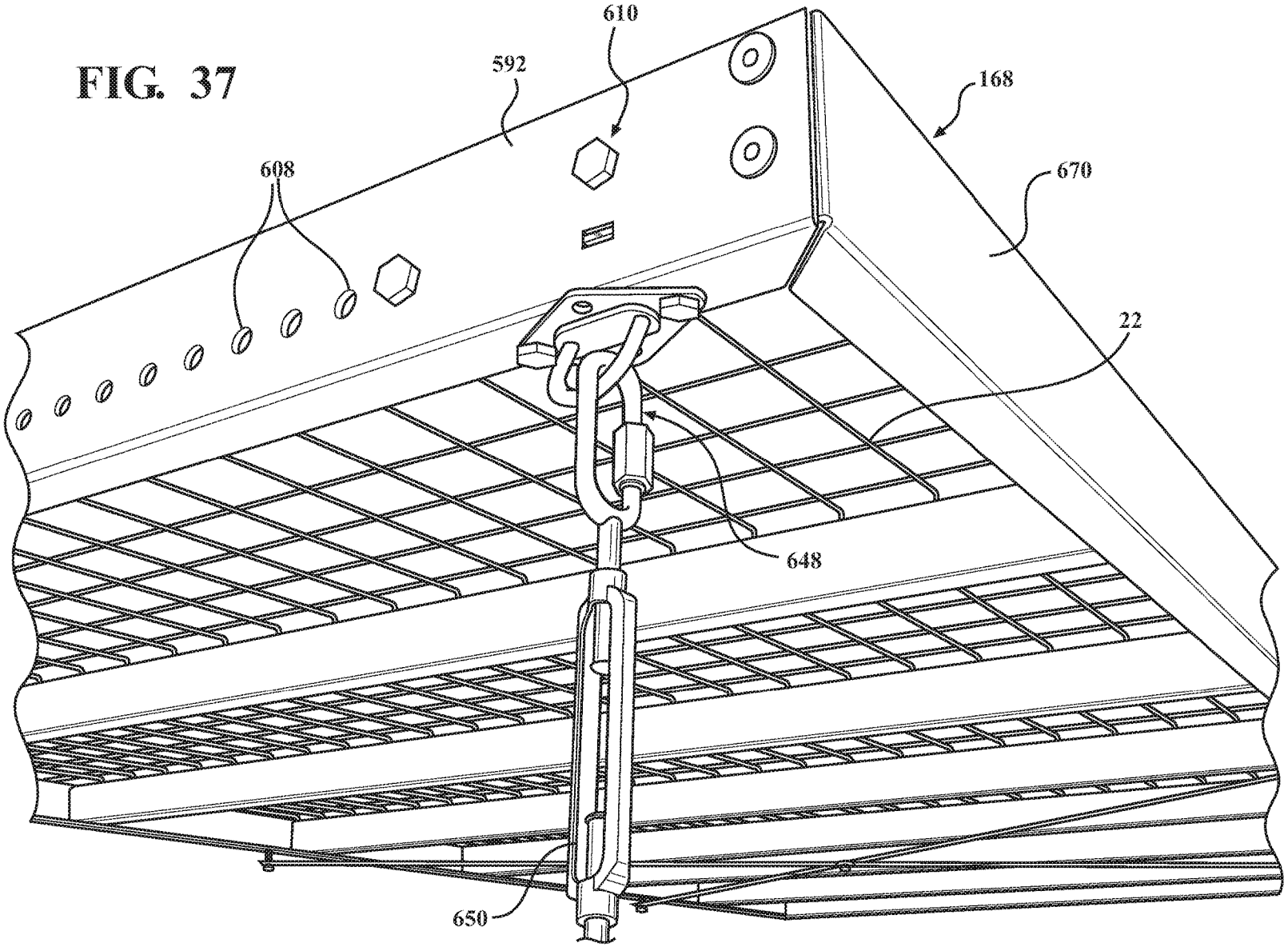
FIG. 37 is an enlarged, perspective view of a portion of a bottom side of the storage apparatus of FIG. 35.

In yet another embodiment, and as shown in FIGS. 35-37, the storage apparatus 520 has the first 166 and second 168 support frames vertically arranged with the first support frame 166 positioned above the second support frame 168 and coupled to the surface 10. The second support frame 168 attached to or suspended from the first support frame 166. The first support frame 166 may be coupled to the wall of the building, as shown in FIG. 35. Alternatively, the first support frame 166 may be coupled to the ceiling of the building, as shown in FIG. 36. In the embodiment shown in FIGS. 35-37, the second support frame 168 may be referred to as a dependent support frame 168. Further details of this embodiment are described below.

The second support frame 168 has the same configuration and includes the same individual components as the first support frame 166. Alternatively, the configuration and/or one or more of the individual components of the second support frame 168 could be different from the first support frame 166. The second support frame 168 has a first dependent support beam 524 defining a beam axis D and adapted to be coupled to the surface 10. The first dependent support beam 524 has first 526 and second 528 beam end and defines a first plurality of mounting positions 540 between the first 526 and second 528 beam ends. The first dependent support beam 524 of the second support frame 168 may have the same configuration as the first support beam 24 of the first support frame 166 described in detail above. Additionally, the first plurality of mounting positions 540 of the first dependent support beam 524 of the second support frame 168 may have the same configuration and arrangement as the first plurality mounting positions 40 of the first support beam 24 of the first support frame 166.

The first dependent support beam 524 of the second support frame 168 further has a top surface 537 and the second support frame 168 is arranged adjacent the first support frame 166 such that the top surface 37 of the first support beam 24 of the first support frame 166 and the top surface 537 of the first dependent support beam 524 of the second support frame 168 are aligned. In the embodiment shown in FIGS. 35-37, the top surface 37 of the first support beam 24 and the top surface 537 of the first dependent support beam 524 are aligned in the same vertical plane Pv.

The second support frame 168 further has a second dependent support beam 592 spaced from the first dependent support beam 524. The second dependent support beam 592 extends along the beam axis D of the first dependent support beam 524. The second dependent support beam 592 has first 594 and second 596 beam ends and defines a second plurality of mounting positions 608 between the first 594 and second 596 beam ends of the second dependent support beam 592. The second dependent support beam 592 of the second support frame 168 may have the same configuration as the second support beam 92 of the first support frame 166 described in detail above. Additionally, the second plurality of mounting positions 608 of the second dependent support beam 592 of the second support frame 168 may have the same configuration and arrangement as the second plurality mounting positions 108 of the second support beam 92 of the first support frame 166.

The second support frame 168 further has a third dependent support beam 620 extending transverse to the beam axis D of the first dependent support beam 524 and attached to the first 524 and second 592 dependent support beams. The second support frame 168 further has a fourth dependent support beam 670 spaced from the third dependent support beam 620, extending transverse to the beam axis D of the first dependent support beam 524, and attached to the first 524 and second 592 dependent support beams. The configuration of the third 620 and fourth 670 support beams of the second support frame 168 is the same as the third 120 and fourth 170 support beams of the first support frame 166 described in detail above.

The second support frame 168 further has a third alignment device 548 attached to the first dependent support beam 524, and a fourth alignment device 610 attached to the second dependent support beam 592. The configuration and arrangement of the third alignment device 548 attached to the first dependent support beam 524 of the second support frame 168 is the same as the first alignment device 48 attached to the first support beam 24 of the first support frame 166. Similarly, the configuration and arrangement of the fourth alignment device 610 attached to the second dependent support beam 592 of the second support frame 168 is the same as the second alignment device 110 attached to the second support beam 92 of the first support frame 166.

Figure 38:
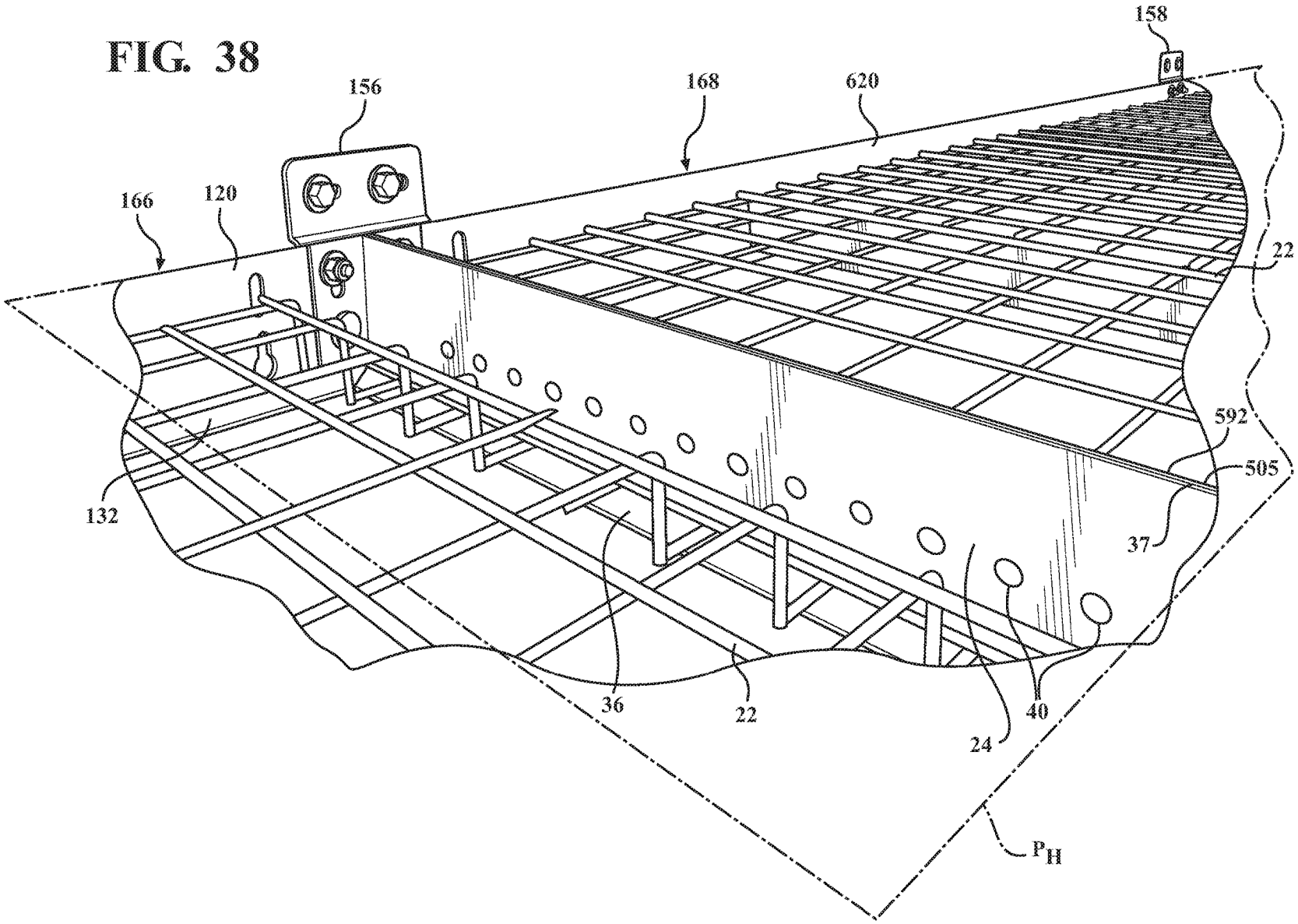
FIG. 38 is an enlarged top perspective view of a portion of another embodiment of the storage apparatus illustrating interconnected, horizontally arranged support frames.
Figure 39:
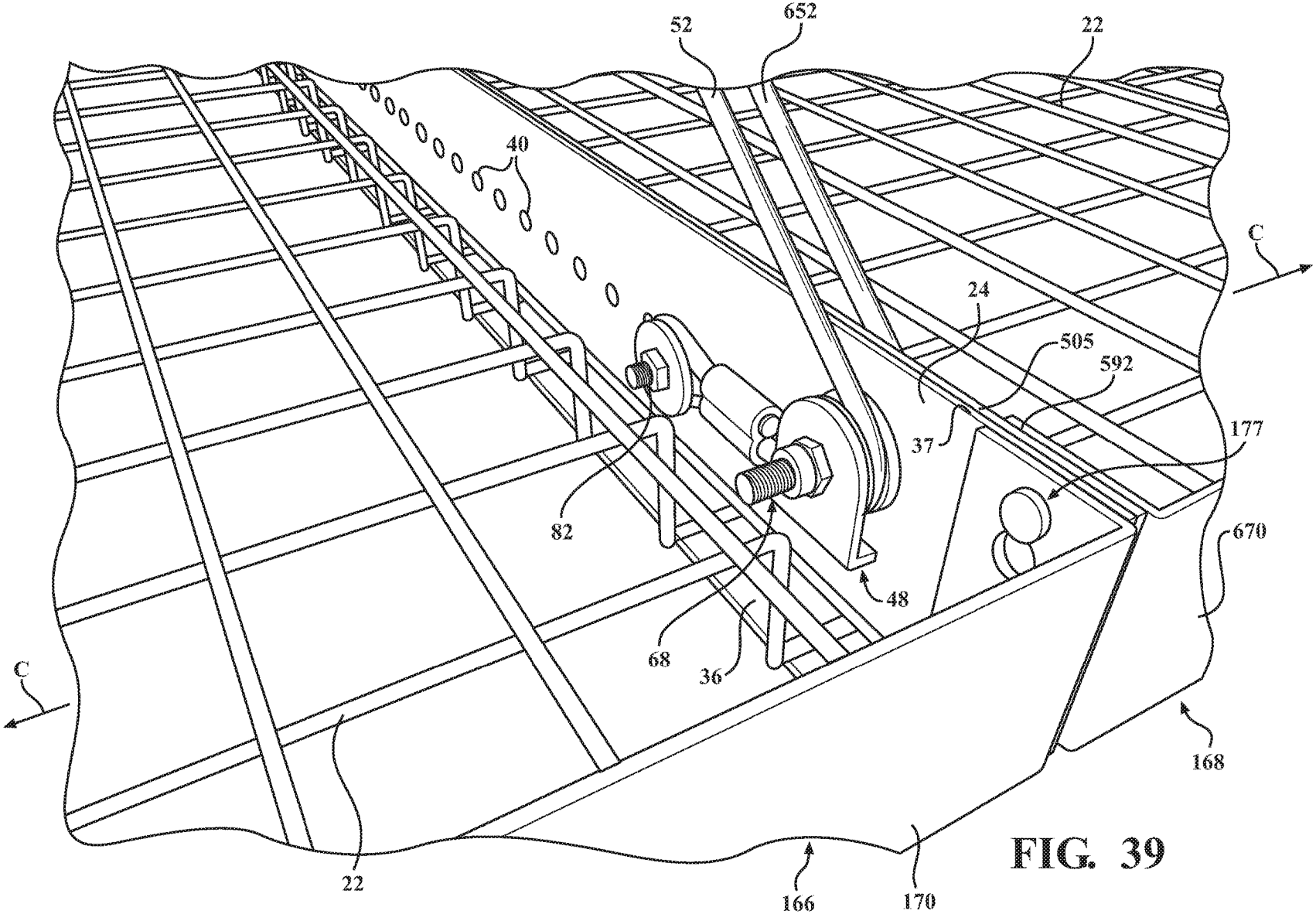
FIG. 39 is an enlarged top perspective view of another portion of the embodiment of the storage apparatus with interconnected, horizontally arranged support frames.
Figure 40:
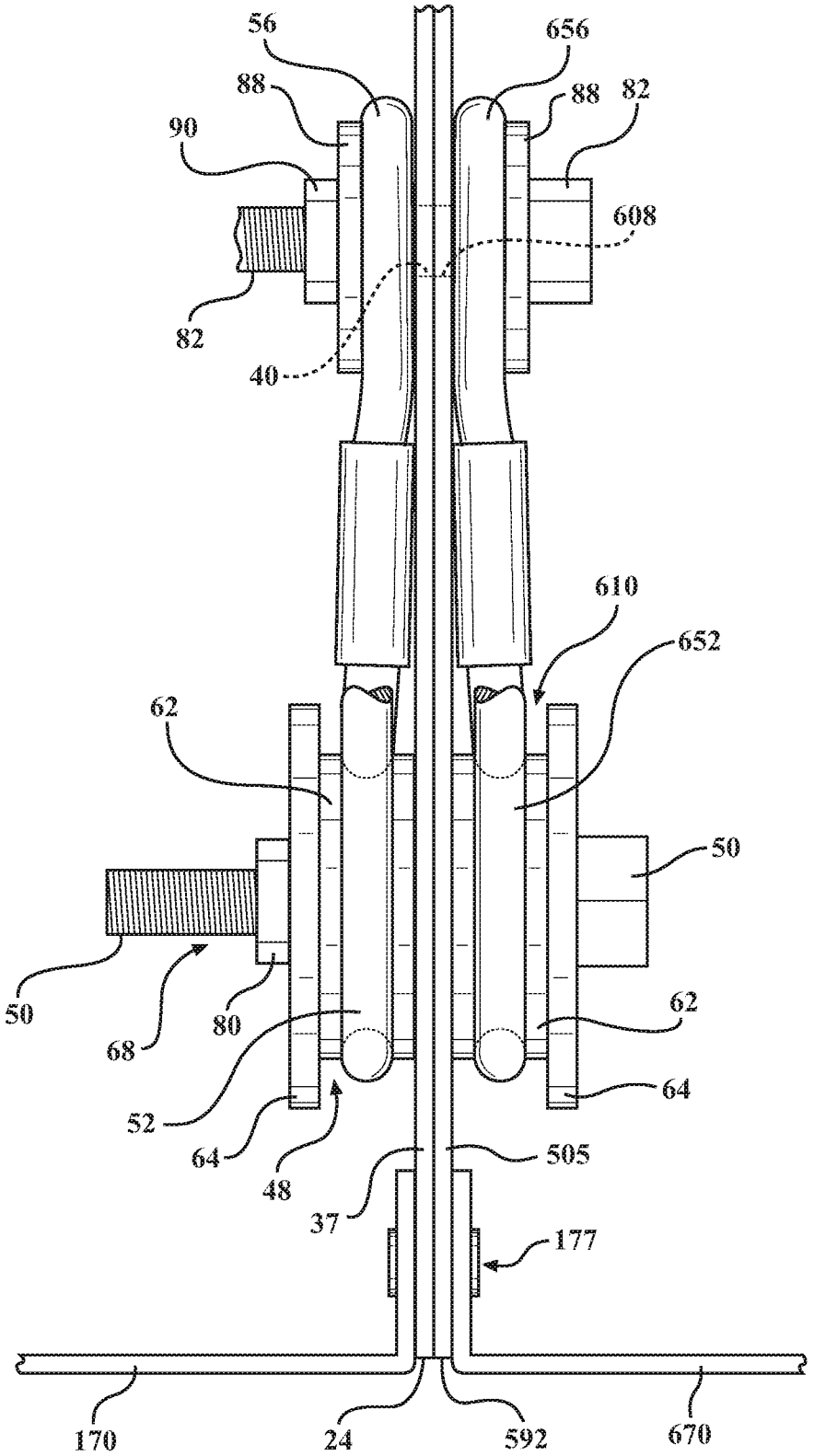
FIG. 40 is a top plan view of the portion of the storage apparatus of FIG. 39.
Figure 41:
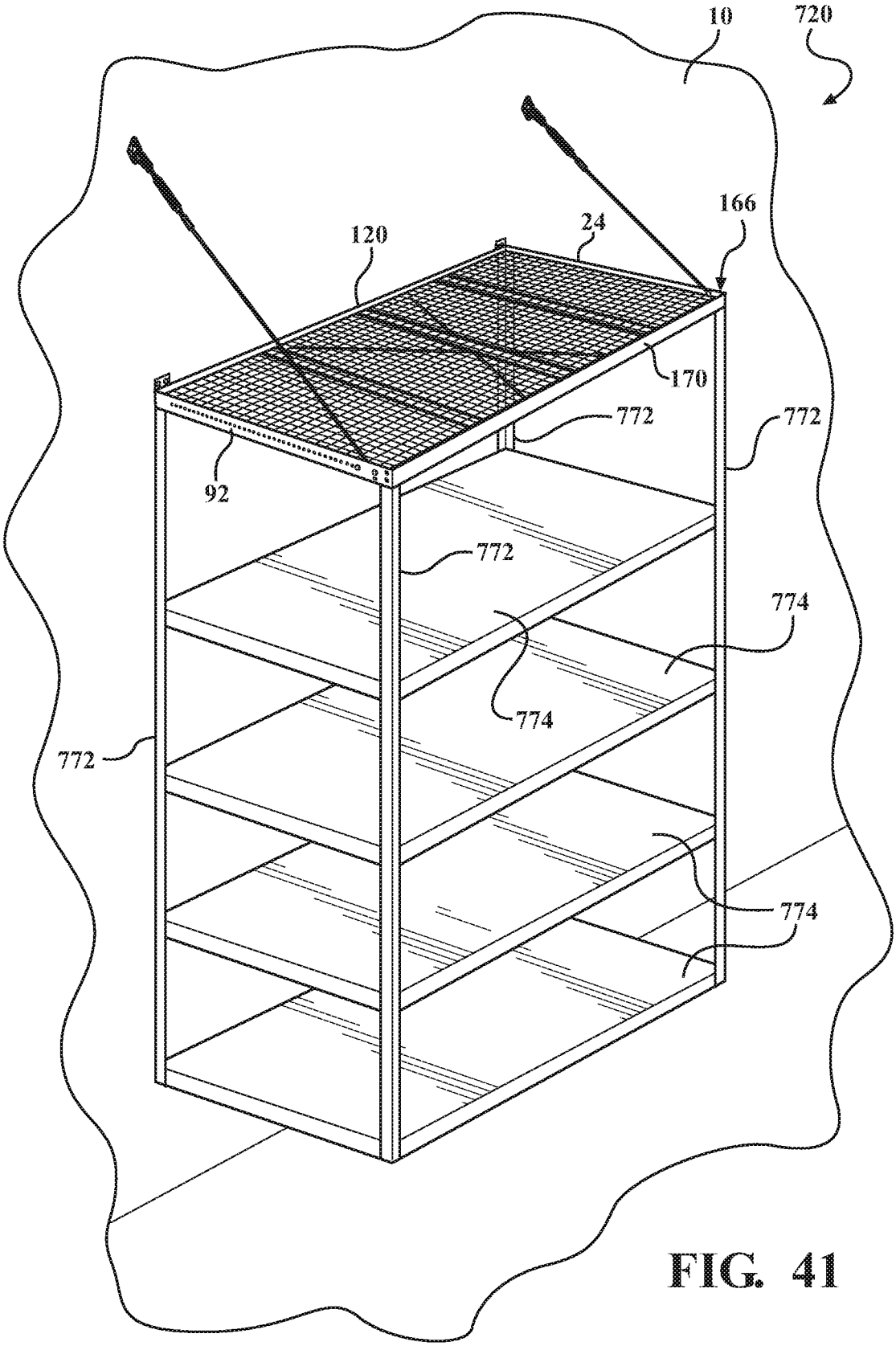
FIG. 41 is a perspective view of another embodiment of the storage apparatus including a support frame and a plurality of vertical beams and a plurality of shelves supported by the support frame.

The second support frame 168 further includes third 640 and fourth 652 cables. The cables 640, 652 are attached to the first 166 and second 168 support frames such that the second support frame 168 is suspended under the first support frame 166. The third cable 640 has first 644 and second 646 cable ends. As shown in FIGS. 38-40, the first cable end 644 of the third cable 640 is attached to the first support beam 24 of the first support frame 166. The first cable end 644 may be attached to the first support beam 24 utilizing a suitable fastening system 648. In an embodiment, and as best shown in FIG. 40, the storage apparatus 520 further includes a turnbuckle 650 coupled to the fastening system 648.

The second cable end 646 of the third cable 640 is removably attached to the first dependent support beam 524 of the second support frame 168 at a selected one of the first plurality of mounting positions 540 of the first dependent support beam 524. Additionally, the third cable 640 is coupled to the third alignment device 548 to align the second cable end 646 of the third cable 640 with the first dependent support beam 524 of the second support frame 168 and the selected one of the plurality of mounting positions 540 of the first dependent support beam 524. The third cable 640 is movable along the third alignment device 548 to move the second cable end 646 of the third cable 640 from the selected one of the first plurality of mounting positions 540 of the first dependent support beam 524 to another one of the first plurality of mounting positions 540 of the first dependent support beam 524 for adjusting the second support frame 168 relative to the first support frame 166. All of this is accomplished in the same manner as adjustment of the first cable 52 utilizing the first alignment device 48 described in detail above.

The fourth cable 652 has first 654 and second 656 cable ends. As shown in FIGS. 38-40, the first cable end 654 of the fourth cable 652 is attached to the second support beam 92 of the first support frame 166. The first cable end 644 may be attached to the second support beam 92 utilizing the fastening system 648 and turnbuckle 650 described above.

The second cable end 656 of the fourth cable 652 is removably attached to the second dependent support beam 592 of the second support frame 168 at a selected one of the second plurality of mounting positions 608 of the second dependent support beam 592. Additionally, the fourth cable 652 is coupled to the fourth alignment device 610 to align the second cable end 656 of the fourth cable 652 with the second dependent support beam 592 of the second support frame 168 and the selected one of the second plurality of mounting positions 608 of the second dependent support beam 592. The fourth cable is movable along the fourth alignment device 610 to move the second cable end 656 of the fourth cable 652 from the selected one of the second plurality of mounting positions 608 of the second dependent support beam 592 to another one of the second plurality of mounting positions 608 of the second dependent support beam 592 for adjusting the second support frame 168 relative to the first support frame 166.

In an embodiment, the storage apparatus 520 includes the first 166 and second 168 support frames arranged in the same horizontal plane $P_H$, as best shown in FIGS. 38 and 39. In this embodiment, the first 166 and second 168 support frames are interconnected to one another. For example, the first support 166 and second 168 support frames are arranged such that the top surface 37 of the first support beam 24 of the first support frame 166 falls within the same horizontal plane $P_H$ as the top surface 505 of the second dependent support beam 592 of the second support frame 168 and the frames 166, 168 are attached to one another. For example, the first support beam 24 of the first support frame 166 is attached to the adjacently-positioned second dependent support beam 592 of the second support frame 168 utilizing the end bracket 156 as shown in FIG. 38 and/or a fastening system 177 as shown in FIG. 39. The support frames 166, 168 are attached to one another utilizing a single mounting post 82, which is disposed through aligned apertures 40, 108 of the first support beam 24 of the first support frame 166 and the second support beam 92 of the second support frame 168. Additionally, the support frames 166, 168 are attached to one another utilizing a single fastener 68 disposed through both of the first support beam 24 of the first support frame 166 and the fourth support beam 170 of the second support frame 168. This fastener 68 is also used to secure both the first alignment device 48 of the first support frame 166 and the fourth alignment device 610 of the second support frame 168. For instance, the first alignment device 48 of the first support frame 166 and the fourth alignment device 610 of the second support frame 168 are aligned along the longitudinal axis C and the fastener (or bolt) 50 is disposed through the first 166 and second 168 support frames and the aligned first 48 and fourth 610 alignment devices to attach the first alignment device 48 of the first support frame 166 to the first support beam 24 and the fourth alignment device 610 of the second support frame 168 to the second dependent support beam.

Figure 42:
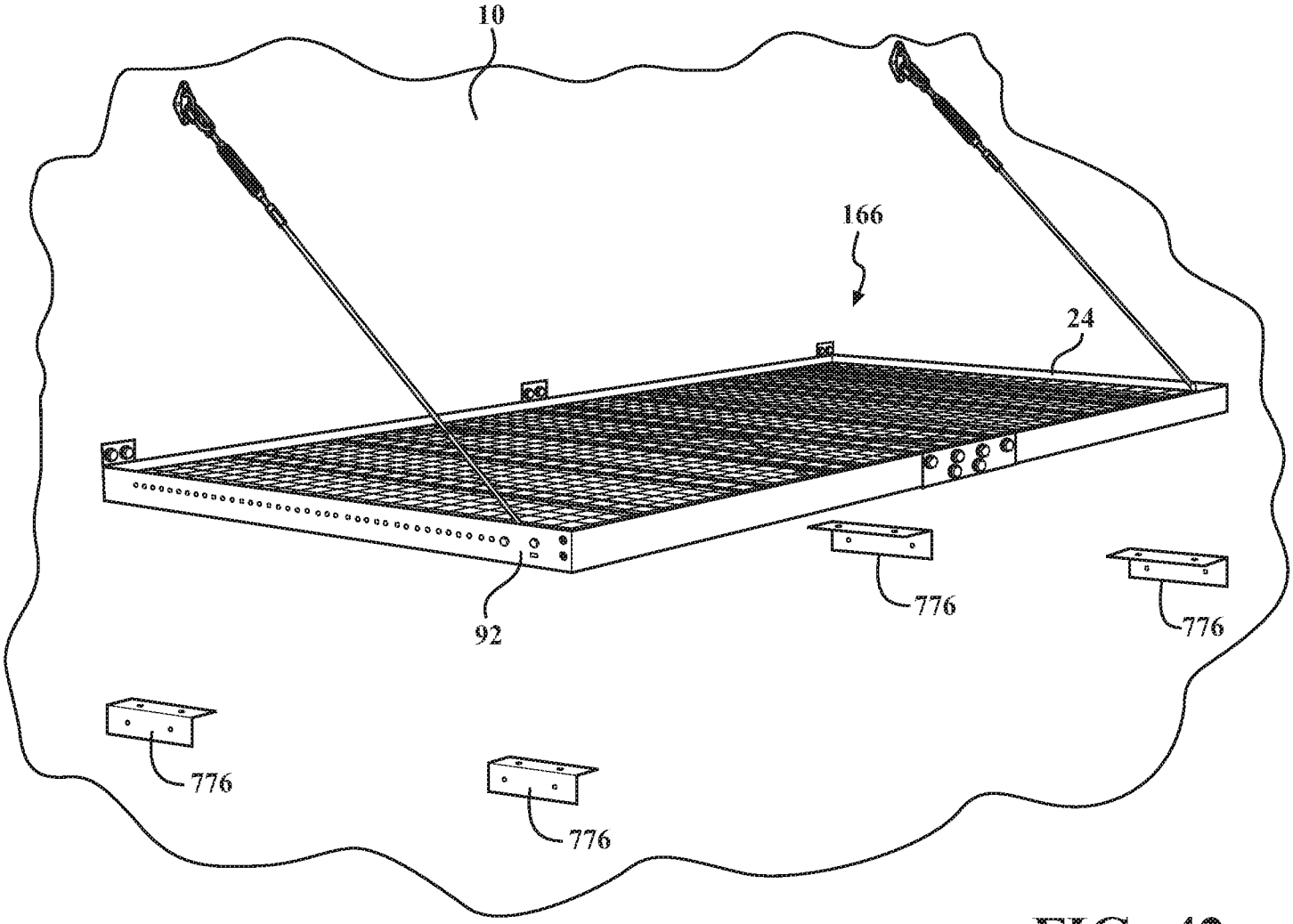
FIG. 42 is a partially exploded view of a portion of the storage apparatus of FIG. 41.
Figure 43:
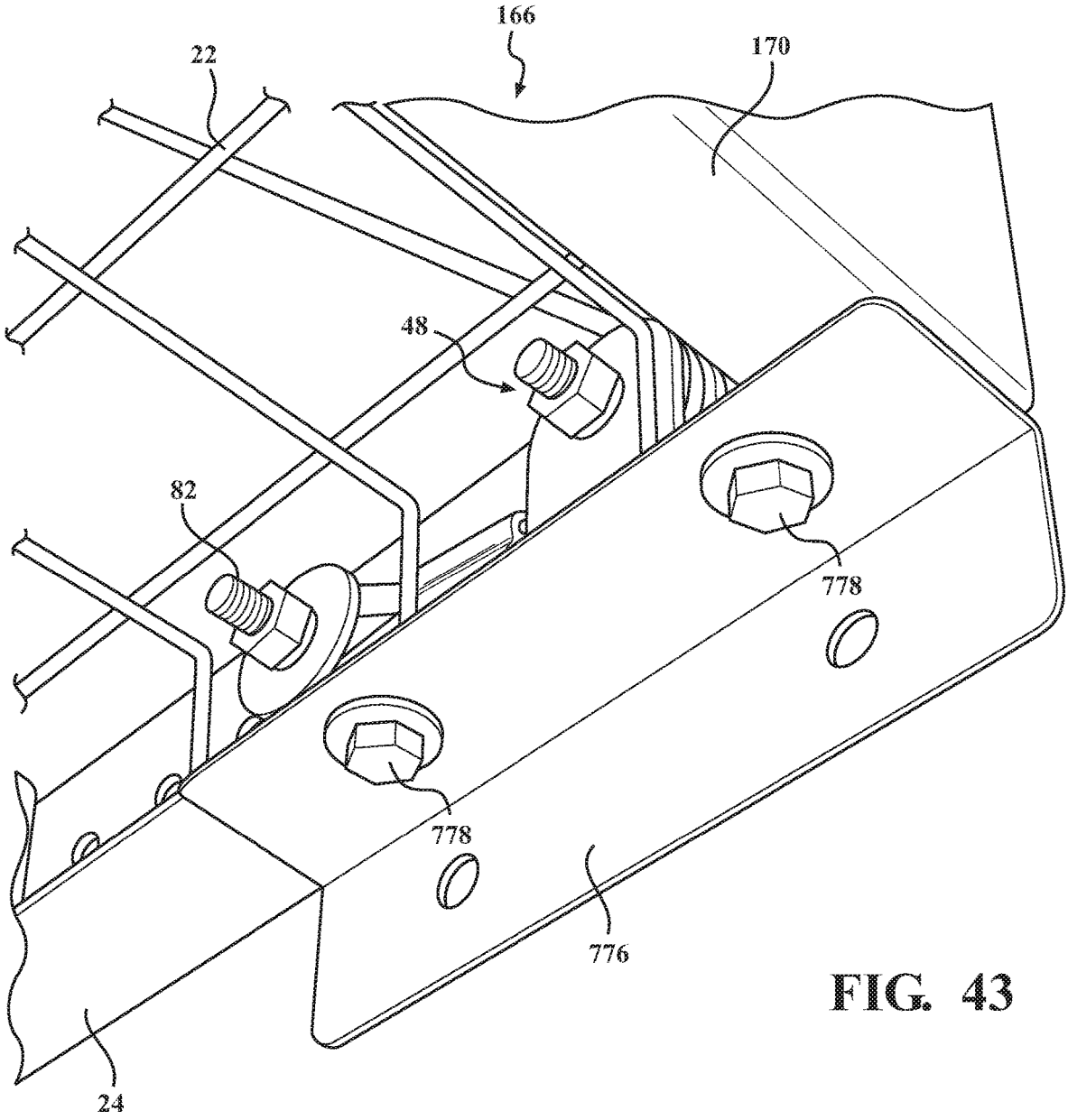
FIG. 43 is a perspective view of a portion of the storage apparatus of FIG. 41 with the vertical support beams removed.
Figure 44:
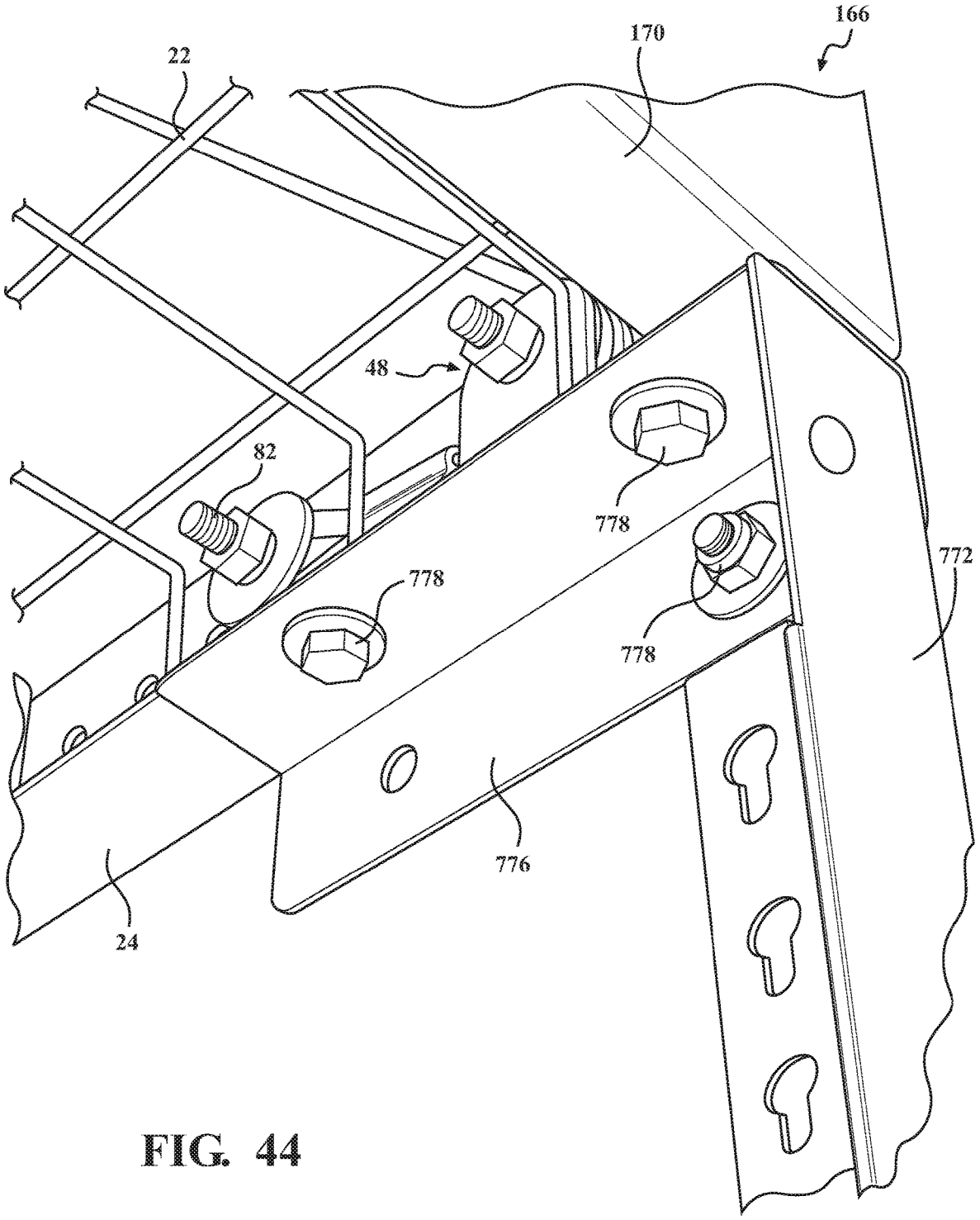
FIG. 44 is a perspective view of a portion of the storage apparatus of FIG. 41.
Figure 45:
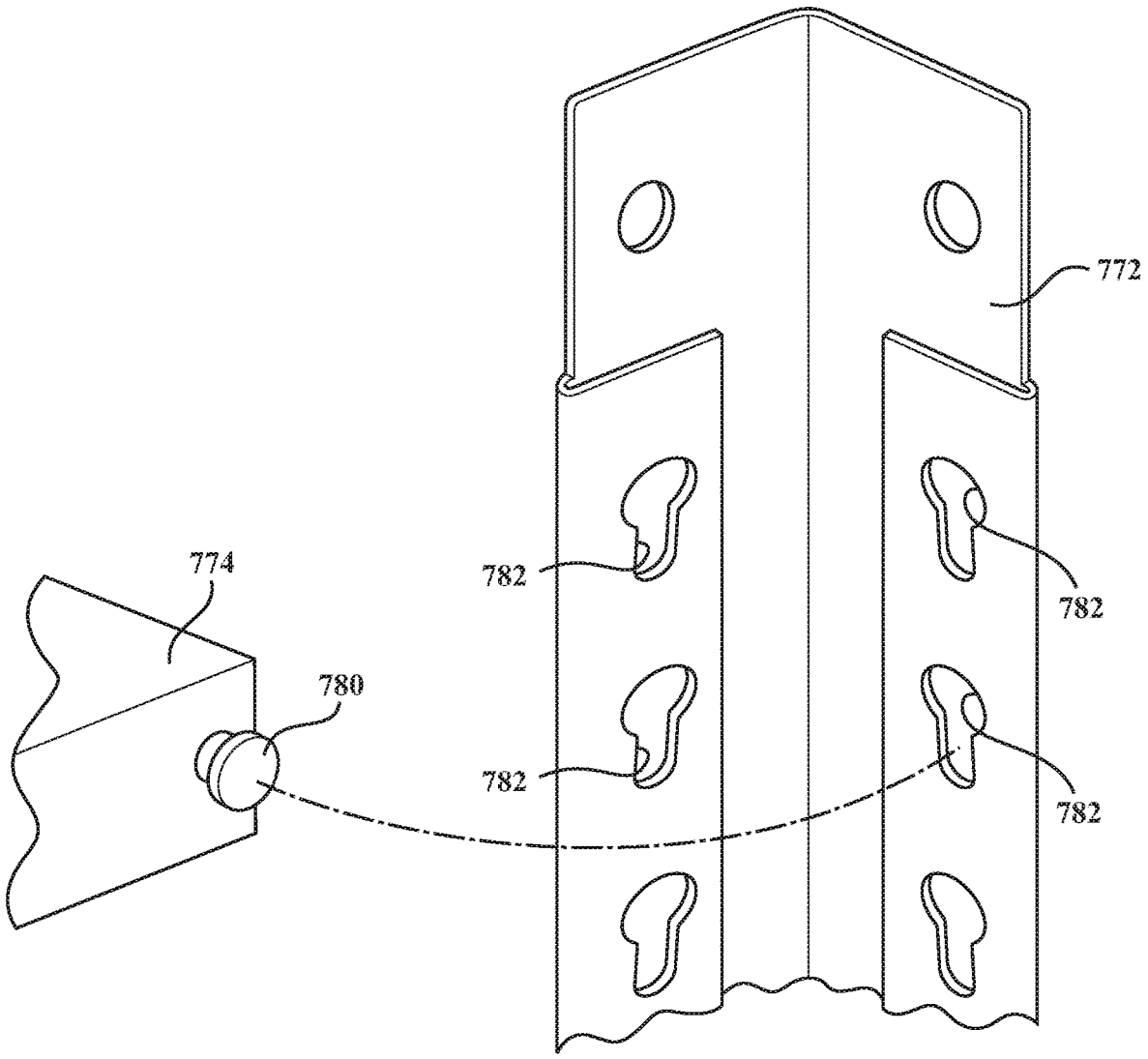
FIG. 45 is an exploded view of another portion of the storage apparatus of FIG. 41.

Another embodiment of the storage apparatus 720 is described below with reference to FIGS. 41-45. In this embodiment, the storage apparatus 720 includes the first support frame 166, a plurality of vertical beams 772 and a plurality of shelves 774 supported by the plurality of vertical beams 772. The plurality of vertical beams 772 are attached to the support frame 166 such that the plurality of shelves 774 is supported below the support frame 166. With reference to FIGS. 42-44, a pair of vertical beams 772 is attached directly to the first support beam 24 utilizing brackets 776 and suitable fasteners 778, and a pair of vertical beams 772 is attached directly to the second support beam 92 utilizing brackets 776 and suitable fasteners 778. The shelves 774 are coupled to the vertical beams 772 by any suitable means. For example, and as shown in FIG. 45, each shelf 774 may have a fastener, such as a rivet 780, and each vertical beam 772 may have a plurality of apertures 782 arranged along the length of the beam 772. The rivets 780 of the shelf 774 mate with aligned apertures 782 of oppositely-arranged beams 772 to removably fix the shelf 774 to the vertical beams 772. It should be appreciated that the storage apparatus 720 can have any number of shelves 774, and adjacent shelves 774 may have any spacing.

The invention has been described in an illustrative manner, and it is be understood that the terminology which has been used is intended to be in the nature of words of description rather than of limitation. It is now apparent to those skilled in the art that many modifications and variations of the present invention are possible in light of the above teachings. It is, therefore, to be understood that the invention may be practiced otherwise than as specifically described.

What is claimed is:

1. A storage apparatus attachable to a surface, said storage apparatus comprising:

a support beam defining a beam axis and adapted to be coupled to the surface with said support beam having first and second beam ends and defining a first plurality of mounting positions between said first and second beam ends;

a support structure abutting and being supported by said support beam;

an alignment device attached to said support beam; and a cable having first and second cable ends with said first cable end adapted to be attached to the surface and said second cable end removably attached to said support beam at a selected one of said first plurality of mounting positions, with said cable coupled to said alignment device to align said second cable end with said support beam and said selected one of said first plurality of mounting positions, and said cable movable along said alignment device to move said second cable end from said selected one of said first plurality of mounting positions to another one of said first plurality of mounting positions for adjusting said support structure relative to the surface.

2. The storage apparatus as set forth in claim 1 wherein said alignment device is attached proximate said second beam end.

3. The storage apparatus as set forth in claim 1 wherein said support beam has inner and outer sides and said alignment device is disposed adjacent said inner side.

4. The storage apparatus as set forth in claim 1 wherein said alignment device includes a groove with said cable seated within said groove.

5. The storage apparatus as set forth in claim 1 wherein said alignment device includes a bracket having a locating tab, and said support beam defines an opening configured to receive said locating tab to maintain a position of said alignment device to secure said cable within said groove.

6. The storage apparatus as set forth in claim 5 wherein said alignment device includes a pulley sandwiched between said bracket and said support beam.

7. The storage apparatus as set forth in claim 1 wherein said first plurality of mounting positions is further defined as a first plurality of apertures and further comprising a mounting post coupled to a selected one of said first plurality of apertures and configured to receive said second cable end to attach said second cable end to said support beam.

8. The storage apparatus as set forth in claim 7 wherein each one of said first plurality of apertures is evenly spaced from an adjacent one of said first plurality of apertures.

9. The storage apparatus as set forth in claim 7 wherein each one of said first plurality of apertures is separated from an adjacent one of said first plurality of apertures.

10. The storage apparatus as set forth in claim 7 wherein said selected one of said first plurality of apertures is spaced inwardly a first distance from said second beam end for forming a first height of said support structure relative to the surface, and another one of said first plurality of apertures is spaced inwardly a second distance from said second beam end with said second distance larger than said first distance for forming a second height of said support structure relative to the surface.

11. The storage apparatus as set forth in claim 1 further comprising a mounting post attached to said support beam at said selected one of said first plurality of mounting positions with said mounting post receiving said second cable end to attach said second cable end to said support beam at said selected one of said first plurality of mounting positions.

12. The storage apparatus as set forth in claim 1 wherein said support beam is further defined as a first support beam and further comprising a second support beam spaced from said first support beam with said second support beam having first and second beam ends and defining a second plurality of mounting positions between said first and second beam ends of said second support beam.

13. The storage apparatus as set forth in claim 12 wherein said cable is further defined as a first cable and said alignment device is further defined as a first alignment device with said support structure abutting the first and second support beams and further comprising:

a second alignment device attached to said second support beam; and a second cable having first and second cable ends with said first cable end of said second cable adapted to be attached to the surface and said second cable end removably attached to said second support beam at a selected one of said second plurality of mounting positions, with said second cable coupled to said second alignment device to align said second cable end of said second cable with said second support beam and said selected one of said second plurality of mounting positions, and said second cable movable along said second alignment device to move said second cable end from said selected one of said second plurality of mounting positions to another one of said second plurality of mounting positions for adjusting said support structure relative to the surface.

14. The storage apparatus as set forth in claim 13 wherein said second plurality of mounting positions of said second support beam is further defined as a second plurality of apertures and further comprising a mounting post coupled to a selected one of said second plurality of apertures and configured to receive said second cable end of said second cable to attach said second cable end of said second cable to said second support beam.

15. The storage apparatus as set forth in claim 14 wherein said support structure defines a longitudinal axis transverse to said beam axis and said first plurality of mounting positions is further defined as a first plurality of apertures with said first plurality of apertures of said first support beam evenly spaced from one another and said second plurality of apertures of said second support beam evenly spaced from one another with a selected one of said first plurality of apertures of said first support beam and a selected one of said second plurality of apertures of said second support beam aligned along said longitudinal axis.

16. The storage apparatus as set forth in claim 13 further comprising a third support beam extending transverse to said beam axis and attached to said first and second support beams.

17. The storage apparatus as set forth in claim 16 further comprising a fourth support beam spaced from said third support beam, extending transverse to said beam axis, and attached to said first and second support beams, with said fourth support beam adapted to be coupled to the surface;

wherein said first, second, third, and fourth support beams collectively define a support frame with said support structure abutting and being supported by said support frame.

18. The storage apparatus as set forth in claim 17 wherein said support frame is further defined as a first support frame and said first support beam has a top surface and further comprising a second support frame coupled to said first support frame with said second support frame comprising:

a first dependent support beam defining a beam axis and adapted to be coupled to the surface with said first dependent support beam having first and second beam ends and defining a first plurality of mounting positions between said first and second beam ends, with said first dependent support beam of said second support frame having a top surface and said second support frame arranged adjacent said first support frame such that said top surface of said first support beam of said first support frame and said top surface of said first dependent support beam of said second support frame are aligned;

a second dependent support beam spaced from said first dependent support beam and extending along said beam axis of said first dependent support beam with said second dependent support beam having first and second beam ends and defining a second plurality of mounting positions between said first and second beam ends of said second dependent support beam;

a third alignment device attached to said first dependent support beam of said second support frame;

a fourth alignment device attached to said second dependent support beam of said second support frame;

a third cable having first and second cable ends with said first cable end of said third cable adapted to be attached to said surface and said second cable end of said third cable removably attached to said first dependent support beam of said second support frame at a selected one of said first plurality of mounting positions of said first dependent support beam, with said third cable coupled to said third alignment device to align said second cable end of said third cable with said first dependent support beam of said second support frame and said selected one of said first plurality of mounting positions of said first dependent support frame; and a fourth cable having first and second cable ends with said first cable end adapted to be attached to said surface and said second cable end removably attached to said second dependent support beam of said second support frame at a selected one of said second plurality of mounting positions of said second dependent support beam, with said fourth cable coupled to said fourth alignment device to align said second cable end of said fourth cable with said second dependent support beam and said selected one of said second plurality of mounting positions of said second dependent support beam, wherein said third cable is movable along said third alignment device to move said second cable end of said third cable from said selected one of said first plurality of mounting positions of said first dependent support beam to another one of said first plurality of mounting positions of said first dependent support beam and said fourth cable is movable along said fourth alignment device to move said second cable end of said fourth cable from said selected one of said second plurality of mounting positions of said second dependent support beam to another one of said second plurality of mounting positions of said second dependent support beam for adjusting said second support frame relative to said surface.

19. The storage apparatus as set forth in claim 18 wherein said support structure defines a longitudinal axis transverse to said beam axis and said first alignment device of said first support frame and said fourth alignment device of said second support frame are aligned along said longitudinal axis and further comprising a fastener disposed through said first and second support frames and said aligned first and fourth alignment devices to attach said alignment device of said first support frame to said first support beam and said fourth alignment device of said second support frame to said second dependent support beam.

20. The storage apparatus as set forth in claim 18 wherein said first cable end of said third cable is attached to said first support beam of said first support frame and said second cable end of said third cable is attached to said first dependent support beam of said second support frame, and said first cable end of said fourth cable is attached to said second support beam of said first support frame and said second cable end of said fourth cable is attached to said second dependent support beam of said second support frame to suspend said second support frame under said first support frame.

21. The storage apparatus as set forth in claim 19 wherein said second support frame further comprises:

a third dependent support beam extending transverse to said beam axis of said first dependent support beam and attached to said first and second dependent support beams;

a fourth dependent support beam spaced from said third dependent support beam, extending transverse to said beam axis of said first dependent support beam, and attached to said first and second dependent support beams; and a bracket interconnecting said fourth support beam of said first support frame and said fourth dependent support beam of said second support frame.

22. The storage apparatus as set forth in claim 17 further comprising at least one cross beam supported by said third and fourth support beams with said at least one cross beam spaced from each of said first and second support beams and extending parallel to said beam axis, with said support structure abutting said at least one cross beam.

23. The storage apparatus as set forth in claim 22 wherein said support structure is further defined as a plurality of support racks each having a lip and said at least one cross beam defines a channel to receive said lip to removably secure said support rack to said at least one cross beam.

24. The storage apparatus as set forth in claim 17 further comprising a pair of support bars each having first and second bar ends with said first bar end attached to said third support beam and another pair of support bars each having first and second bar ends with said first bar end attached to said fourth support beam and said second bar ends of said pair of support bars and said other pair of support bars attached to one another at a location between said third and fourth support beams to stabilize said support frame.

25. The storage apparatus as set forth in claim 1 further comprising a plurality of vertical beams and a plurality of shelves supported by said plurality of vertical beams with said plurality of vertical beams attached to said support beam such that said plurality of shelves is supported below said support beam.

26. A storage apparatus comprising:

a support beam defining a beam axis;

a support structure abutting and being supported by said support beam with said support structure defining a longitudinal axis transverse to said beam axis; and a cross beam spaced from said support beam and extending transverse to said longitudinal axis with said cross beam defining a channel;

wherein said support structure is further defined as a plurality of support racks each having a lip with said lip of one of said plurality of support racks and said lip of an adjacent one of said plurality of support racks disposed within said channel of said cross beam to secure said one of said plurality of support racks and said adjacent one of said plurality of support racks to said cross beam, wherein said lip is removable from said channel of said cross beam by being lifted in a direction transverse to both said beam axis and said longitudinal axis.

27. The storage apparatus as set forth in claim 26 wherein said support beam is further defined as a first support beam and further comprising additional support beams spaced from one another and each of said additional support beams extending along said longitudinal axis with said cross beam supported by said additional support beams and movable along said longitudinal axis relative to said additional support beams to adjust a portion of said cross beam.

28. The storage apparatus as set forth in claim 26 wherein said support beam is further defined as a first support beam and further comprising additional support beams spaced from one another and each of said additional support beams extending along said longitudinal axis with said cross beam supported by said additional support beams, and wherein said additional support beam has a body and a ledge extending from said body with said cross beam movably supported on said ledge of said additional support beams.

29. The storage apparatus as set forth in claim 26 wherein said cross beam is one of a plurality of cross beams each defining a channel with said lip of said one of said plurality of support racks and said lip of said adjacent one of said plurality of support racks disposed within said channel of a common one of said plurality of cross beams.

30. The storage apparatus as set forth in claim 26 wherein said support beam is further defined as a first support beam having a body and a ledge extending from said body with said one of said plurality of support racks supported by said ledge of said first support beam.

31. The storage apparatus as set forth in claim 30 wherein said plurality of support racks includes an end rack having a main portion with opposing first and second sides and said lip extending from said first side of said main portion and disposed within said channel of said cross beam, and said end rack further having a foot extending from said second side of said main portion and seated against said ledge of said first support beam to mount said end rack to said first support beam and said cross beam.

32. The storage apparatus as set forth in claim 31 wherein said cross beam is one of a plurality of cross beams extending transverse to said longitudinal axis and said plurality of support racks further including a middle rack having a main portion with first and second sides, and said middle rack has a first lip extending from said first side of said main portion and disposed within one of said plurality of cross beams and a second lip extending from said second side of said main portion and disposed within an adjacent one of said plurality of cross beams.

33. The storage apparatus as set forth in claim 32 wherein one of said first and second lips of said middle rack and said lip of said end rack are disposed within said channel of a common one of said plurality of cross beams.

* * * * *